US008771000B2

(12) United States Patent
Melni

(10) Patent No.: US 8,771,000 B2
(45) Date of Patent: Jul. 8, 2014

(54) ELECTRICAL CONNECTORS AND METHODS OF MANUFACTURING AND USING SAME

(75) Inventor: Mark L. Melni, Twin Falls, ID (US)

(73) Assignee: Melni, LLC, Twin Falls, ID (US)

( * ) Notice: Subject to any disclaimer, the term of this patent is extended or adjusted under 35 U.S.C. 154(b) by 133 days.

(21) Appl. No.: 13/591,216

(22) Filed: Aug. 21, 2012

(65) Prior Publication Data

US 2013/0217250 A1 Aug. 22, 2013

Related U.S. Application Data

(63) Continuation of application No. 12/391,247, filed on Feb. 23, 2009, now Pat. No. 7,794,255, which is a continuation-in-part of application No. 13/306,653, filed on Nov. 29, 2011, now Pat. No. 8,246,370, which is a continuation of application No. 12/939,148, filed on Nov. 3, 2010, now Pat. No. 8,066,525, which is a continuation-in-part of application No. 12/871,819, filed on Aug. 30, 2010, now Pat. No. 7,901,233, which is a continuation of application No. 12/391,247.

(60) Provisional application No. 61/257,827, filed on Nov. 3, 2009, provisional application No. 61/030,470, filed on Feb. 21, 2008, provisional application No. 61/054,770, filed on May 20, 2008, provisional application No. 61/100,768, filed on Sep. 29, 2008, provisional application No. 61/106,473, filed on Oct. 17, 2008.

(51) Int. Cl.
*H01R 13/52* (2006.01)

(52) U.S. Cl.
USPC ..... 439/271

(58) Field of Classification Search
USPC ..... 439/271, 274, 289, 275, 248, 845
See application file for complete search history.

(56) References Cited

U.S. PATENT DOCUMENTS 9,369 A 11/1852 Richards
254,559 A 3/1882 Lothrop (Continued)

FOREIGN PATENT DOCUMENTS

WO WO2009105784 A2 8/2009
WO WO2011056901 A2 5/2011

OTHER PUBLICATIONS

Strain Relief Cord Connectors, http://www.remke.com/products/strain-relief-cord-connectors.php, commercially available prior to Aug. 2012.

(Continued)

*Primary Examiner* — Jean F Duverne
(74) *Attorney, Agent, or Firm* — Pedersen and Company, PLLC; Ken J. Pedersen; Barbara S. Pedersen

(57) ABSTRACT

An electrical connector forms electrical contact by tightening of a movable, electrically-conductive spiral around un-insulated wire or wires. The spiral coils around the wire multiple times and tightens on the wire(s) when either one or the other end, or both ends, of the spiral is/are rotated relative to the other. Various housing portions may be provided for connection to different portions of the spiral, to facilitate the tightening of the spiral and to cooperate with a latch/lock system to retain the spiral in tightened condition. Multiple spirals may be provided in one connector, including spirals that tighten around separate wires at opposite ends/side of the connector and/or in spiral ports extending transversely from a main spiral(s). Terminal ends or additional spiral units/ports may be connected to a given spiral, either permanently, semi-permanently, or detachably, for producing a wide variety of configurations and modular connection devices.

14 Claims, 36 Drawing Sheets

(56) References Cited

U.S. PATENT DOCUMENTS

| | | | | |
|---|---|---|---|---|
| 1,039,542 | A | 9/1912 | Kennington | |
| 1,649,923 | A | 11/1927 | Post | |
| 1,657,253 | A | 1/1928 | Fortin | |
| 1,858,816 | A | 5/1932 | Burkhardt | |
| 2,093,810 | A | 9/1937 | Karmazin | |
| 2,434,358 | A | 1/1948 | Frank | |
| 2,521,722 | A | 9/1950 | Hubbell et al. | |
| 2,724,097 | A | 11/1955 | Matthysse | |
| 2,724,736 | A | 11/1955 | Klumpp | |
| 2,792,560 | A | 5/1957 | Bollmeier | |
| 3,032,737 | A | 5/1962 | Rottmann | |
| 3,107,966 | A | 10/1963 | Bonhomme | |
| 3,110,755 | A | 11/1963 | Esser | |
| 3,206,833 | A | 9/1965 | Yonkers | |
| 3,497,607 | A | 2/1970 | Swanson | |
| 4,035,577 | A | 7/1977 | Loeber | |
| 4,087,157 | A | 5/1978 | Hodges | |
| 4,104,482 | A | 8/1978 | Scott | |
| 4,192,567 | A | 3/1980 | Gomolka | |
| 4,199,211 | A | 4/1980 | Kidder | |
| 4,268,104 | A | 5/1981 | Kidder | |
| 4,531,016 | A | 7/1985 | Duve | |
| 4,632,488 | A | 12/1986 | Long et al. | |
| 4,632,496 | A * | 12/1986 | Williams | 439/841 |
| 4,707,567 | A | 11/1987 | Blaha | |
| 4,740,656 | A | 4/1988 | Rich | |
| 4,803,779 | A | 2/1989 | Blaha | |
| 4,886,074 | A | 12/1989 | Bisping | |
| 4,924,035 | A | 5/1990 | Miller et al. | |
| 4,944,699 | A | 7/1990 | Velke et al. | |
| 5,018,251 | A | 5/1991 | Brown | |
| 5,228,875 | A | 7/1993 | Swenson | |
| 5,252,779 | A | 10/1993 | DiRienzo | |
| 5,259,395 | A | 11/1993 | Li | |
| 5,260,515 | A | 11/1993 | Braun | |
| 5,331,113 | A | 7/1994 | Soni et al. | |
| 5,418,331 | A | 5/1995 | Delalle | |
| 5,435,296 | A | 7/1995 | Vivenzio et al. | |
| 5,683,273 | A | 11/1997 | Garver et al. | |
| 5,695,369 | A * | 12/1997 | Swenson, Sr. | 439/784 |
| 5,881,435 | A | 3/1999 | Jermyn | |
| 5,925,853 | A | 7/1999 | Miller | |
| 5,975,939 | A | 11/1999 | Market | |
| 6,179,387 | B1 | 1/2001 | Nasset et al. | |
| 6,206,736 | B1 | 3/2001 | DeFrance et al. | |
| 6,358,103 | B1 | 3/2002 | Tomasino | |
| 6,471,554 | B2 | 10/2002 | Armistead et al. | |
| 6,494,753 | B1 | 12/2002 | Tomasino | |
| 6,530,126 | B2 | 3/2003 | Caveney et al. | |
| 6,570,094 | B2 | 5/2003 | King | |
| D478,555 | S | 8/2003 | Tomasino | |
| 6,692,313 | B1 | 2/2004 | Tomasino | |
| 6,695,653 | B1 | 2/2004 | Tomasino | |
| 6,773,312 | B2 | 8/2004 | Bauer et al. | |
| 6,814,630 | B1 | 11/2004 | Tomasino | |
| 6,830,491 | B1 | 12/2004 | Tomasino | |
| 6,851,966 | B1 | 2/2005 | Tomasino | |
| 6,866,550 | B1 * | 3/2005 | Tomasino | 439/784 |
| 6,878,880 | B2 | 4/2005 | King | |
| 6,914,191 | B2 | 7/2005 | Leith et al. | |
| 7,086,150 | B2 | 8/2006 | King et al. | |
| 7,794,255 | B2 | 9/2010 | Melni | |
| 7,901,233 | B2 | 3/2011 | Melni | |
| 8,066,525 | B2 | 11/2011 | Melni | |
| 8,246,370 | B2 | 8/2012 | Melni | |
| 2005/0045362 | A1 | 3/2005 | King et al. | |
| 2006/0042079 | A1 | 3/2006 | King et al. | |
| 2008/0023224 | A1 | 1/2008 | Gumley | |

OTHER PUBLICATIONS

Supplementary European Search Report, application No. EP 09 71 1835, derived from PTC/US09/034928, Applicant: Melni, date of completion: Aug. 5, 2013.

Tuff-Seal TM Strain Relief Cord Connectors, http://www.remke.com/products/strain-relief-cord-connectors.php, pp. 1-3, available at least as early as Jul. 2012.

PCT Written Opinion, PCT/US2009/034928, Sep. 30, 2009, Applicant: Melni.

PCT International Search Report, PCT/US2009/034928, Sep. 30, 2009, Applicant: Melni.

PCT International Search Report and the Written Opinion, PCT/US2010/05337, Jul. 13, 2011, Applicant: Melni.

PolarisTM Insulated Black Block Connectors, http://www.polarisconnectors.com, available prior to Nov. 3, 2009.

* cited by examiner 300
322
362
323
372
371
321
361

300
348
342
318
332
314
320
346
316
323
321

ELECTRICAL CONNECTORS AND METHODS OF MANUFACTURING AND USING SAME

This application is continuation-in-part of Non-Provisional application Ser. No. 13/306,653, filed Nov. 29, 2011 and issuing as U.S. Pat. No. 8,246,370 on Aug. 21, 2012, which is a continuation of Non-Provisional application Ser. No. 12/939,148, filed Nov. 3, 2010 and issued on Nov. 29, 2011 as U.S. Pat. No. 8,066,525, which is a continuation-in-part of Non-Provisional application Ser. No. 12/871,819, filed Aug. 30, 2010 and issued on Mar. 8, 2011 as U.S. Pat. No. 7,901,233, which is a continuation of Non-Provisional application Ser. No. 12/391,247, filed Feb. 23, 2009 and issued on Sep. 14, 2010 as U.S. Pat. No. 7,794,255, which claims benefit of provisional application Ser. No. 61/030,470, filed Feb. 21, 2008; Ser. No. 61/054,770, filed May 20, 2008; Ser. No. 61/100,768, filed Sep. 29, 2008; and Ser. No. 61/106,473, filed Oct. 17, 2008, the disclosures of which Non-Provisional and Provisional Applications are incorporated herein by this reference. Application Ser. No. 12/939,148 also claims benefit of Provisional Application Ser. No. 61/257,827, filed Nov. 3, 2009.

BACKGROUND OF THE INVENTION

1. Field of the Invention

The invention relates generally to electrical connectors that connect multiple wires together, or that connect one or more wires to other electrically-conductive equipment. More specifically, a connector comprises an electrically-conductive spiral for being tightened around conductive, stripped wire(s), wherein crimping is not required. In a loosened configuration, the conductive spiral is larger in diameter than the diameter of the stripped wire(s) being inserted into the spiral, but, after said insertion, the conductive spiral is manually tightened into a smaller-diameter configuration that creates electrical contact between said conductive spiral and the stripped wire(s). The preferred conductive spiral receives multiple stripped wires, and, upon tightening, forces said multiple, stripped wires into electrical contact with each other and with the spiral. For example, one spiral, or multiple spirals in series, may be used, and the wires may enter the spiral(s) from the same direction or from opposite directions, wherein the spiral(s) is/are adapted for electrical connection of the wires only to each other. Alternatively, the spiral(s) may be adapted for electrical connection of the wire(s) to a terminal end, such as an eyelet, fork, or a battery terminal, that is integral with or otherwise electrically connected to the spiral(s) and that may, in turn, be connected to another conductive device. Certain embodiments relate to connectors for large-diameter, heavy-duty wire/cable, for example, for utility connectors and/or connectors for 4 and 6 wire gauge. Certain embodiments may be used in the place of conventional connectors of the "block" style, and may have additional benefits of being easy to use, reliable, and modular. In certain embodiments, modularity allows connection of multiple modular units together to create connectors with various numbers, and orientations, of wire entry ports. In certain embodiments, water/moisture resistance or sealing is incorporated into the connector or modules. In certain embodiments, tightening the spiral(s) will lengthen the spiral(s) and the latch/lock system(s) and/or end caps and housing portions are adapted to accommodate this lengthening of the spiral(s). Tensioning the wires or cables that are electrically connected by certain embodiments of the connector will simply further tighten the grip of the spiral(s) on the wires/cables, for example, further lengthening the spiral(s) but still not unlocking/unlatching the spiral(s).

2. Related Art

Crimp connectors are popular electrical connectors that comprise at least one conductive cylindrical portion that is manually crimped (bent, smashed) against a wire inserted into the cylindrical portion. See FIGS. 15-17. An electrically-insulating sleeve typically surrounds the cylindrical portion. Some crimp connectors, typically called "butt splice" crimp connectors, include two, opposing generally cylindrical ends that each receives, and is crimped onto, a wire, for electrically connecting two wires. Said two generally cylindrical ends are integral parts of the single conductive member. See, for example, FIG. 14. Other crimp connectors comprise one cylindrical end for being crimped and an opposing utility terminal end, such as an eye, a fork, or other preferably flat shape for being captured between the head of a screw or bolt and the surface of said another conductive device. Or, other shapes may be used, such as a female or male quick-connect (and quick-disconnect) connector, including rectangular-tubular female (see FIG. 17) or cooperating blade male terminal end, and cylindrical or partial cylindrical female terminal ends or cooperating male pin terminal ends, and other utility terminal ends. In each of these crimp connectors, the only fastening of the connector to the wire is done by crimping the wall of the generally cylindrical end(s) with a crimping tool to force portions of the wall against or into the wire. The quality of the crimping, that is, the amount and permanence of the contact between the wall and the wire, varies greatly depending on the skill of the person doing the crimping. Further, a crimped connection between wall and wire comprises, at best, a small surface area of the wall abutting and/or gouging into a small surface area of the wire, said small surface area being portions or points around a circumferential surface of the wire only along a very short axial length of the wire.

Prior art crimp-connection devices frequently fail because inadequate pressure is used during crimping. Also, sometimes, the crimping action may "smash" the tubular portion of the connector rather than bending the tubular wall inward; such smashing tends to open the tubular wall at an axial seam, with at least one seam edge moving away from the wire, and, hence, tends to reduce the integrity and effectiveness of the connector. A further problem of such conventional crimp connectors is that is it not always easy to determine the quality and permanence of the crimped connection by visually inspecting the crimp.

An alternative conventional electrical connection may be called a "threaded wire connector," such as is illustrated in FIG. 18. Such a device may be described as a cap with internal threads tapering from large diameter at an outer end of the cap to smaller diameter at an inner end of the cap. As the threaded wire connector is pushed and turned onto the end of multiple wires, the threads of generally the same diameter as the combined diameter of the multiple wires become screwed around the surface of the wires and/or at least grip and compress the wires. Thus, even though the wires do not originally have any threads on their surfaces, the threaded wire connector enters into a type of threaded engagement with the metal of the wires, gripping and electrically connecting the wires. The threaded wire connector may be screwed off of the wire in the opposite direction. Only some of the threads of the threaded wire connector enter into threaded engagement with, and/or grip or gouge into, the wires. Thus, engagement between the threaded wire connector and the wires comprises threads along a short axial distance of the threaded wire connector gripping a short axial length of the wires. The larger diameter threads typically do not contact, or at least do not gouge or grip, the wire. The diameters of the threads of the threaded wire connector do not change before, during, or after use on the wire. The threads of the threaded wire connector do not move relative to each other. For examples of threaded wire connectors and/or threaded connectors, see FIG. 18 and also the following patents: Swanson U.S. Pat. No. 3,497,607, issued in 1968; Scott U.S. Pat. No. 4,104,482, issued in 1978; Duve U.S. Pat. No. 4,531,016, issued in 1985; Blaha U.S. Pat. No. 4,707,567, issued in 1987; Blaha U.S. Pat. No. 4,803,779, issued in 1989; Miller, et al, U.S. Pat. No. 4,924,035, issued in 1990; Braun, Jr. U.S. Pat. No. 5,260,515, issued in 1993; Soni, et al U.S. Pat. No. 5,331,113, issued in 1994; Delalle U.S. Pat. No. 5,418,331, issued in 1995; and Market U.S. Pat. No. 5,975,939, issued in 1999.

The patent literature also comprises spring connectors that work by a user forcing a rigid pin or rod into the center space of a spring that has an internal diameter significantly smaller than the diameter of the rigid pin or rod. Said forcing of the pin/rod causes the spring to expand its diameter and it is this expansion of the spring diameter, and the consequent tight fit, that causes the spring to grip the pin/rod. For example, see Fortin U.S. Pat. No. 1,657,253; Hubbell, et al. U.S. Pat. No. 2,521,722; Williams U.S. Pat. No. 4,632,486, issued in 1986; and Bauer, et al. U.S. Pat. No. 6,773,312. Many of these spring connectors are designed so that rotating the rigid pin/rod may be done to loosen the spring's grip on the pin/rod for removal of the pin/rod.

The patent literature also comprises strain relief devices that mechanically support and/or reinforce insulation-covered electrical cords, for example, a distance from a conventional plug or other convention electrical connection, to protect the electrical cord from being damaged. See for example, Burkhardt U.S. Pat. No. 1,858,816; Klump, Jr. U.S. Pat. No. 2,724,736; and Rottmann U.S. Pat. No. 3,032,737; and Long U.S. Pat. No. 4,632,488. These strain relief devices typically comprise flexible covers or sleeves that surround only insulated portions of a wire/cable and do not form any type of electrical contact or play any role in electrical conduction.

There is still a need for an electrical connector that quickly and reliably connects wires to each other, or wires to a terminal end that is then bolted or screwed to a conductive surface or to a terminal end that is then quick-connected into another conductive member. In view of the millions or billions of such electrical connections that must be made every year in the construction, utility, computer and information technology (IT), automotive, and other electrician and IT trades, such an electrical connector should be economical, compact, and preferably permanent. There is a need for a connector, and a need for methods of installing the connector, wherein the installer may be certain that a secure and permanent connection with a large electrical contact surface area may be made. The present invention meets these and other needs.

SUMMARY OF THE INVENTION

The present invention comprises an electrical connector that comprises a conductive spiral that is moveable from at least one relatively large diameter configuration, into which stripped wire(s), cable(s), or other elongated conductive elements may be inserted, to at least one relatively smaller, or reduced, diameter configuration that grips said stripped wire(s), cable(s), or other elongated elements. The engagement of the conductive spiral against the stripped wire(s) or other un-insulated conductive element(s) forms an electrical connection between the conductive spiral and the wire(s) or element(s) and, in certain embodiments wherein multiple stripped/un-insulated wires/elements are inserted into the conductive spiral, the spiral also forces the wires/elements together into electrical contact with each other. The conductive spiral is preferably sized in diameter so that, in the large-diameter configuration, the inner diameter of the spiral is larger than the combined diameter of the wire(s)/element(s) that are to be inserted, so that little if any resistance to insertion of the wire(s)/element(s) is created by the spiral.

Conductive spirals according to a first group of embodiments of the invention may comprise a conductive terminal end, wherein the terminal end may protrude from the coiled portion of the spiral, so that stripped wire(s)/element(s) inside the conductive spiral are also in electrical connection with said terminal end. The utility terminal end may be an eyelet, fork, battery terminal, or other flat or ring member, for being bolted or screwed to a conductive surface, or a female or male quick-connect/disconnect piece that relies on cylindrical or rectangular tubular mating members, for example. Preferably, the terminal end is directly attached to, or integral with, the coiled portion of the spiral so that the coils and terminal end form a single unitary piece with no break or interruption in the electrical conductivity of said single unitary piece.

Conductive spirals according to a second group of embodiments of the invention electrically connect together stripped multiple wires/elements from separate cables by compression of said stripped multiple wires/elements together in a bundle. Such conductive spirals preferably have no protruding terminal end. Said stripped multiple wires/elements may enter the conductive spiral(s) from the same direction. Alternatively, said stripped multiple wires/elements may enter the conductive spiral(s) from opposite directions, for example, wherein a conductive spiral comprises spiral portions at two opposite ends of the spiral unit, for insertion of wire(s)/element(s) toward each other from opposite directions.

Conductive spirals according to a third group of embodiments of the invention may comprise a conductive protruding elongated member, such as a dowel, bar, tube, or other fastener that is electrically connected to a spiral or spirals, and that protrudes to electrically connect to another spiral or spirals. For example, this third group may comprise a modular system, wherein each of a plurality of modules has a spiral or spirals, and wherein at least one dowel or other elongated member or fastener is electrically connected to the spiral(s) and protrudes at an angle to the longitudinal axis of the spiral(s) to electrically connect to the spiral(s) of an adjacent module. Further, the protruding elongated member or fastener may be one or the only means of mechanically connecting the module to said adjacent module. Preferred embodiments of such a modular system, for example, include modules that: 1) receive wire(s) in a single port from a single direction; 2) receive wire(s) in multiple ports extending in the same direction from the main body of the module, so that the wire(s) enter the ports from the same direction; and/or 3) receive wire(s) into multiple ports extending in different directions from the main body of the module.

In the preferred embodiments, the conductive spiral(s) are preferably sized to be, when relaxed in the larger-diameter configuration, larger than the combined diameter of the wire(s)/element(s) being inserted into the conductive spiral, so that the wire(s)/element(s) may be easily inserted into the conductive spiral. Only upon twisting of one end of the conductive spiral(s) relative to their other end(s) will the spiral(s) reduce in diameter to an extent that the spiral(s) will exert substantial force on the wire(s)/element(s) inside the spiral(s) to create a reliable and secure electrical connection between the spiral(s) and the wire(s)/element(s) and to prevent removal of the wire(s)/element(s) from the spiral(s).

In the preferred embodiments, the outer surfaces of the conductive spiral(s) are substantially surrounded with housing portions that insulate the conductive spiral(s) to prevent electric shock and short-circuiting, and that provide a latch/lock system to retain the spiral(s) in the tightened configuration and a handle system that allows a user to tighten the spiral(s). While the housing portions perform important functions for operation of the preferred connectors, the conductive spiral(s), the terminal end if any, and the protruding elongated members in modular systems if any, and the wires/elements inserted into the conductive spiral(s), are preferably the only conductive structure that is required to affect the electrical connection.

BRIEF DESCRIPTION OF THE DRAWINGS

FIGS. 46-50 are perspective views of some, but not the only, embodiments of block-style connectors, that may be used as stand-alone connectors, or that may be modules connected into assemblies, for example, as portrayed in FIG. 50.

DETAILED DESCRIPTION OF PREFERRED EMBODIMENTS

Figures 1, 2:
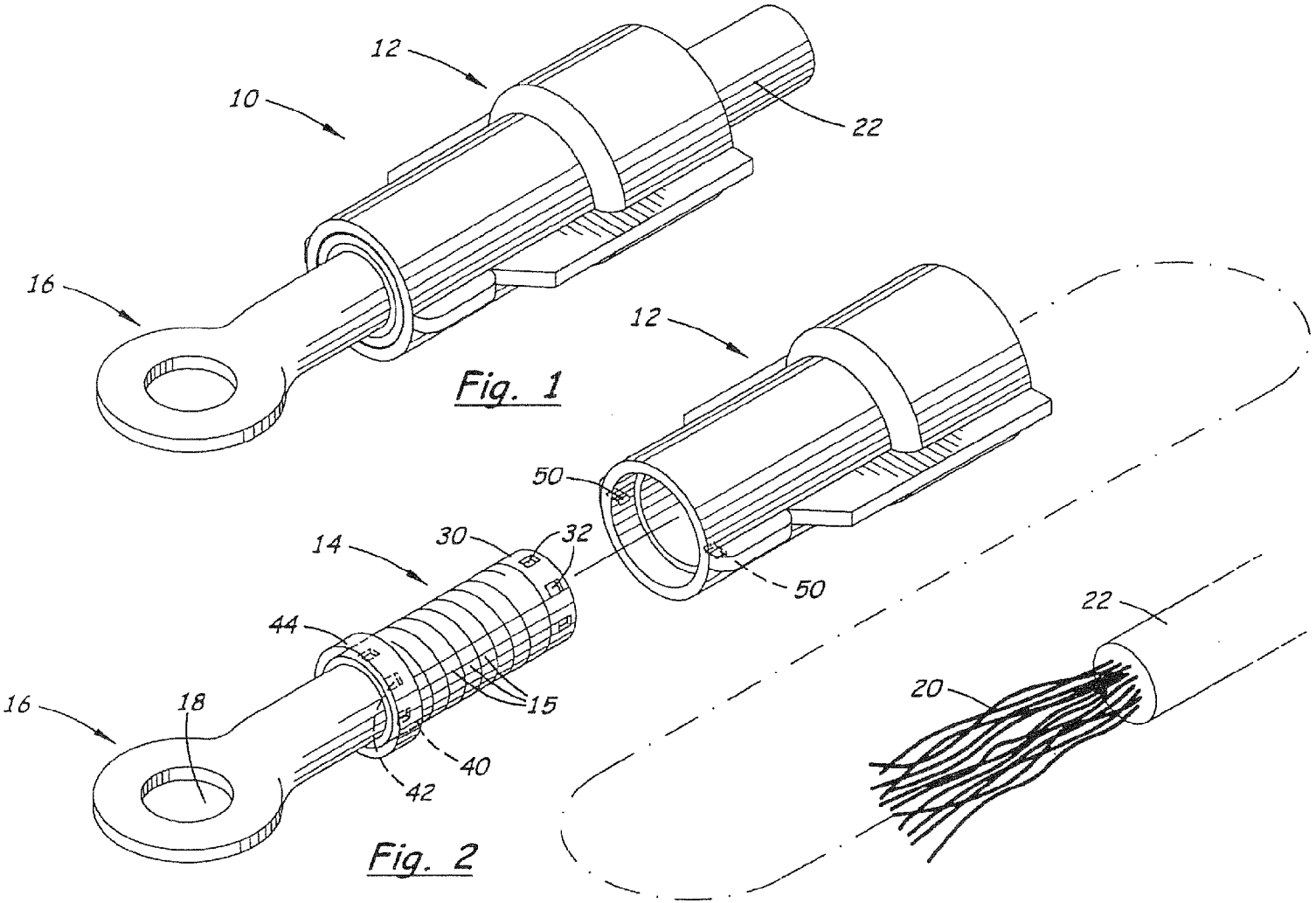
FIG. 1 is a perspective view of one embodiment of the invented spiral electrical connector, with an electrical cable installed in the connector.
FIG. 2 is an exploded, perspective view of the embodiment of FIG. 1.

Referring to the Figures, there are shown several, but not the only, embodiments of the invented spiral electrical connectors. The connectors allow one or more stripped, electrically-conductive wires/cables/elements to be connected to other un-insulated, conductive wires/cables/elements. One may note that the term "conductive" is used in this Description and in the Claims for simplicity, and is understood to mean electrically-conductive. The connectors may be used with wire, cable, and other elongated conducting material, but the term "wire" is used herein for simplicity and includes single-strand, multiple-strand (including those that are braided, twisted, woven and/or otherwise grouped) wires and conducting material having at least a portion that is elongated for being inserted into the connector. The preferred embodiments are particularly beneficial in connecting multiple stripped, conductive strands (also called "filaments") to each other or to another conductive elements or surfaces, as said multiple strands can effectively be inserted into the enlarged, relaxed spiral, even though each strand is flexible. Said strands are not required to, and in fact it is preferred that they do not, exert significant force on the spiral(s) when being inserted into the central passageway of spiral(s), and, specifically, it is preferred that the strands do not expand, stretch, or enlarge the spiral(s) when being inserted into the spiral.

The preferred conductive spiral extends circumferentially around the outside of wire multiple times, that is, at least twice for a total of at least 720 degrees. More preferably, there are many spiral wraps around the wire, for example, 5-10 for a total of 1800-3600 degrees. By moving one end of the spiral(s) relative to the other in opposite directions around the wire, the wrapping of the spiral(s) may be tightened or loosened on the wire depending on the directions chosen. For example, the spiral(s) may be moved from a relaxed or relatively loose configuration that allows insertion of the wire into the hollow central space ("passageway") of the spiral, to a tightly-wrapped configuration that grips the wire all the way around the circumference of the wire along a length of the wire that is generally equal to the axial length of the spiral. In preferred embodiments, the spiral wraps around a length of the wire that is several times the diameter of the wire. The spiral(s) may be a right-hand spiral or a left-hand spiral, and will be tightened or loosened accordingly, as will be understood by one of skill in the art after reading and viewing this disclosure.

In both the loosened and the tightened configurations, the preferred spiral wraps are all the same or generally the same diameter. In certain embodiments of the tightened configuration, the entire or substantially the entire interior surface of the spiral contacts the wire. Therefore, in certain embodiments of the tightened configuration, the preferred flat interior surface of the spiral forms electrical contact with the wire over a surface area that is generally defined by a) circumference of the wire times b) the length of a portion of the wire that is several times the wire diameter. This contact surface area is large compared to a contact surface area in a crimped connector that is defined by a fraction of the wire circumference times a length of the wire that is typically equal to or less than the diameter of the wire. This contact surface area is also large compared to a contact surface area in a threaded wire connector that is defined by the thin sharp edges of a few threads of different diameters.

In certain embodiments, the spiral wraps may be formed from conductive metal tubular stock, for example, by providing a spiral cut or cuts through the wall of a metal tube. The tube wall is preferably rigid and/or thick enough that, after being cut, it remains in its original diameter and configuration, which is the "relaxed" configuration. The tube diameter is chosen so that the desired wire will easily slide into the hollow center of the tube in this relaxed configuration. The tube wall is preferably flexible enough that twisting/rotating the tube/spiral ends relative to each other may be done, whereby the diameter of the tube/spiral reduces and captures the wire. Upon locking the tube/spiral in the tightened configuration, the stripped wire remains captured and in electrical contact with the interior surface of the tube/spiral.

In certain embodiments, the spiral may be made from, or be like, a coiled spring, but unlike prior art spring embodiments discussed above, a spring of the invented embodiments would form a relatively large diameter when in the relaxed configuration (larger than the combined diameter of any wire(s) being inserted), and is tightened by the user around the wire(s) to a smaller-diameter configuration to grip the wire, and then latched/locked in that smaller-diameter configuration. A spiral that is made from, or like, a coiled spring may have the disadvantage of each coil/wrap being circular or oval in cross-section, rather than flat or generally flat, and therefore not presenting and pressing as much internal coil surface area against the wire being held. Alternatively, therefore, the internal coil surface may be modified or sharpened to better contact and grip the wire.

In certain embodiments, the spiral unit is formed by cutting or stamping a flat shape from a conductive, flat metal sheet, and then curling (rolling, bending) the flat shape into the desired spiral shape. The flat shape, and hence the resulting spiral shape, may include a terminal end if desired. Many of said flat shapes may be cut or stamped out of the same sheet at the same time, with little or no waste metal. Once separated from the adjacent flat shapes, an individual flat shape may be curled (rolled, bent) into the desired spiral unit and its ends may be welded or otherwise tacked/fixed to remain in the proper generally cylindrical tubular shape. See, for example, FIGS. 36, 36A, 36B, 37, 37A, and 37B. One may note that the rolling, curling, or bending of flat shapes to form spirals, in certain manufacturing techniques, is conducted during manufacture of the connector, is done well before insertion of wire(s) into the spiral, and is not wrapping a strip, wire, or tape, around the wire(s) to be captured.

The metal sheet from which the flat shapes are cut/stamped preferably are sufficiently rigid that, after being curled and its ends are fixed, it remains in the desired spiral shape and configuration, which is the "relaxed" configuration. The spiral is curled to have a diameter such that the desired wire will easily slide into the hollow center of the spiral in this relaxed configuration. The chosen metal sheet is preferably flexible enough that twisting/rotating the tube/spiral ends relative to each other may be done, whereby the diameter of the tube/spiral reduces and captures the wire, but the metal is preferably chosen so that, once tightened on the wire, the coils tend not to deform, flex, curl, stretch, or separate to an extent that the would allow accidental loosening and release of the wire. Upon twisting and locking the tube/spiral in the tightened configuration, the stripped wire remains captured and in electrical contact with the interior surface of the tube/spiral.

The spiral is preferably not formed by wrapping a strip or wire around the wire to be captured, but, instead, is formed from a self-standing (self-supporting) tube/spiral that is inherently biased into a relaxed, loose condition, and yet that may be twisted into a tensioned tightened, smaller-diameter condition (in the direction parallel to the length of the coil of the spiral and generally transverse to the axial length of the spiral). Further, the spiral is preferably not manufactured by wrapping a strip or wire around any object that remains in the spiral during its use as a connector. For example, the preferred spirals are not flexible wires, strips, strings, or tape that are wound or tied around the conductive wire(s) to be captured, but rather are self-supporting members that retain their shape so that wire(s) may be inserted into their central passageways with little or no pressure of the wire(s) against the inside surfaces of the spiral.

The material that is rolled/curled/bent into a generally tubular shape preferably remains in said generally tubular shape, preferably biased by its resiliency into a relatively-larger diameter tubular shape into which the wire(s) may be inserted, but flexible enough so that twisting its ends relative to each other, or one end relative to a central region, moves the tubular shape into a relatively smaller-diameter tubular shape that may be latched/locked to grasp the wire(s). As in cut-tube embodiments of the conductive spiral, such a rolled/curled sheet embodiment of the conductive spiral is preferably substantially rigid, so that it may firmly and continuously grip the inserted wire(s) when the spiral is tightened on the wire(s).

[0076] Said rolling/curling/bending of said flat shape preferably includes rolling/curling/bending of each end of the conductive spiral (and also a central region if the connector is a double-ended connector) into a ring-shape. Opposing edges that come together to from each ring-shape may be straight, notched, tongue-and-groove, or other shapes, wherein-non-straight edges may help with mating of said opposing edges. Said opposing edges may be fixed to each other or may simply be retained near each other to maintain the ring-shape by virtue of being received within a collar and/or housing portion, for example.

Alternatively, but less preferably, the self-standing/self-supporting tube/spiral may be inherently biased into a tight condition relative to the wire and yet may be loosened by rotation/twisting of the spiral (in the opposite direction to the tightening direction) into a compressed (in a direction parallel to the spiral cut) larger-diameter condition. In such an embodiment, a lock or latch is needed to retain the spiral in the loosened condition until insertion of the wire into the spiral and until it is desired to capture the wire in the spiral.

In certain embodiments, at least one spiral of conductive material is provided in a housing, with one end of the spiral fixed to the housing and the other end of the spiral rotatable relative to said housing. Once a wire end(s) is/are inserted into the interior space of the spiral (which is in its large diameter configuration), the rotatable end may be rotated or "twisted" relative to the housing and relative to the wire end(s) to move the spiral into said smaller diameter configuration to an extent that the spiral tightly grips the wire end(s). Preferably, the rotation/twisting, and the consequent tightening of the spiral is continuous, and may be done to the full extent necessary to tightly grip the wire. The rotatable end is then locked, latched, or otherwise fastened to prevent loosening of the spiral again to a larger diameter, and, hence, to prevent disengagement of the wire end(s). In certain embodiments, the lock, latch, or other fastener that retains the spiral in the reduced diameter configuration is not easily released, and/or not capable of being released, so that, once installed in the wire, the spiral unit will remain firmly and immovably fixed to the wire. In certain embodiments, force on the wire in a direction intended to pull it out of the spiral will tend, if anything, to tighten the grip of the preferred spiral on the wire, as such a force works to axially-lengthen the spiral, and, in doing so, to reduce the diameter of the spiral for an even tighter grip.

Certain embodiments comprise a single spiral for connecting stripped wire to a eye, fork, or other terminal end, which single spiral may be twisted relative to its housing and to the inserted wire. One hand will typically hold the housing, while the other hand twists the terminal end that is preferably rigidly connected to the spiral in order to twist the spiral into the tightened configuration. Preferably, a latch automatically engages, for example, by a ratchet mechanism, so that a hand is not needed to manually latch the spiral and so that the spiral does not loosen when the hands holding the housing and the terminal end are released. In other words, the preferred ratchet allows movement in the tightening direction but does not allow significant movement in the loosening direction. Alternatively, other latch mechanisms or means may be used, for example, plunger members, pins members, or other protruding or gripping members that contact or otherwise interfere with the spiral or an attachment fixed to the spiral, to prevent or limit reverse movement of the spiral. For example, "pivot-in to lock" (and "pivot-out to unlock") means "push-in to lock" (and "pull-out to unlock") means, "twist to lock" systems, "screw-in to lock" or "screw-out to lock" means, hooks, pins/pegs, pivot-arms, threaded members, cammed members, or other fasteners may be used for latching and unlatching means for the spiral(s). The latch mechanisms portrayed in the Figures are typically automatic and non-releasable, but alternatively, latch mechanisms/means may be provided that are manually engaged by the user, and/or releasable/unlatchable by purposeful manual action by a user, for example, by pulling of a plunger or pin member radially outward relative to the spiral and the housing.

Certain embodiments comprises two spirals that are provided parallel and coaxially at opposite ends of a connector. Each of the two spirals may be twisted independently, relative to a first housing portion and relative to its respective stripped wire received inside its interior space. One hand will typically hold the first housing portion, while the other hand twists another housing portion that is preferably rigidly connected to a first spiral in order to twist said first spiral into the tightened configuration to capture a first wire. Then the user continues to grasp the first housing portion, perhaps switching hands, and, with the other hand, twists yet another housing portion that is preferably rigidly connected to a second spiral in order to twist said second spiral into the tightened configuration to capture a second stripped wire. The two spirals are electrically connected to each other and, hence, the two stripped wires are electrically connected to each other. Preferably, latches automatically engage for each of the two spirals, for example, by ratchet mechanisms, so that a hand is not needed to manually latch each spiral and so that each spiral does not loosen when the hands holding the various connector portions are released. Alternatively, other latch mechanisms/means may be used, for example as discussed above for the latches of the terminal end embodiments.

Alternatively, if the tightening directions of the two spirals of a two-spiral embodiment permit, the user may grasp the housing portions at opposite ends of the connector that are preferably rigidly connected to the first and second spirals and twist said housing portions in opposite directions, thus tightening both spirals at the same time with a simple "two-handed twist." Such an action will be permitted, for example, if the spiral directions are both right handed, or alternatively both left handed.

Certain of the spiral connectors may be made in many diameters and lengths, to accommodate many different types of stripped/un-insulated wire, that is, many different diameters, strand-numbers, and strand-types of electrical wire. For example, connectors may accommodate large wire diameters such as the well-known 4/0, 3/0, 2/0 and 1/0 AWG (American Wire Gauge) wire, or smaller wire diameters such as the well-known 2, 4, 6, 8, 10 and 12 gauge (AWG, decreasing diameter with increasing gauge number). When wire is installed in the connector and the connector is in use, inner surface of the spiral portion(s) of the preferred connectors must be in direct contact with outer surface of the single stripped/un-insulated wire, or with outer surface of at least some of the stripped/un-insulated, multiple strands or multiple wires, captured in the spiral portions. When in a reduced-diameter configuration, the entire or substantially the entire inner surface area of the preferred spiral contacts the wire. Therefore, the reduced-diameter spiral wraps around, and squeezes, preferably the entire circumference of the wire(s) along a significant axial distance along the wire(s), to create a large surface area of electrical contact between the spiral and the wire(s).

The housing(s) of the connectors are preferably sleeve(s) that encircle the spiral(s) and that provide means for securing an end of each spiral so that that spiral end is immovably or substantially immovably fixed to a housing or housing portion, an opening though the housing for the insertion of the wire, and an opening through the housing through which a terminal end and/or another conductive element may extend. The housing(s) may be of various shapes and sizes, with optional but preferred fins or knurling to provide a sure hand-grip, and with optional transparency or opaqueness and/or color-coding for different wire gauges or types. The preferred latch(es) may be provided in, or may extend from the housing(s), and preferably are designed so that they may not be unlocked or unlatched, or, at least, may not easily or accidentally be unlocked or unlatched.

The Figures illustrate some, but not the only, embodiments of housings, spirals, spiral ends, terminal ends, and latch systems. Certain of the latch systems comprise one or more fingers that extend inwardly from the housing to gouge into, protrude into, catch, abut against, or otherwise engage an end of the spiral or a ring, collar, or protrusion on the end of the spiral, to stop or limit reverse rotation of the spiral. Thus, once the spiral has been tightened and latched, the stripped/un-insulated wire(s) is/are captured and gripped inside the spiral, and the spiral will not loosen to allow removal of the wire(s). Alternatively, other latch mechanisms or means may be used, for example, plunger members, pins members, or other protruding or gripping members that contact or otherwise interfere with the spiral or an attachment fixed to the spiral, to prevent or limit reverse movement of the spiral. For example, "pivot-in to lock" (and "pivot-out to unlock") means, "push-in to lock" (and "pull-out to unlock") means, "twist to lock" means, "screw-in to lock" or "screw-out to lock" means, hooks, pins/pegs, pivot-arms, threaded members, cammed members, or other fasteners may be used for latching and unlatching means for the spiral(s). The latch mechanisms/means portrayed in the Figures are typically automatic and non-releasable, but alternatively, latch mechanisms may be provided that are manually engaged by the user, and/or releasable/unlatchable by purposeful manual action by a user, for example, by pulling of a plunger or pin member radially outward relative to the spiral and the housing.

Important features of the preferred embodiments include a large electrical contact surface area, for example, ⅙-1 square inch of surface area, in many embodiments, and even more for large cable applications. This may be compared to a small fraction of an inch, for example, less than 1/10 square inch of contact surface area between a conventional crimped connector and a wire. Further, the preferred spiral connectors may be installed, without tools, by simply inserting the wire in the relaxed connector, followed by a simple and quick twisting of one end of the connector relative to the other. The preferred automatic latching/locking of the latch mechanism takes place without further manipulation of the connector or the wire.

While spirals extending in a particular direction are portrayed in the Figures, for example, a "right hand spiral" in FIG. 2, "left hand spirals" may also be used, with associated adaptations in the latch mechanisms to prevent or limit reverse movement by the spiral once the spiral has been tightened. It should be noted that the preferred spirals are not coils of wire wrapped around the wire inserted into the connector, but rather preferably rigid or substantially rigid spiral coils formed so that twisting/rotating one end will tend to tighten the entire spiral around the inserted wire. Preferably, when one end of the spiral is moved relative to the other (see arrow in FIG. 3), including when both ends are caused to rotate in opposite directions, the entire spiral moves, with all of the spiral wraps or "coils" sliding relative to each other or otherwise moving in a direction parallel to their length (see representative small arrows in FIG. 4. One may note that said moving in a direction parallel to their length comprises both radial and axial movement components). An important distinction between prior art "threaded wire connectors" and certain embodiments is that prior art threaded wire connectors have fixed immovable threads, of decreasing diameter, inside a casing, wherein the user threads the threaded wire connector onto a wire and, during this installation, there is no movement of any of the threaded wire connector threads relative to each other. In certain embodiments of the present invention, on the other hand, the spiral wraps or "coils" move relative to each other during the tightening process (and also during a loosening process, if the embodiment is provided with that option). In certain embodiments, the wraps/coils may start out at the same or substantially the same diameter, but, during the tightening process, they move/slide relative to each other to form a smaller-diameter structure that is typically smaller-diameter, and typically substantially a uniform smaller-diameter, all along the length of the structure.

During use of certain embodiments, the wire is captured and preferably immovable in the spiral and that the terminal end is preferably directly fixed to, or is integral with, the spiral. The connector preferably is not adapted or intended to create force on the wire or the terminal end that would cause movement of the wire and/or the terminal end relative to the spiral. Also, the connector preferably is not adapted so that electrical current through the wire creates any force on the spiral or terminal end that would cause movement of the spiral or terminal relative to the wire. The connector preferably is not a solenoid system for converting electrical energy into axial movement via electromagnetism and/or for converting movement via electromagnetism into electrical current. Preferably, there are no magnets associated with or attached to the connector.

Figure 6:
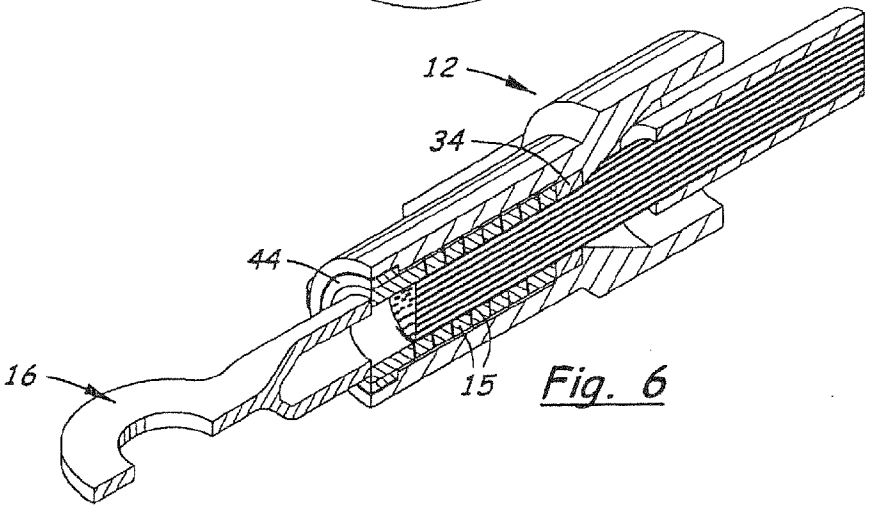
FIG. 6 is an axial cross-sectional perspective view of the embodiment of FIGS. 1 and 2, with the cable is stripped of insulation at its end and the stripped wires are inserted axially into the housing and the spiral. Note that, in this embodiment, the terminal end has a cylindrical end that is open at one end and closed at the end from which the terminal end extends, and, hence, the wires do not extend to be visible or accessible at or near the terminal end of the connector. In other embodiments, the wires may extend from the spiral and through all or part of the open cylinder of the terminal end to be visible and/or accessible.

Now referring specifically to the Figures, there are shown some, but not the only embodiments of the invented connectors and methods of making and using the connectors. FIGS. 1 and 2 shown a spiral connector 10 that comprises housing 12, spiral 14 comprising multiple coils 15, terminal end 16 with eye 18, and stripped wire 20 protruding from the insulation 22 (the insulation having been stripped off of the end of the wire 20 to bare multiple wire strands). The combination of the spiral 14 and the terminal end 16, which are preferably directly attached to each other and/or manufactured as an integral, single unit, may be called a "spiral unit." Wire 20 and insulation 22 are intended to represent the many possible versions of wire, cable, and other elongated conductive materials that may be used with the connector 10, as discussed above, and especially the multiple-strand (multiple-filament)

wire for which the preferred connectors are particularly beneficial. FIG. 6 illustrates to best advantage how the stripped wire strands extend into the spiral of the preferred connectors, but that the insulated portion of the wire (covered by insulation 22) preferably extends only part way into the preferably-funnel-shaped opening at the proximal end of the housing 12; this way, the spiral may exert force on, compress, and/or "bundle" the wire strands without any interference by the insulation 22.

After the multiple strands of the preferred stripped wire 20 are inserted into the spiral 14 of the connector 10, the spiral 14 is tightened as described elsewhere in this document. Said tightening of the spiral 14 will reduce the diameter of the spiral 14 to an extent that is determined by the combined outer diameter of the "bundle" of stripped wire strands. Said tightening will squeeze the strands into a compact bundle, with little or no space between the strands, that is substantially cylindrical in shape. The outer surfaces of the outer-most strands of the bundle will be the surfaces contacted and pressured by the inner surface of the spiral, and said outer-most strands will contact and apply pressure to the inner strands. The conductive spiral electrically connects to the outer-most strands, which electrically connect to the inner strands, so that all strands are electrically connected to the spiral. During the tightening, the strands may tend to shift relative to each other, until the strands are fully squeezed into a tight bundle by the spiral that is tight against the strands. In this fully-tightened condition of spiral and strands, the spiral should be latched, preferably automatically.

One may note that these preferred methods of installation and use are different from prior art "spring" connectors wherein a solid, rigid pin is shoved into a spring so that the pin expands the spring to create the force causing the spring to grip the pin. One may note that the preferred multiple, at least somewhat flexible, strands of wire 20 could not be effectively shoved into a spring with a diameter smaller than the combined diameter of the "bundle" of the strands, because the strands would bend and fail to properly enter the spiral, and, particularly, would fail to expand the spring.

Also, one may note that the preferred methods of installation and use are also different from apparatus and methods for wrapping, strain-relieving, or other supporting of insulated electrical cords, and are different from apparatus and methods of reinforcing or otherwise supporting conventional electrical cords at their connections to conventional electrical plugs. Thus, the preferred apparatus and methods are not the supporting apparatus and methods that reinforce the strength of the insulated electrical cord and/or that prevent bending or axial sliding of the insulated electrical cord at or near a plug.

One may note that the preferred embodiments and methods of the invention form electrical contact between conductive spirals and conductive wires, rather than form housings or cases for insulated cords. On may note that the preferred embodiments and methods of the invention will not work if the captured wire(s) is/are insulated inside the spiral and will not work if electrical insulation is provided in the spiral between the spiral and the wire(s). Also, one may note that many embodiments of the invention, more fully described below, comprise electrical connection between multiple wires inserted into the spiral, or between wire(s) inserted into the spiral and a terminal end that is integral with or directly electrically connected to the spiral. The wire inside the spiral(s) does not pass through the spiral to a distant electrical connection or plug. The stripped distal ends of the wires preferably terminate inside of, or very near (for example, within 0-10 millimeters of) the spiral, and the stripped distal ends preferably do not contact any structure other than the spiral.

The terminal ends that may be portions of the spiral units of the preferred connectors are conductive material that is directly electrically connected to the spiral or manufactured to be integral with (in a single, unitary piece) the spiral, that is, there is no intermediate structure between the terminal and the spiral. A terminal may be directly electrically connected to the distal end of a spiral by spot-welding, for example, or may be made an integral portion of the spiral unit by the flat-sheet-cutting or -stamping methods described elsewhere in this document. Thus, the terminal end may be differentiated from an electrical plug or other electrical connection that is separate and distanced from the spiral and mechanically connected to the spiral only by virtue of an insulated cord extending between the spiral and the plug or separate connection.

The spiral 14 of FIG. 2 comprises a proximal end 30 that has recesses 32 spaced around its circumference that may assist in fixing of the proximal end 30 to the housing 12. After inserting the spiral 14 into the housing, sonic welding may fix the proximal end 30 into the interior cavity of the housing, as shown to best advantage in FIGS. 6 and 7 at fixed connection 34. Said sonic welding may cause polymeric housing material to flow into said recesses 32 and then re-harden, thus fixing the proximal end to the housing. The interior wall surface of the housing may comprise a slightly-protruding ring (at 34 in FIG. 7) that surrounds the proximal end 30, some of which will be likely to soften and flow into the recesses 32. Other fixing methods may be used, with the adaptation preferably being that the proximal end 30 of the spiral not be moveable relative to the housing 12. For example, in this and the following embodiments, one or more protrusions (not shown), in addition to or in place of the recesses 32, may be provided in/on the proximal end 30 of the spiral for becoming embedded or otherwise gripping or engaging the material of the housing upon sonic welding, adhesive connection, molding or other fixing of the proximal end to the housing. Alternative spiral proximal end configurations may be envisioned by one of skill in the art after viewing this disclosure and the drawings.

The spiral 14 also comprises distal end 40 that may also have recesses 42 spaced around its circumference. Recesses 42 may (in a similar manner to recesses 42 cooperating with the interior wall of the housing) cooperate with plastic collar 44 provided on said distal end 40. Collar 44 protrudes radially outward from the side surface of spiral 14. Collar 44 may be sonically welded to distal end 40. Other fixing methods may be used, with the adaptation preferably being that the distal end of the spiral not be moveable relative to the collar 44, so that locking the position of the collar 44 will lock the position of the spiral 14. For example, in this and the following embodiments, protrusions (not shown) from the side surface of spiral 14, in addition to or in place of the recesses 42, may be provided in/on the distal end of the spiral for becoming embedded or otherwise gripping or engaging the material of the collar 44 upon sonic welding, adhesive connection, molding or other fixing of the distal end to the collar 44. As discussed elsewhere in this disclosure, alternative collars or spiral distal end configurations, and/or entirely different locking mechanisms may be envisioned by one of skill in the art after viewing this disclosure and the drawings.

Figures 7, 8, 9, 10, 11:
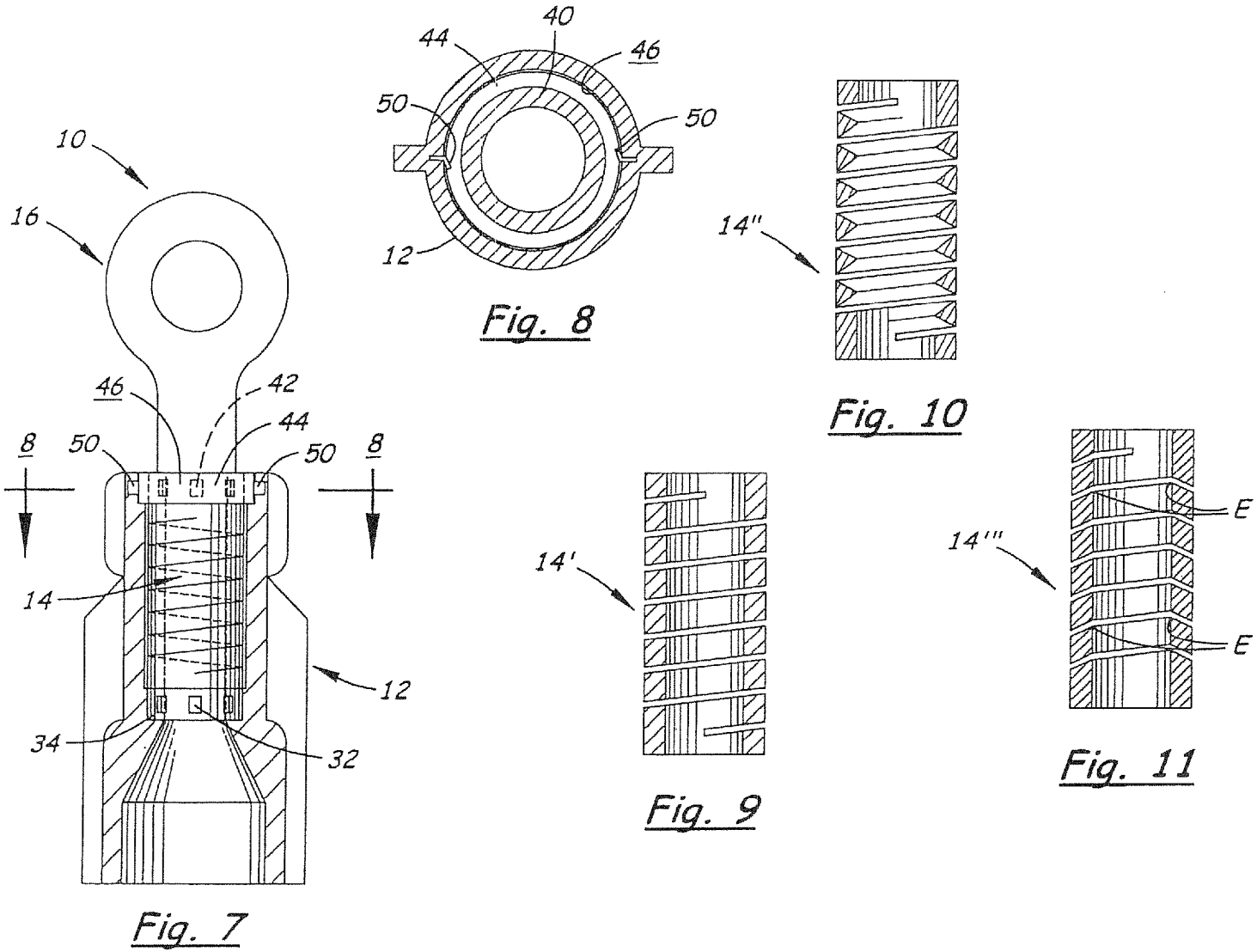
FIG. 7 is a side view of the embodiment of FIGS. 1, 2 and 6, with the housing in cross-section.
FIG. 8 is a transverse, cross-sectional view of the embodiment of FIGS. 1, 2, 6 and 7, viewed along the line 8-8 in FIG. 7.
FIG. 9 is a side, cross-sectional view of one embodiment of a conductive spiral, such as is provided in the embodiment of FIGS. 1-4, and 6-8, wherein the spiral cut extends through the wall approximately transverse (approximately 90 degrees) to the axis of the spiral.
FIG. 10 is a side-cross-sectional view of another embodiment of a conductive spiral, which may be made by angled cuts through the wall of a tube and/or other methods that result in the inner surface of the wraps/coils being sharp edges.
FIG. 11 is a side-cross-sectional view of another embodiment of a conductive spiral, wherein the cut between wraps/coils of the spiral extends through the wall at an acute angle, thus providing some overlap of the spirals/coils and increased rigidity of the tightened spiral.

The collar 44 and its generally smooth and continuous outer surface 46 will rotate inside the housing when the terminal end 16 is twisted by one hand, the housing 12 being held by the other hand. During said twisting, preferably to the extent at which the spiral 14 is very tight against the wire 20 outer surface, at least one finger 50 (preferably two, as shown in FIGS. 2, 7 and 8) flex to slide along the outer surface 46. The material of the collar 44 and the material and orientation of the fingers 50 relative to the collar 44 are adapted so that, upon release of the twisting motion, and/or any reverse force, the fingers 50 will bite into, frictionally grip, and/or otherwise engage the outer surface 46 of the collar 44 to limit, and preferably prevent, reverse motion of the spiral 14. Thus, this cooperation of the fingers 50 with the collar surface 46 acts as a latch or lock for retaining the spiral in the tightened configuration. Said generally smooth and continuous outer surface 46 provides for a continuous, non-incremental amount of twisting and tightening, and locking of the spiral in that position without any significant loosening after the user releases his/her hands.

The finger 50 and collar 44 system is one, but not the only, example of a ratchet-type lock, wherein motion of allowed in one direction but not in the reverse. One may note that the fingers 50 are drawn to be small plates embedded in the housing and each having a bend that places the end of the finger in a position wherein the finger will flex out of the way during the desired twisting, but will catch and latch upon the spiral or collar moving in the reverse direction. Other shapes may be effective, for example, a flat, unbent plate that is embedded at an angle into the housing wall to "point" in the direction of the desired twisting.

Preferably, the entire spiral 14, including proximal and distal ends 30, 40, is entirely electrically-conductive and, most preferably, a conductive metal(s). The collar 44, however, may be a non-conductive material, as its role is in latching rather than electricity flow. Having the collar 44 be plastic or other non-electrically-conductive material may be particularly beneficial if the fingers are metal, whereby the latch system would be metal to plastic contact rather than possibly corroding metal to metal contact. In alternative embodiments, both the fingers and the collar may be metal, or both the fingers and the collar may be plastic/polymer. In alternative embodiments, for example those discussed later in this disclosure, the collar may be absent and the fingers or other latch member may directly contact and engage the surface of the distal end of the spiral, rather than having an intermediate member between the finger/latch member and the spiral.

Figure 5:
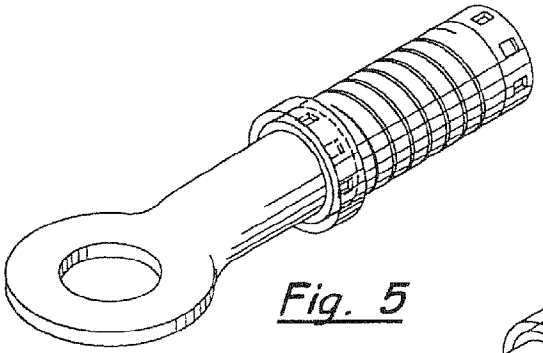
FIG. 5 is a perspective view of an alternative spiral unit, wherein the spiral is cut or otherwise manufactured to have space between each wrap of the spiral.
Figure 5A:
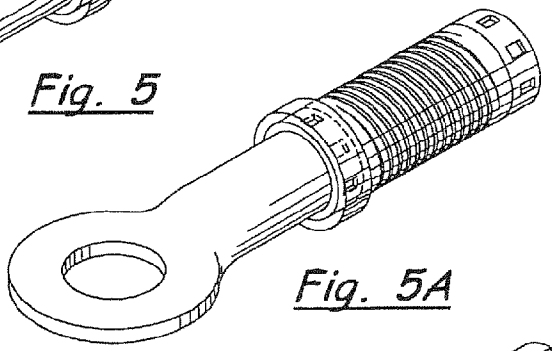
FIG. 5A is a perspective view of another alternative spiral unit, having two parallel cuts spiraling around the tube. Such embodiments may be included in the terms "a spiral" and "at least one spiral."
Figure 3:
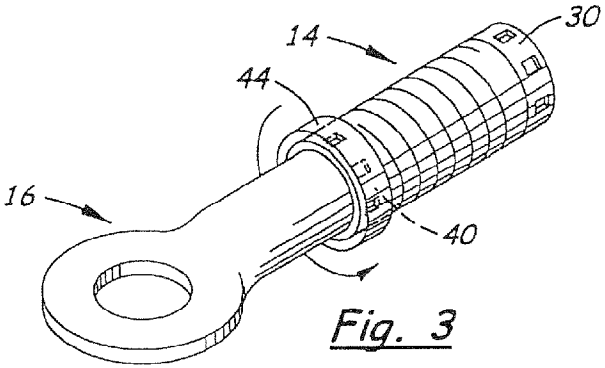
FIG. 3 is a perspective view of the spiral unit of the embodiment of FIGS. 1 and 2, that is, wherein said spiral unit has been removed from the housing. In this view, the spiral is in its relaxed, relatively-large-diameter configuration, but an arrow shows the direction the terminal end would be turned relative to the opposite end of the spiral to tighten the spiral.
Figure 4:
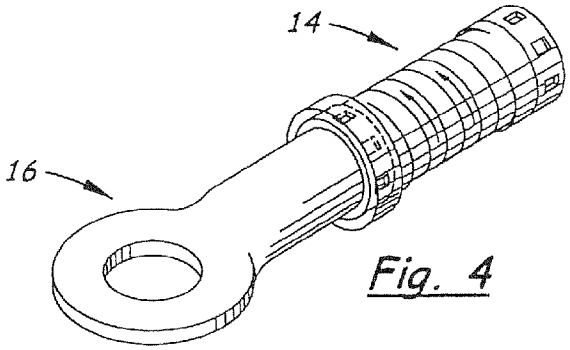
FIG. 4 is a perspective view of the spiral unit of FIG. 3, wherein the spiral has been twisted to reduce its diameter to a tightened configuration wherein it would grip a wire(s) received therein. The spiral unit of FIGS. 1-4 is formed so that twisting of its terminal end in a counterclockwise direction when viewed from the terminal end, when the opposite end is held stationary or twisted in the opposite direction, will reduce the diameter of the spiral, for example, as illustrated in FIGS. 3 and 4.

FIGS. 3 and 4 illustrate spiral 14 in relaxed and tightened configurations, respectively. FIGS. 5 and 5A illustrates alternative versions of the spiral, with spaces between the spiral wraps/coils (FIG. 5) and with two spiral cuts forming two side-by-side spirals that will both extend around and tighten against the wire.

FIGS. 9-11 illustrate some, but not the only, possible designs for spiral 14. FIG. 9 illustrates a spiral version 14', wherein a spiral cut extends transversely, or nearly transversely, across the tube wall from which the spiral is preferably formed. FIG. 10 illustrates a less-preferred spiral 14" wherein two cuts or other forming techniques may be used to make the interior surface of the spiral wraps/coils comprise sharp edges. This FIG. 10 embodiment is less preferred relative to embodiments wherein the internal surfaces of the wraps/coils are generally flat and broad to maximize contact with the wire. FIG. 11 illustrates an alternative spiral 14'" wherein the cut that creates the wraps/coils is slanted so that interior surfaces of the wraps/coils have acutely-angled edges E. Twisting of the spiral 14'" of FIG. 11 may create slight overlap of the wraps/coils and, thus, a sturdier, more rigid structure around the wire.

Figures 12, 13:
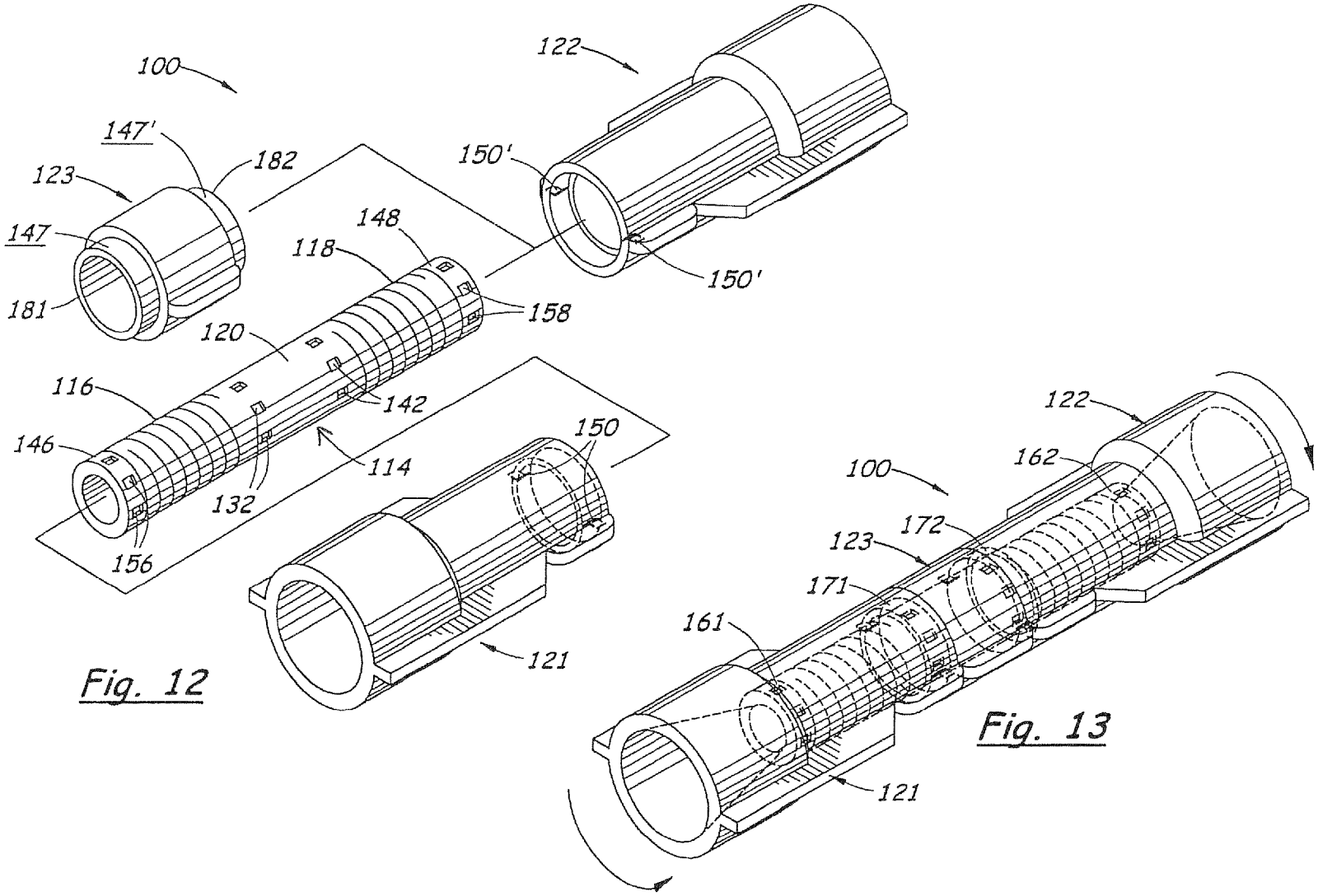
FIG. 12 is an exploded perspective view of another embodiment of the invention, which is a double-ended spiral connector, shown without the two wires/cables/elements that the unit may connect in a "butt" style connection.
FIG. 13 is an assembled, perspective view of the embodiment of FIG. 12, wherein the internals of the unit are shown in dashed lines.

FIGS. 12 and 13 illustrate one but not the only embodiment of a double-ended spiral connector 100 for connecting two wires together. The spiral unit 114 comprises two spirals 116, 118 (which each may also be called a "spiral portion") that are provided on opposite ends of a central region 120 that is not spiraled. The housing comprises multiple portions, including end sleeves 121, 122, and central sleeve 123. Central sleeve 123 is preferably fixed to the central region 120 so that sleeve 123 does not rotate relative to the spiral unit 114. This may be accomplished by various means, for example, sonic welding of the plastic central sleeve 123 to the metal central region 120 with the aid of plastic of the interior surface of the central sleeve 123 flowing into, and then re-hardening in, recesses 132, 142 provided around the central region 120. End sleeves 121 and 122 are slid onto spiral unit 114 to cover their respective spirals 116, 118, and the outer ends 146 and 148 of the spirals 116, 118, respectively, are sonically welded or otherwise fixed to the interior surfaces of the sleeves 121, 122. This fixing may be done by sonic welding, as described above for the embodiment of FIGS. 1 and 2 and for the central region 120 and central sleeve 123, wherein material from the interior surfaces of the sleeves 121, 122 flows into, and then re-hardens, in recesses 156, 158.

Upon installation of the central sleeve 123 and the end sleeves 121, 122 as described above, the connector 100 will appear as it does in FIG. 13. The central sleeve 123 is fixed to the center region 120 of the spiral unit 114, but the end sleeves are rotatable relative to the central sleeve 123 and the central region 120. Therefore, after inserting wire (not shown in FIGS. 12 and 13) into the open ends of end sleeves 121, 122, the central sleeve 123 may be grasped in one hand and one of the end sleeves (either 121 or 122) may be twisted. This twisting will tighten the respective spiral, and, upon the preferred automatic latching, the wire will be captured and retained tightly in the spiral. For example, in FIG. 13, one may see the twisting/rotation arrow for end sleeve 121, and the arrow for end sleeve 122, which happen to be in opposite directions because of the direction of the spirals 116, 118. As in the single-end-insertion connections, the spirals 116, 118 of this embodiment, when in the relaxed configuration, are larger in interior diameter than the combined diameter of the wire(s) being inserted into the passageway of the spirals. This way, even if the inserted wires are many, thin, and/or flexible, they may be inserted easily and are not required, and in fact preferably do not, exert significant force on the interior surface of the spirals or expand the diameters of the spirals.

For ease of viewing, call-outs 161, 162 are provided in FIG. 13 to point out the fixed attachment of spirals 116, 188 to end sleeves 121, 122, respectively. The opposite ends of the spirals, at call-outs 171, 172, are free to rotate relative to the end sleeves 121, 122, respectively, with the rotation being only in one direction due to adaptations that preferably include the ratchet-type of latch/lock discussed before.

The ratchet-type latches/locks of FIGS. 12 and 13 comprise fingers 150, 150' (similar to fingers 50) sliding, during the desired twisting, along the circumferential outer surface 147, 147' of the extensions 181, 182 of central sleeve 123. However, upon release of the twisting motion, and/or any reverse force, fingers 150, 150' will bite into, frictionally grip, and/or otherwise engage the outer surface 147, 147' of the central sleeve 123 to limit, and preferably prevent, reverse motion of the spiral. Thus, this cooperation of the fingers 150, 150' with surfaces 147, 147' acts as a latch or lock for retaining the spirals in the tightened configuration. Surfaces 147, 147' are preferably generally smooth and continuous, so that a continuous, non-incremental amount of twisting and tightening may be done and locked without any significant loosening after the user released his/her hands.

As will be understood from the above disclosure and the Figures, connectors according to the invention may be used to connect multiple wires together, without the need for any terminal end included in the connector. For example, the connector 100 of FIGS. 12 and 13 electrically connects multiple wires together without any terminal end, as will be understood by one of skill in the art. Other embodiments according to the invention may be used also to connect multiple wires together, without the need for a terminal end in the connector, in a "side-by-side" configuration wherein the multiple wires inserted into a single spiral rather than into two spirals or opposing ends of a spiral or spiral unit. See, for example, FIGS. 38, 38A-38E, which are described in more detail later in this document. Thus, one may describe the connector 100 of FIGS. 12 and 13 as an "end-to-end", "generally coaxial", or "butt" connection, and one may describe the connector of the type shown in FIGS. 38, 38A-38E, as a "side-by-side" connection. The multiple wires used in the connectors of FIGS. 12 and 13 and FIGS. 38, 38A-38E may be many types, for example, wires, cables, single or multiple strands, or other elongated, conductive elements. As in the spirals discussed earlier in this document, the spiral of the embodiment of FIGS. 38, 38A-E, when in the relaxed configuration, are larger in interior diameter than the combined diameter of the wire(s) being inserted into the passageway of the spiral(s). This way, even if the inserted wires are many, thin, and/or flexible, they may be inserted easily and are not required, and in fact preferably do not, exert significant force on the interior surface of the spiral or expand the diameters of the spiral.

Figure 18:
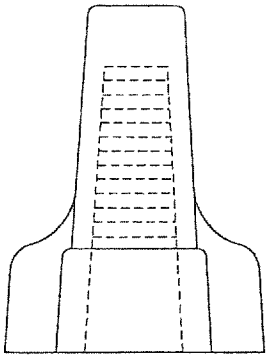
Fig. 18 (PRIOR ART)
FIG. 18 is a side view of a prior art threaded wire connector, with internal threads shown in dashed lines. One may note that the threads transition from large diameter near the open end (bottom end in this view) to smaller diameter near the closed (top) end. When the threaded wire connector is "screwed" onto ends of wires, the individual threads do not move relative to each other or change diameter and only engage the wires by means of the entire threaded wire connector moving axially to a point wherein the diameter of the threads matches and/or is smaller than the combined diameter of the wires.
Figure 17:
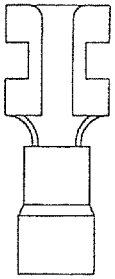
Fig. 17 (PRIOR ART)
FIG. 17 is a side view of another style of prior art crimp connector, which may be called a female rectangular-tubular terminal end for receiving a male blade, in a quick-connect and quick-connector style terminal end system.
Figure 16:
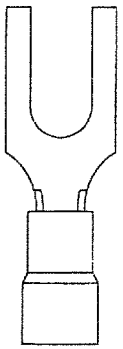
Fig. 16 (PRIOR ART)
FIG. 16 is a side view of another style of prior art crimp connector with a fork-type terminal end. Again, the top corners of plate edges (that are bent to form a generally cylindrical lower end) are visible above the top end of the insulating sleeve.
Figure 15:
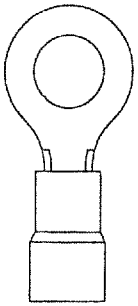
Fig. 15 (PRIOR ART)
FIG. 15 is a side view of one style of prior art crimp connector with an eyelet-type terminal end. The lower end of the conductive portion of the connector is generally a cylindrical shape formed by bending side edges of a flat plate toward each other. The top corners of said side edges are visible near the top end of the insulating sleeve.
Figure 14:
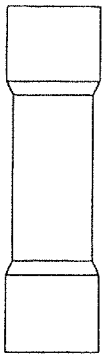
Fig. 14 (PRIOR ART)
FIG. 14 is a side view of one style of prior art butt crimp connector comprising two crimpable, cylindrical, opposing ends.

FIGS. 14-17 illustrate some of the many possible prior art terminal ends that may be adapted for attachment to a spiral or spirals according to certain embodiments of the invention. As noted earlier in this document, it is preferred that the terminal end be attached directly to, or manufactured integral with, the spiral. FIG. 18 illustrates a prior art threaded wire connector, as described earlier in this disclosure.

Figure 19:
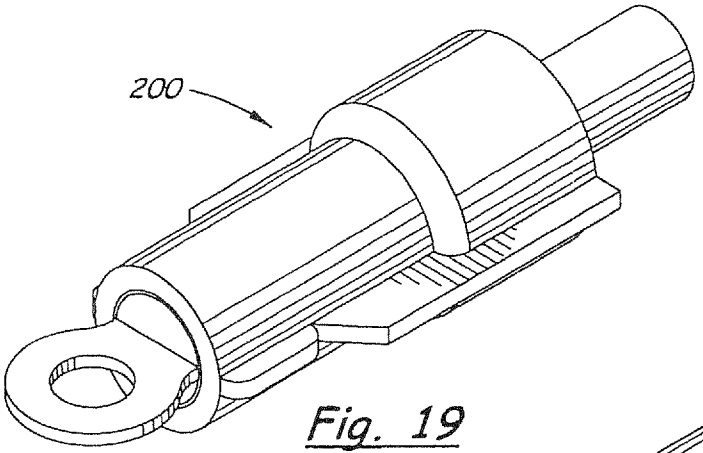
FIG. 19 is another embodiment of the invented spiral electrical connector, with an alternative latch system and an alternative connection between the terminal end and the spiral coils.

FIG. 19 illustrates an alternative embodiment of the invented spiral connector 200 comprising housing 212 and spiral 214 with terminal end 216. The combination of the spiral 214 and the terminal end 216, which are preferably directly attached to each other and/or manufactured as an integral, single unit, may be called a "spiral unit." The spiral distal end 240 does not have a collar encircling it. The latch mechanism comprises direct contact of the fingers 250 with the distal end outer surface, that is, the outer circumferential surface of the end of the tube from which the spiral is formed. Many closely-spaced notches or recesses 252 are provided around said circumferential surface, over which the fingers 250 will slide during the desired twisting. However, upon release of the twisting motion, and/or any reverse force, the fingers 250 will fall into and become lodged in, or otherwise engage, the notches or recesses 252 to limit, and preferably prevent, reverse motion of the spiral 214. Thus, this cooperation of the fingers 250 with the distal end 240 acts as a latch or lock for retaining the spiral in the tightened configuration. This is an example of a metal end of the spiral being part of the latch mechanism, preferably for cooperation with metal fingers 250. Fingers 250, however, may alternatively be formed of plastic to create plastic-metal cooperation if desired.

One may note the alternative terminal end 216 of the connector 200, wherein the terminal end 216 is connected to a closed end 217 on the distal end 240 and extends along a central plane that intersects the spiral. This is one, but not the only, alternative may of forming a spiral with attached or integral terminal end. In this connector 200, therefore, the entire spiral 214, terminal end 216, and closed end 217 are preferably conductive, and, even if the fingers 250 are also of metal or other conductive material, the housing 212 insulates and protects the user from contact with the conductive portions of the connector 200.

Figure 21:
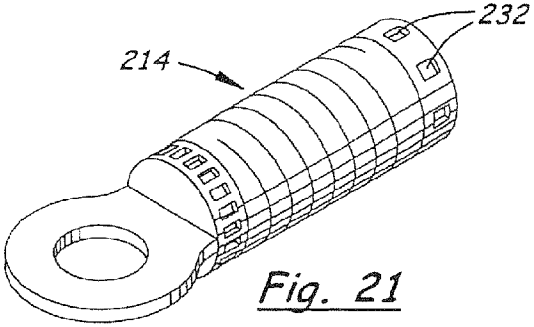
FIG. 21 is a perspective view of the spiral unit of FIGS. 19 and 20, with the spiral in a relaxed, large-diameter configuration.
Figure 22:
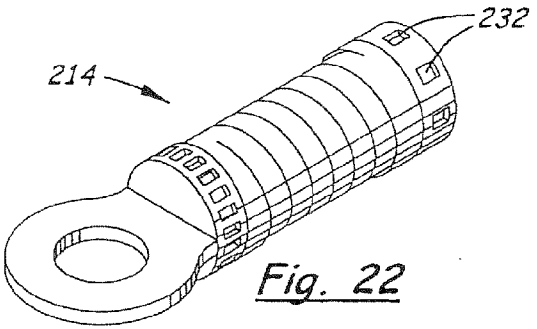
FIG. 22 is a perspective view of the spiral unit of FIGS. 19-21, wherein the spiral has been twisted to reduce its diameter to a configuration wherein it would grip wire(s) received therein.

FIGS. 21 and 22 illustrates the spiral 214 of the connector 200 removed from the housing 212 and in both a relaxed configuration (FIG. 21) and a twisted, tightened configuration (FIG. 22). Here, one may note that relative larger and fewer recesses 232 that are provided on the proximal end of the spiral for helping with sonic welding fixing of that end to the housing. And, one may note the relative smaller and greater number of notches/recesses 252 that are part of the latch mechanism. These notches/recesses 252 will provide latching in an incremental, rather than a continuous, fashion, but, if enough are provided, they may still retain a sufficiently tight configuration for the spiral.

Figure 23:
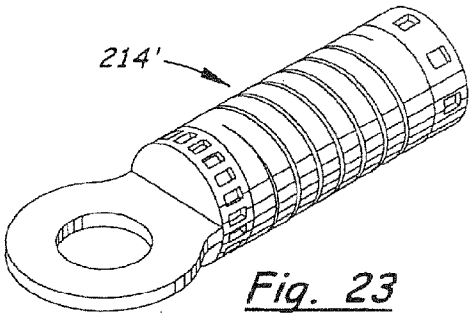
FIG. 23 is a perspective view of an alternative spiral unit, wherein the spiral is cut/manufactured to have space between each wrap/coil of the spiral.
Figure 23A:
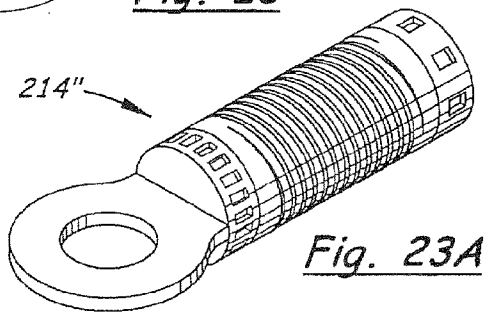
FIG. 23A is a perspective view of yet another spiral unit, having two cuts spiraling around the tube stock.

FIGS. 23 and 23A illustrates alternative spirals similar to that shown in FIGS. 21 and 22, wherein one spiral 214' is formed with space provided between wraps/coils (FIG. 23) and one spiral 214" is formed with multiple spiral cuts parallel and spaced from each other, thus, forming two spirals, side-by-side, encircling the stripped wire (FIG. 23A).

Figure 20:
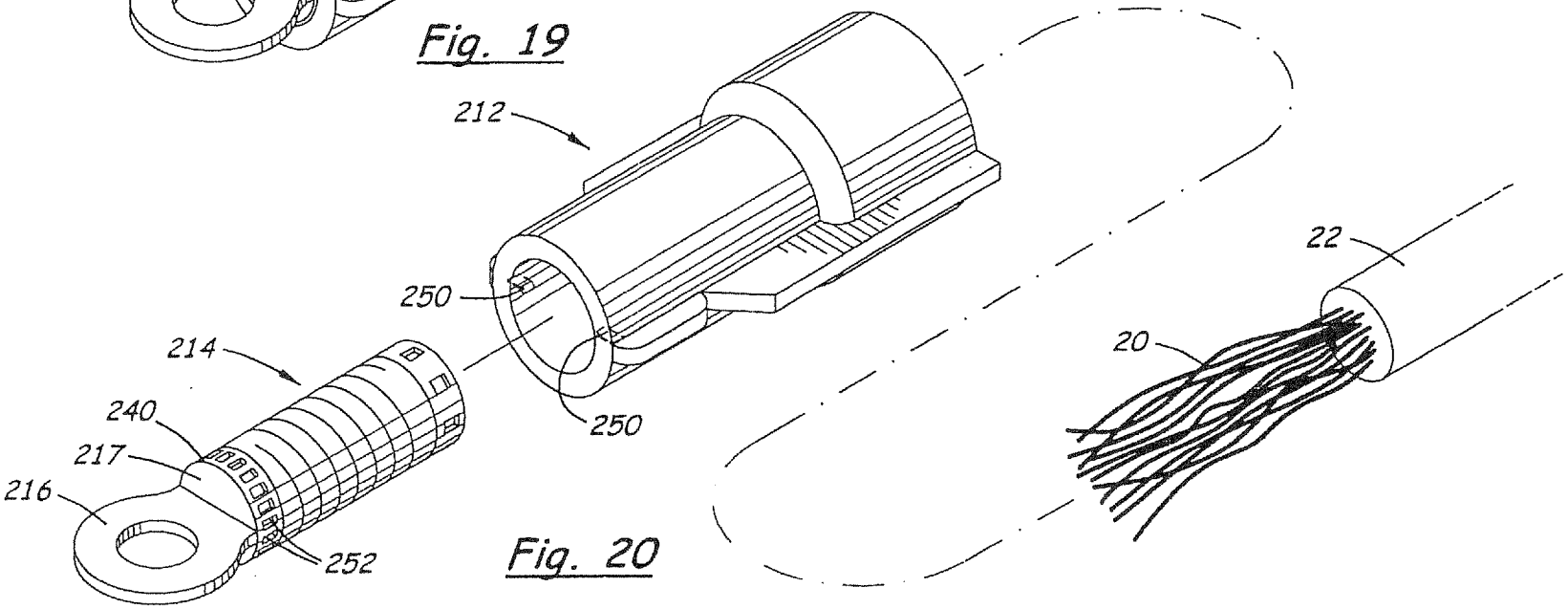
FIG. 20 is an exploded, perspective view of the embodiment of FIG. 19.
Figure 24:
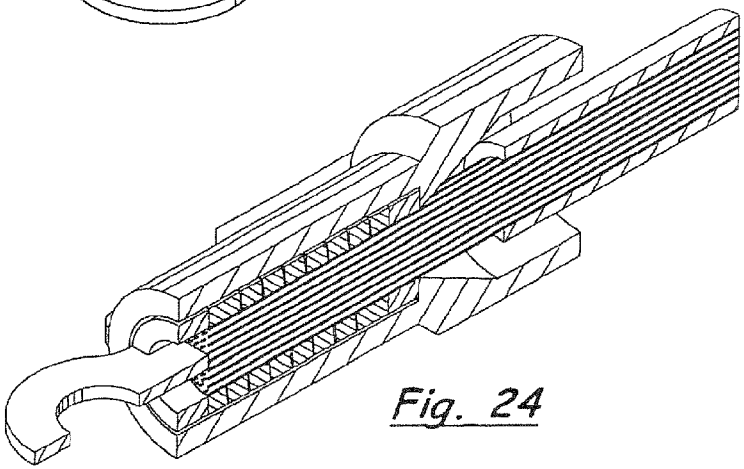
FIG. 24 is an axial cross-sectional, perspective view of the embodiment of FIGS. 19 and 20.
Figure 25:
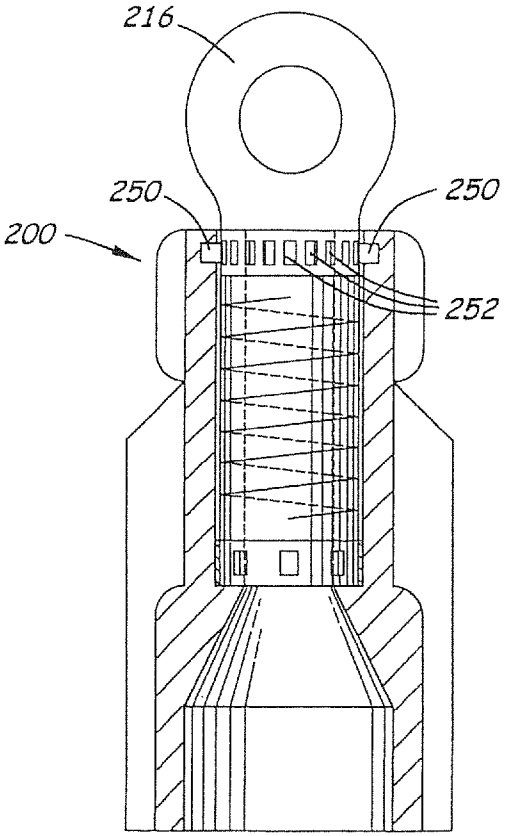
FIG. 25 is a side view of the embodiment of FIGS. 19, 20, and 24, with the housing in cross-section, and wherein the latch mechanism comprises latch fingers catching on the upper end of the spiral, which upper end is the same diameter as the rest of the spiral.

FIG. 24 illustrates in cross-section the connector 200 of FIGS. 19 and 20. The terminal end 216 is portrayed in this figure as extending through the "closed end" 217 for possible electrical contact with the wire itself and even with the spiral wraps/coils themselves. FIG. 25 illustrates the embodiment of FIGS. 19, 20 and 24 in axial cross-section.

Figure 27:
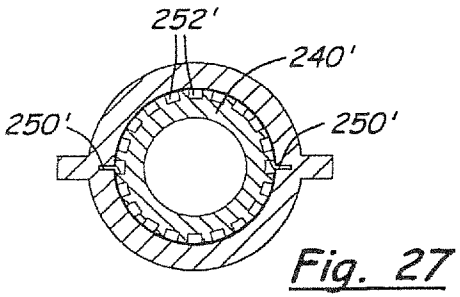
FIG. 27 is a top, cross-sectional view, viewed along the line 27-27 in FIG. 26.
Figure 26:
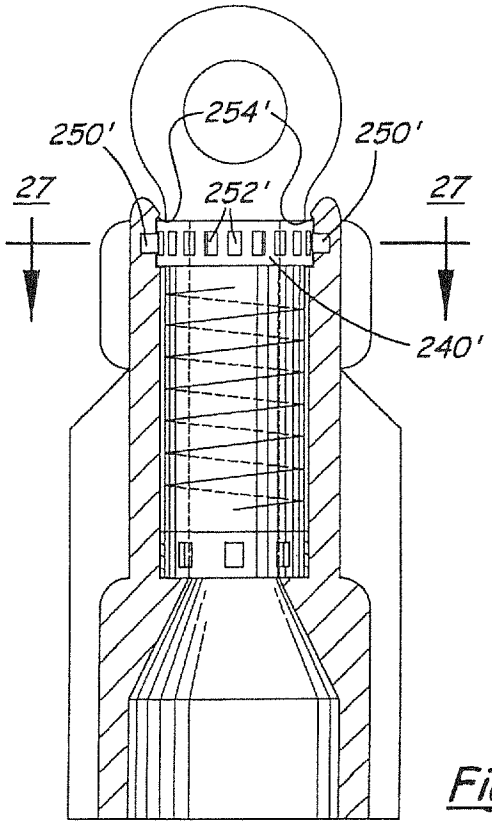
FIG. 26 is a side view of an alternative embodiment, with housing cut away in cross-section, wherein the latch mechanism comprises a ring/collar encircling the an end of the spiral and protruding out from the side surface of the spiral to be engaged by latch fingers.

FIGS. 26 and 27 portray to best advantage fingers 250' extending into and catching in notches/recesses 252' of an alternative distal end/collar 240'. This distal end/collar 240' features a slightly larger diameter than the diameter of the spiral wall, and, hence, protrudes radially outward slightly from the spiral. A recessed ring region 254 may be provided inside the housing to accommodate the distal end/collar 240'.

Figures 28, 29:
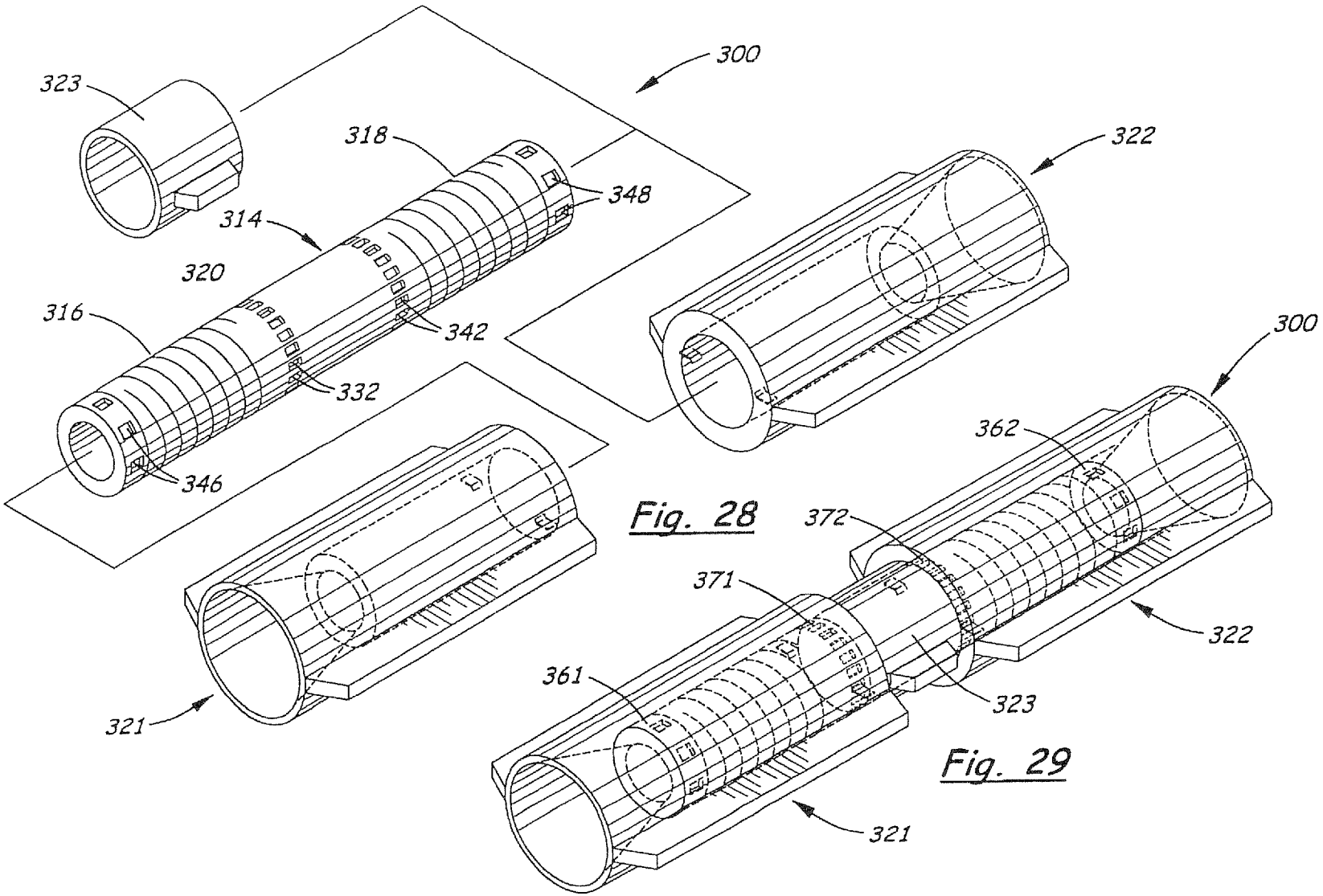
FIG. 28 is an exploded view of an alternative embodiment of a double-ended spiral connector, having an alternative housing and an alternative latch mechanism.
FIG. 29 is an assembly, perspective view of the embodiment of FIG. 28.
Figure 30:
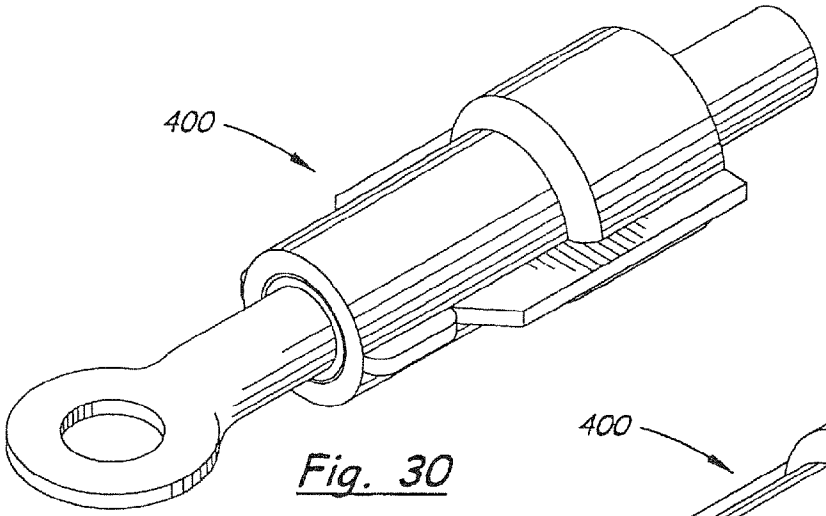
FIGS. 30 and 31 are perspective and exploded perspective views, respectively, of an alternative embodiment having yet another latch mechanism.
Figure 31:
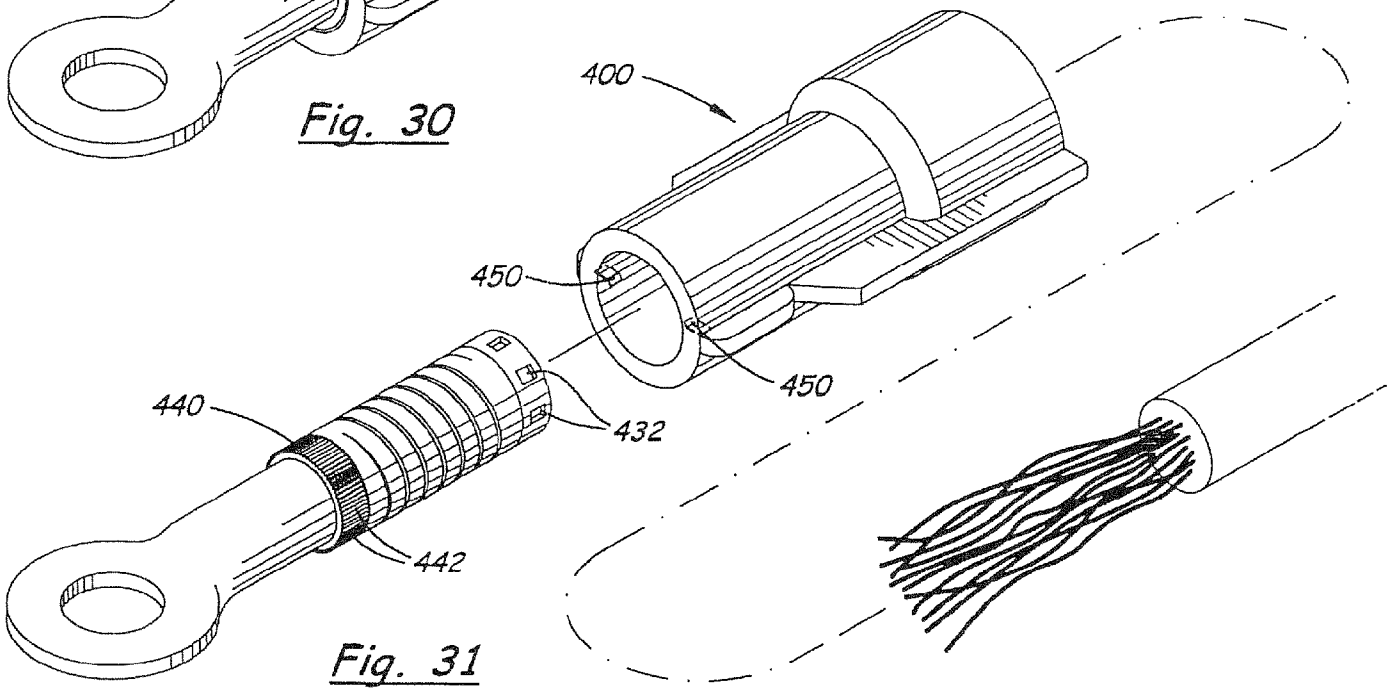

FIGS. 28 and 29 portray an alternative, double-ended connector 300. Major differences between this connector 300 and the connector 100 of FIGS. 12 and 13 include the following: The central sleeve 323 is fixed to the central region 320 of the spiral unit 314 by welding, adhesive, or other methods that result in sleeve 323 not being movable relative to the spiral unit 314. Said central sleeve 323 does not extend to cover, and does not cooperate with, the notches/recesses 332, 342 provided at the inner end of each spiral 316, 318 (each of which may also be called a "spiral portion" of spiral unit 314). The recesses 346, 348 at the outer ends of the spirals may be used for sonic welding to the interior surface of the respective end sleeves 321, 322, as described above for recesses 146, 148 in FIGS. 12 and 13. The fingers 350, 350' cooperate with, and latch in, recesses 332, 342, to effect the latching/locking desired after twisting of the spirals. As in the connector 100 of FIGS. 12 and 13, the user will grasp the central sleeve 323 and twist first one end sleeve and then the other, to tighten both spirals 316, 318 on their respective wires. Upon release of the twisting motion, and/or any reverse force, fingers 350, 350' will fall into and catch inside, and/or otherwise frictionally grip, and/or otherwise engage the notches/recesses 332, 342 of the spiral unit 314, to limit, and preferably prevent, reverse motion of the spirals. Thus, this cooperation of the fingers 350, 350' with notches/recesses 332, 342 acts as a latch or lock for retaining the spirals in the tightened configuration. Call-outs 361 and 362 are provided on FIG. 29 to point out the fixed attachments of the spirals to the end sleeves. Call-outs 371 and 372 are provided on FIG. 29 to point out the rotatable/twistable relationship of the notches inner ends of the spirals 316, 318 to the fingers 350, 350' of the end sleeves 321, 322.

FIGS. 30-33 portray yet another connector 400 that comprises a distal spiral end 440 having many, narrow, axial grooves 442 around the circumference of the end 440. These grooves provide smaller increments of latching after twisting of the spiral, as the fingers 450 may catch on any of the closely-spaced grooves to latch the spiral in the tightened configuration. One may note the great size difference between the grooves 442 in the distal end and the recesses 432 on the proximal end, as the grooves 442 are a portion of the accurate, and finely-adjustable latching system, while the recesses 432 are merely for assisting in the sonic welding of the proximal end to the housing. One may note that this embodiment, like the others drawn in this disclosure, includes two fingers in the ratchet-style latch system, but it should be noted that other numbers, from one to many may be effective. Also, one may note that many embodiments drawn herein include recesses such as those called-out as 432, but that these may not be required for other methods of fixing the spiral to the housing.

Figures 32, 33, 34, 35:
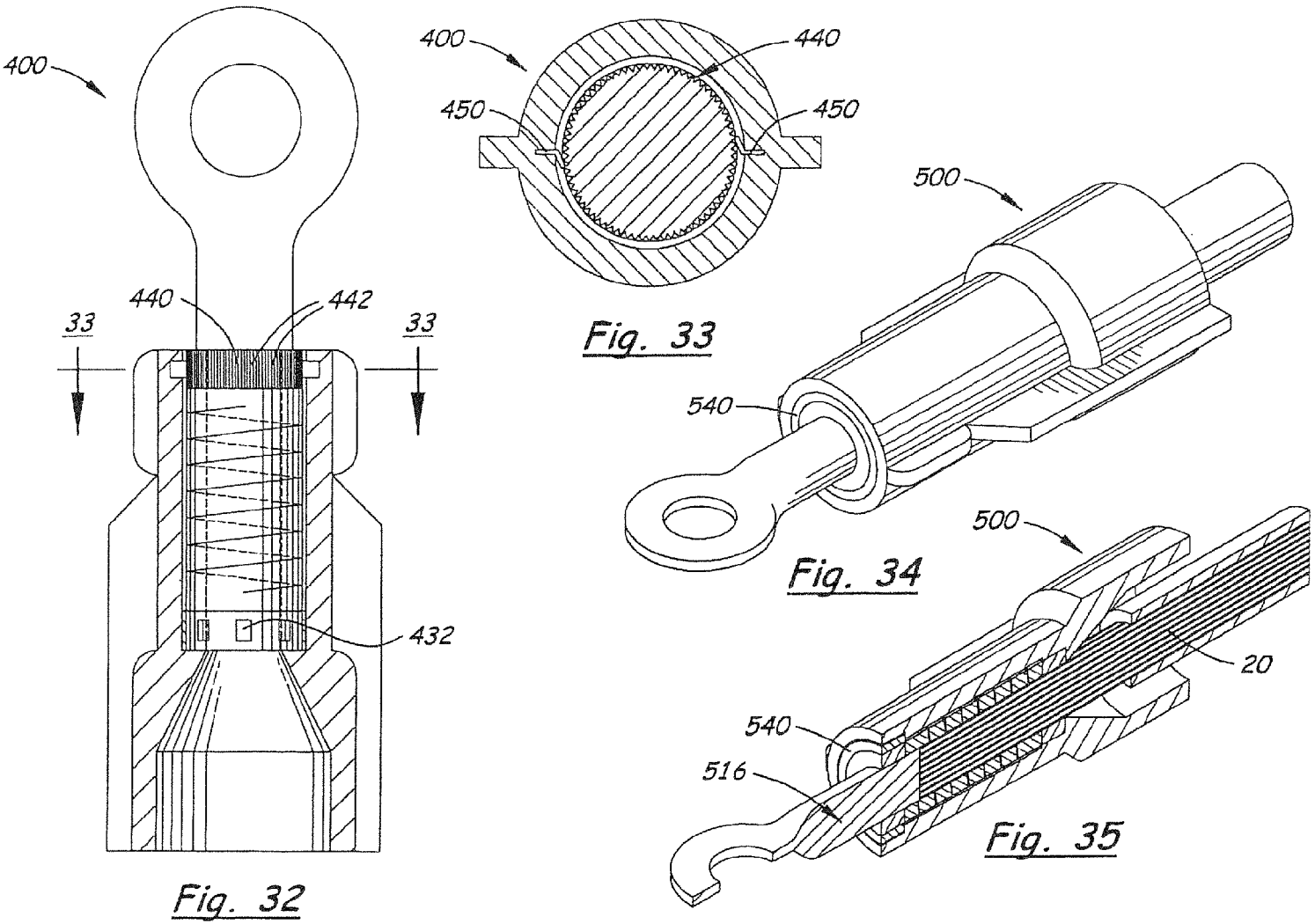
FIG. 32 is a side view of the embodiment of FIGS. 30 and 31, with the housing in cross-section.
FIG. 33 is a top, cross-sectional view of the embodiment of FIGS. 30-32, viewed along the line 33-33 in FIG. 32.
FIGS. 34 and 35 are perspective and cross-sectional views, respectively, of yet another embodiment, with a different system for directly attaching the terminal end to the spiral.

FIGS. 34 and 35 portray yet another connector 500 that includes a collar 540 that surrounds the distal end of the spiral and that may be used in the latch system. This collar 540 may be plastic and, therefore, the terminal end 516 is shown extending through the collar 540 to electrically connect to a spiral wrap/coil itself and optionally to contact the end of the wire 20.

FIGS. 36, 36A, 36B, 37, 37A, and 37B illustrate some, but not the only, embodiments of invented flat-sheet-cutting or -stamping methods and conductive spiral portions formed thereby. The structure for the spiral may be stamped, cut, or otherwise formed from a flat or generally flat metal or other conductive sheet. For example, in FIGS. 36 and 36A, many flat shapes 600 are cut/stamped from a single flat sheet, wherein the terminal end T is connected to, and distanced from, band B1 by a long, diagonal portion D. The diagonal portion D may have a longitudinal cut through it, whereby both the strips of material S1, S2 on both sides of the cut each form a spiral wrap, similar, for example, to the multiple-cut spiral shown in FIG. 23A. One may note from FIG. 36 that many of said flat shapes 600 may be cut/stamped side-by-side on the single flat sheet of metal, with little or no waste metal between said shapes 600, thus, minimizing waste of the metal and minimizing or eliminating "trimming" of each shape to its proper shape and size. This method may greatly increase the types of metal that may be economically used for the spiral, as one may start with a flat sheet of metal rather than tubular stock.

Figure 36:
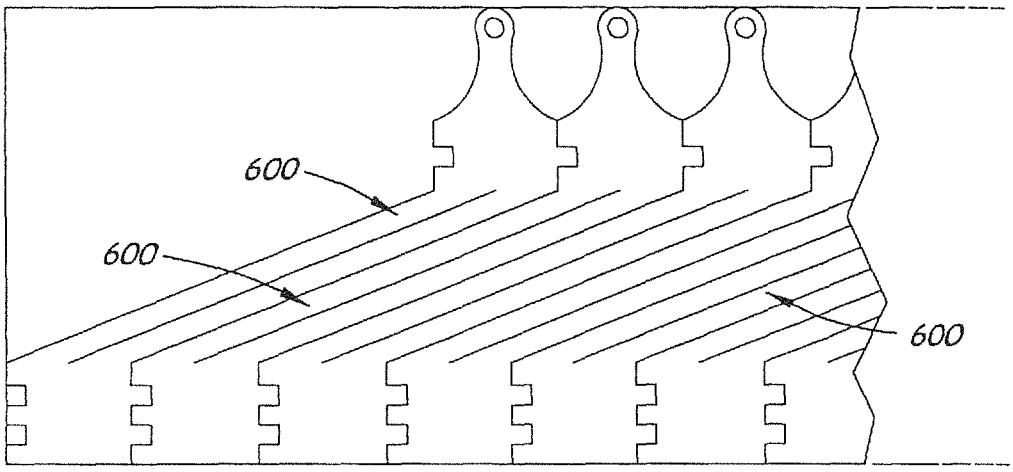
FIGS. 36, 36A and 36B illustrate one but not the only method of cutting or stamping a spiral unit from a flat sheet of metal, wherein after separation of the multiple flat shapes cut/stamped from the sheet, each flat shape may be curled into a generally tubular spiral unit. The spiral unit shown in these figures includes an eyelet terminal end that is integral with the spiral portion of the spiral unit.
Figure 36A:
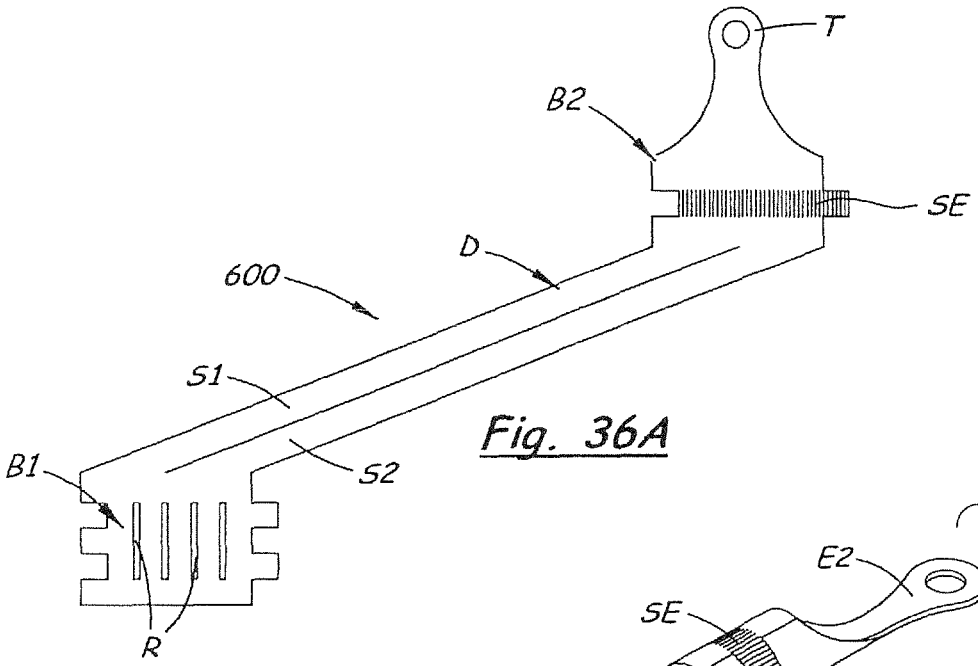
Figure 36B:
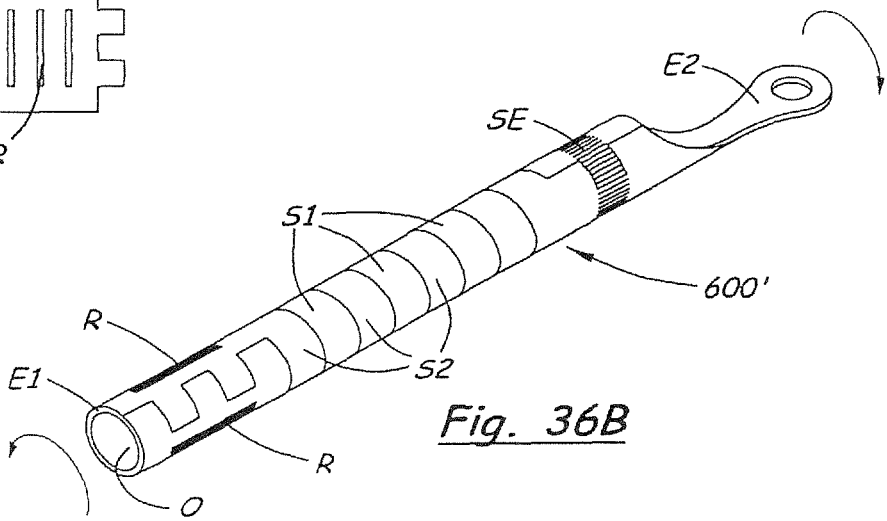

Each flat shape 600 is separated from the adjacent flat shapes and/or extra metal, and then rolled/curled/bent into the generally tubular shape (spiral unit 600'), by methods that will be understood by those of skill in the metal arts. Bands B1 and B2 are similarly roller/curled/bent and their outer edges may be fixed together to assist in strengthening the spiral unit 600', for example, by spot-welding or other techniques. The resulting spiral unit 600', as shown in FIG. 36B, has opening O through which wire(s) may be inserted so that stripped/exposed metal of the wires may extend deep into the spiral to be contacted by the spiral wraps. Tightening of the spiral unit 600' on the wires causes movement of the spiral wraps relative to each other to form the previously-discussed relatively-small diameter spiral grasping the wire(s). There may be some spaces between the wraps of the spiral, which spaces are not shown in FIG. 36B, which may become smaller or close completely. Note that, in FIGS. 36, 36A, and 36B, the housing is not shown, but it will be understood that, after said rolling/curling/bending of the shape 600 into the spiral unit 600', rotating of end E2 clockwise relative to end E1, in the directions indicated by arrows in FIG. 36B, will tighten the spiral.

Recesses R (or alternatively, cuts, apertures, or protrusions), and/or serrations SE (or other cuts, recesses or protrusions) may be provided near end E1 and E2, respectively. Recesses R may assist in preferably anchoring end E1 to a housing, and serrations SE preferably may assist in latching E2 (after tightening) to the housing. Thus, as discussed previously in this document, after tightening and latching, both ends of the tightened spiral are fixed or latched to the housing, so that the housing maintains the tightened condition of the spiral, preferably permanently.

Figure 37:
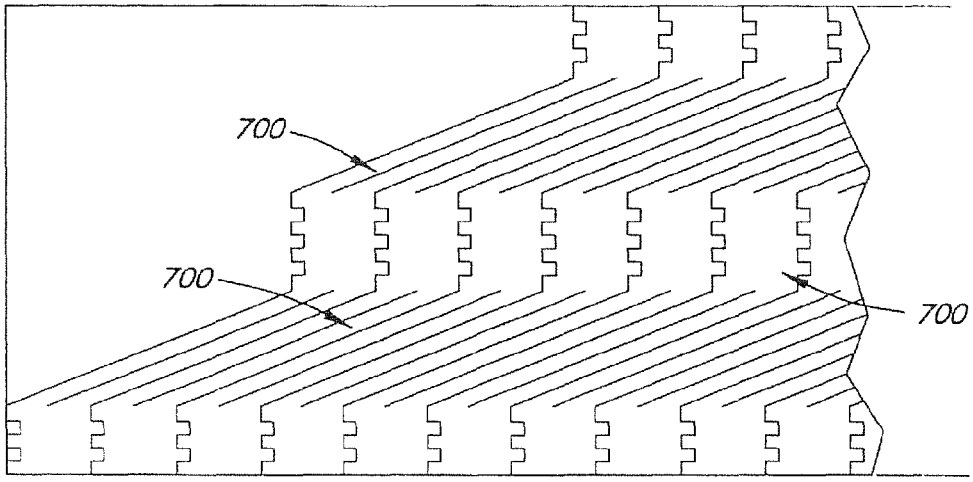
FIGS. 37, 37A and 37B illustrates one but not the only method of cutting or stamping a double-spiral unit from a flat sheet of metal, wherein, after separation of the multiple flat shapes cut/stamped from the sheet, each flat shape may be curled into a generally tubular spiral unit. The spiral unit shown in these figures includes a central band, a spiral portion on each side of the central band, and end bands at the outer ends of the spiral unit.
Figure 37A:
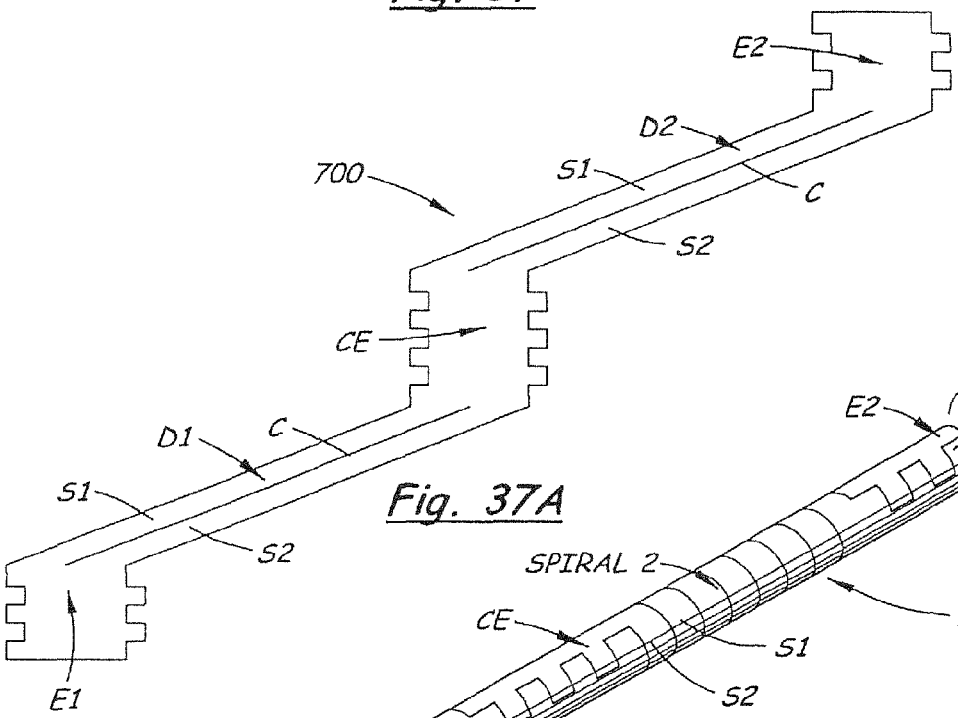
Figure 37B:
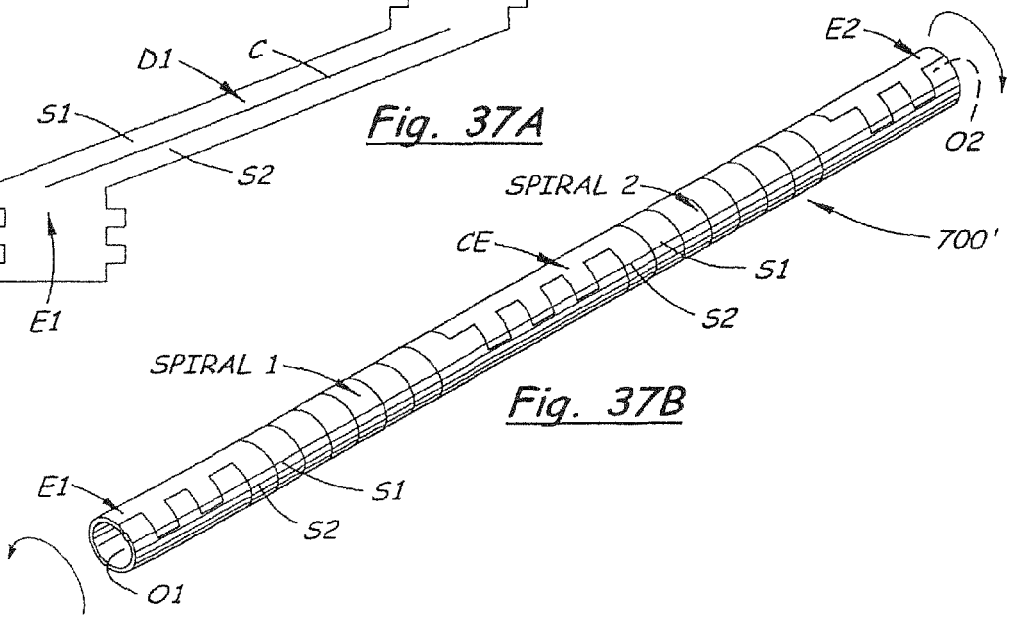

FIGS. 37 and 37B show flat shape 700, which is cut/stamped from a flat sheet to allow formation of a double-ended connector spiral unit 700'. End E1 and center CE are connected by, and distanced apart by, a long, diagonal portion D1. Center CE and end E2 are connected by, and distanced apart by, a long, diagonal portion D2. The diagonal portions D1 and D2 may each have a longitudinal cut C through them, whereby both the strips of material S1, S2 on both sides of cut C each form a spiral wrap, similar, for example, to the multiple-cut spiral shown in FIG. 23A. One may understand from FIG. 37B that counterclockwise rotation of end E1 relative to center CE will tighten the spiral portion called out as "spiral 1," and clockwise rotation of end E2 relative to the center CE will tighten the spiral portion called out as "spiral 2". Thus, one may see that a user who twists ends E1 and E2 in opposite directions at the same time (in a "two-handed twist" motion) without grasping or maneuvering the center CE, will effective tighten both spiral portions at the same time.

As the flat shape 700 is rolled/curled/bent into the generally tubular shape (spiral unit 700'), the bands of E1, E2, and CE are preferably similarly roller/curled/bent and their outer edges may be fixed together to assist in strengthening the spiral unit 700', for example, by spot-welding or other techniques. Stripped wires may be inserted into the spiral unit 700' in opposite directions, into the openings O1 and O2 of the spiral unit 700' and deep into their respective spiral portions ("spiral 1" and "spiral 2" in FIG. 37B), so that stripped/exposed metal of the wires may be contacted by the spiral wraps. Tightening of the spirals on the wires would cause movement of the spiral wraps relative to each other to form the previously-discussed relatively-small diameter spirals grasping the wire(s). There may be some spaces between the wraps of the spiral, which spaces are not shown in FIG. 37B, which may become smaller or close completely. Note that, in FIGS. 37A and B, the housing is not shown, but it will be understood that housing portions may be provided, and recesses, protrusions, and/or other systems may be provided to fix and latch the housing portions to the spirals for operation of the device as described above for other embodiments.

FIGS. 38, 38A-F, and 39, 39A and B illustrate additional embodiments of the invention. FIGS. 38 and 38A-E illustrate one, but not the only, connector 800 featuring a "side-by-side" configuration having no terminal end and wherein the electrical contact apparatus consists only of the spiral unit 814 that connects multiple wires or cables inside the spiral. Multiple wires, cables, or other stripped/un-insulated, conductive, elongated members are inserted into and gripped preferably by a single conductive spiral, and thereby placed in electrical connection with each other, wherein the connector does not include a separate terminal end attached to the spiral. For example, two separate electric cables 22, 22' extending from different equipment/devices have their ends stripped of insulation, and all of the resulting stripped strands 20 from both cables are inserted side-by-side in the same direction into a single spiral unit 814 rather than into two spirals. The strands optionally may be twisted together if desired before insertion into the spiral, but this is not typically necessary, as the end of the housing having the opening has in certain embodiments a large funnel-shaped interior surface (large relative to the combined diameter of the strand bundle) and the spiral, as discussed previously is significantly larger than said combined diameter. This way, the strands, which tend to be at least somewhat flexible, will enter the connector easily by sliding into the housing opening, along the slanted inside of the funnel, and into the spiral. Such a connector may be used, for example, in place of the connectors in FIGS. 12, 13, 28, 29, 39, and 39A-C (further discussed below) to connect multiple of said wires, cables, or other conductive, elongated members from different equipment/devices in electrical contact inside a single spiral rather than in end-to-end multiple spirals or in a spiral unit with open opposing ends. The multiple wires, cables or other conductive, elongated members will, at their distal ends, be generally "side-by-side" inside the spiral, rather than "coaxial" or "end-to-end."

Connector 800 comprises spiral unit 814 having a funnel-opening housing portion 812 with wings W, a spiral portion with spiral coils 815, and protruding teeth 853 around the circumference of the spiral unit near the funnel-opening housing portion 812. While not detailed in FIGS. 38-38F, funnel-opening housing portion 812 has an opening O into a funnel-shaped interior passageway, which guides the strands 20 into the spiral. Housing portion 813 encircles the spiral at an end opposite of housing portion 812, and comprises closed end 819. Multiple ratchet bars 850 are spaced around the inside of the housing portion 813 for engagement and interaction with teeth 853, for operation of the latching system. The spiral end to which housing portion 812 is fixed may be called the proximal end of the spiral and the opposite, distal end of the spiral is inserted into housing portion 813 and fixed to the inside surface of housing portion 813 near closed end 819, for example, by sonic welding, adhesives, pinning, or other preferably permanent methods. As suggested in FIG. 38E, the multiple strands of multiple cables may be inserted into the connector 800, and a user may grasp the housing portion 812 (especially wings W) with one hand, and housing portion 813 with the other hand, and may twist the two housing portions relative to each other. In the connector 800 of FIGS. 38, 38A-E, the user would twist housing portion 812 so that the top wing W in FIG. 38E would come out away from the paper and would twist housing portion 813 toward the paper, as suggesting by the arrows in FIG. 38E. As will be understood by those reading and viewing this disclosure, the spirals of the preferred embodiments may be manufactured in the reverse direction, which would result in twisting/rotation in opposite direction being operable to tighten the spirals. The latching system, comprising ratchet bars 850 and teeth 853, is illustrated to best advantage in FIGS. 38A and B.

Figure 38:
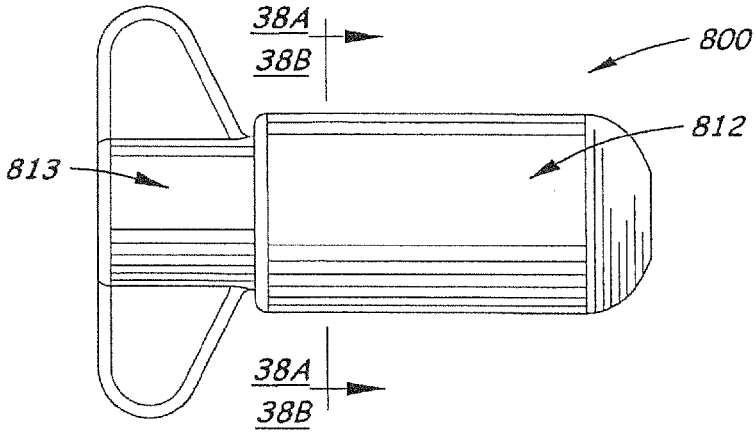
FIGS. 38 and 38A-E illustrate one, but not the only, embodiment of a side-by-side wire connector, wherein separate electrical cables are inserted into a single spiral and the spiral is tightened by the user rotating the funnel-end housing portion relative to the main housing portion.
Figure 38A:
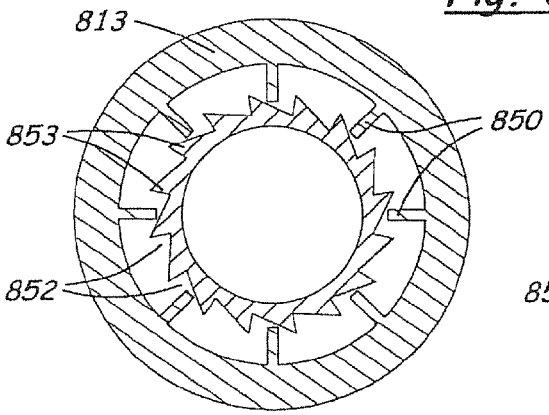
Figure 38B:
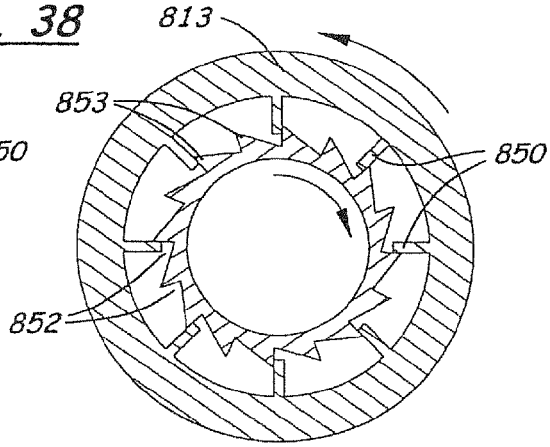
Figure 38C:
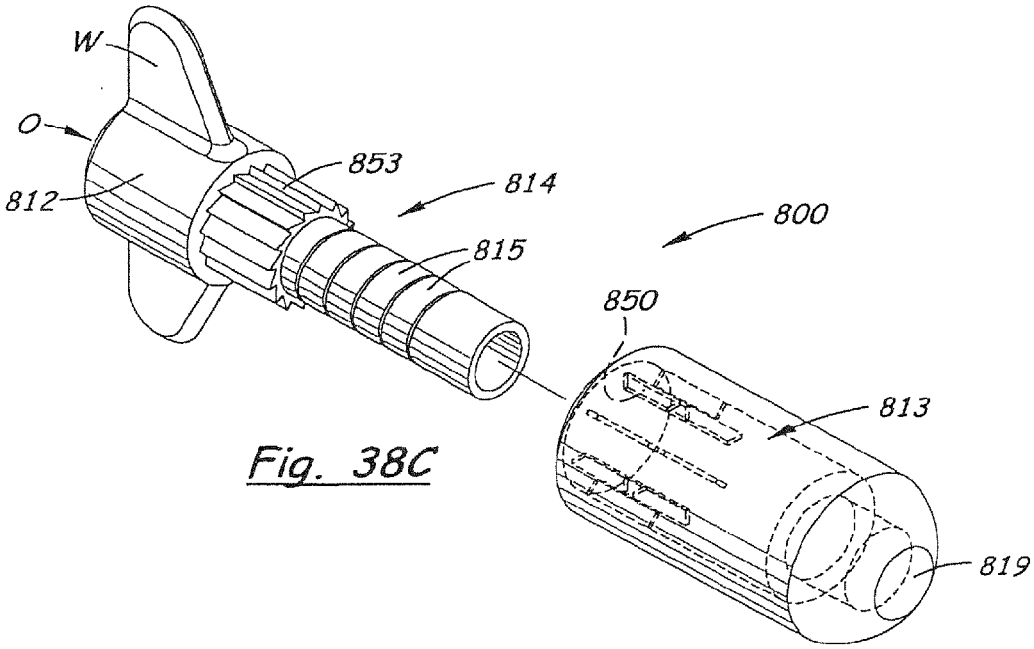
Figure 38D:
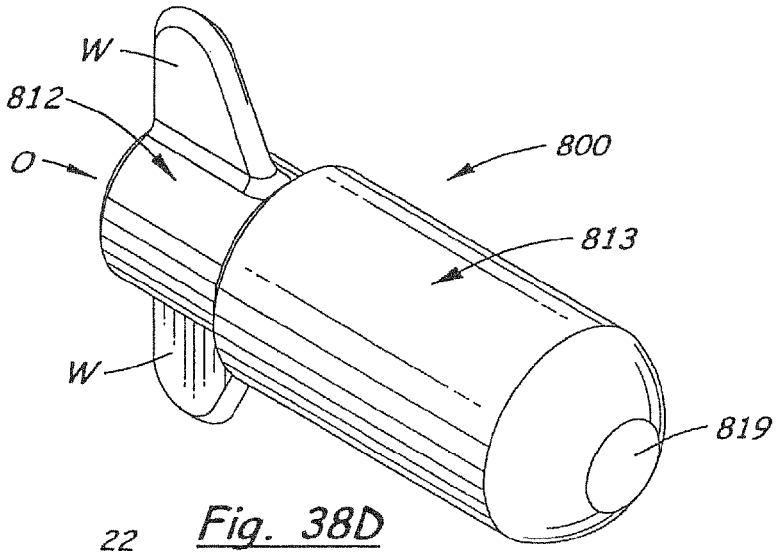
Figure 38E:
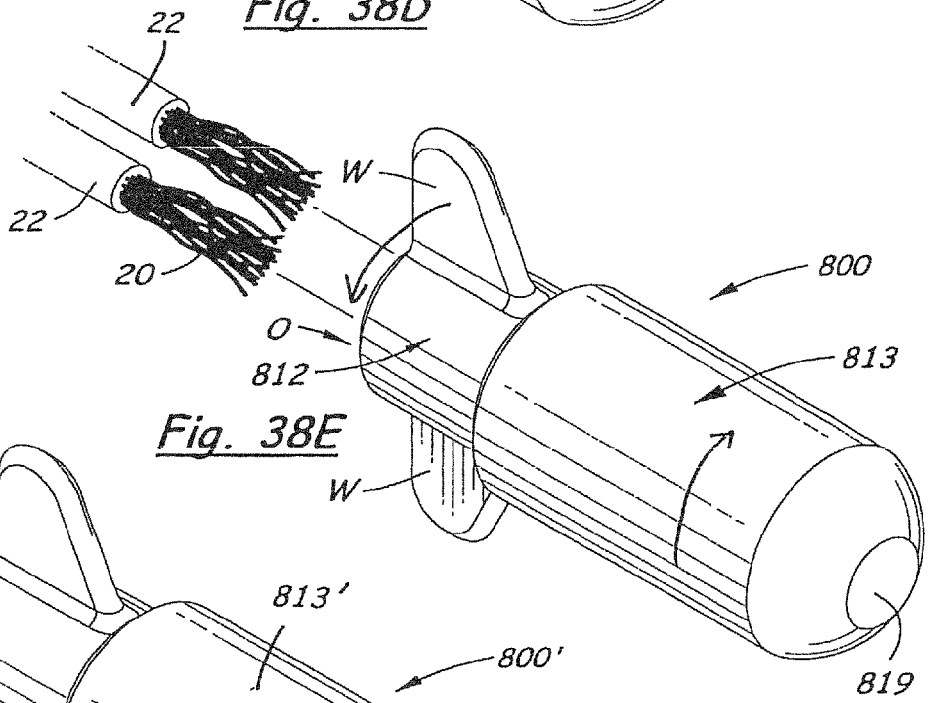
Figure 38F:
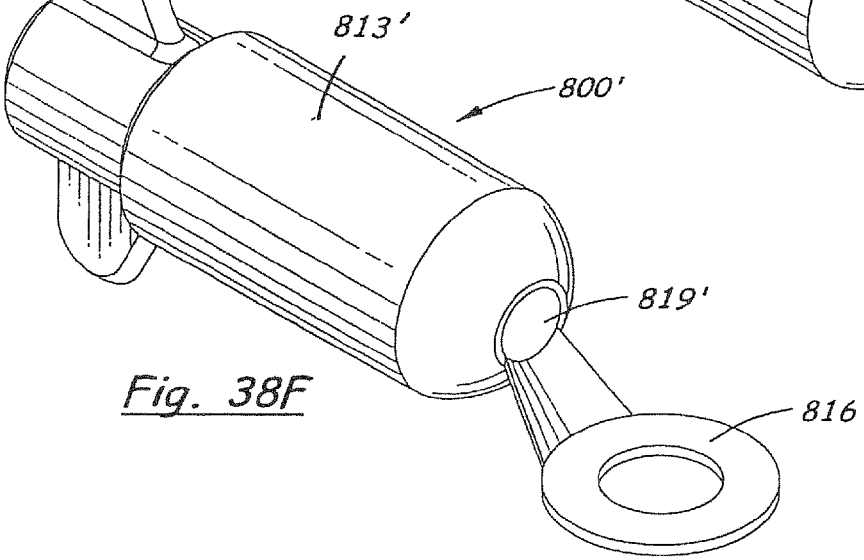
FIG. 38F illustrates a modification to the embodiment of FIGS. 38, 38A-F, wherein a terminal end is provided, directly attached to the spiral and extending out of the distal end of the main housing.

FIG. 38F illustrates one, but not the only, embodiment wherein the connector of FIGS. 38, 38A-E has been adapted into connector 800', which includes a terminal end 816 protruding out through housing portion 813'. Terminal end 816 is a conductive material directly electrically connected to or integral with the spiral of the connector 800', and extends out through a hole 819' in the end of housing portion 813'. As housing portion 813' is preferably immovably fixed to the distal end of the spiral and the terminal is preferably immovably fixed to the spiral, terminal end 816 need not move relative to the housing portion 813' and terminal end 816 may either extend out from a hole 819' or may simply extend through housing portion 813' without significant space or gap between the terminal end and the housing wall.

Figure 39:
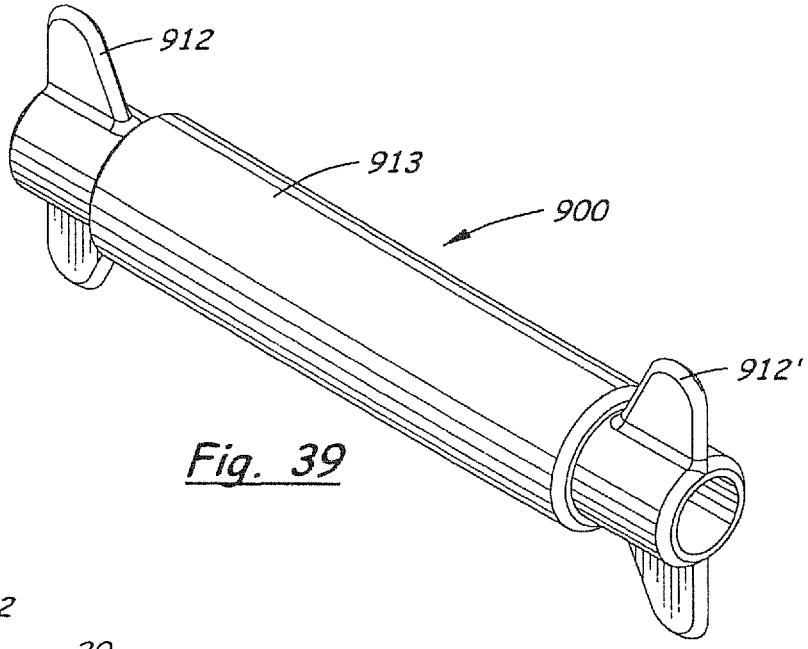
FIG. 39, 39A-C illustrate another, but not the only, embodiment of a double-ended connector, and the preferred method of using the connector in a double-handed twist wherein the two ends are grasped and rotated in opposite directions but the user need not touch the central, main housing.
Figure 39A:
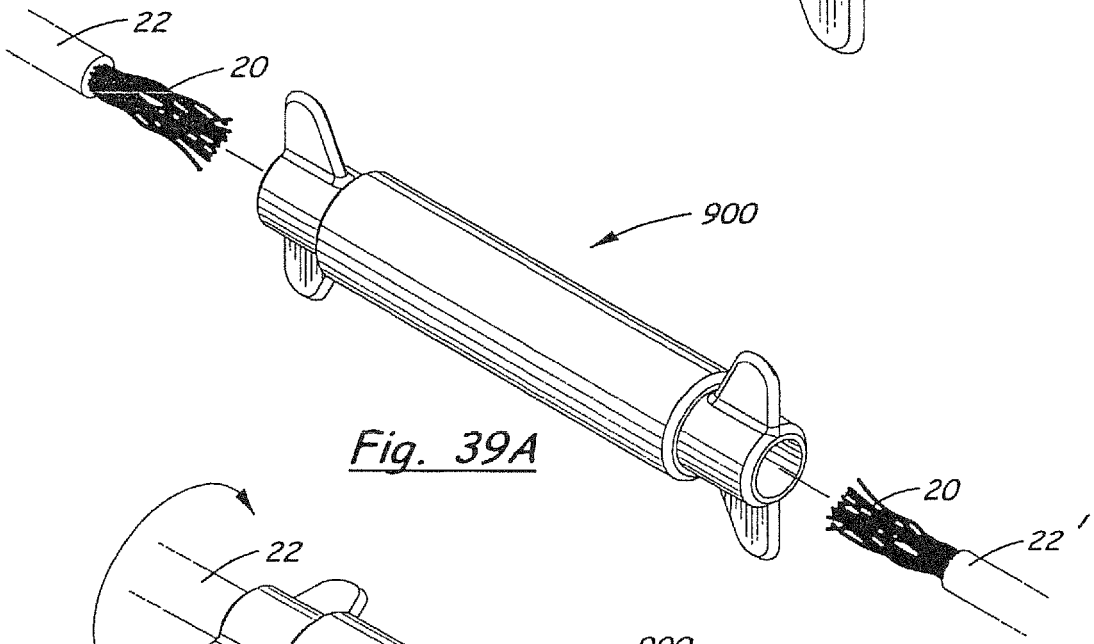

FIGS. 39, 39A and B illustrate another embodiment of, and a method of using, an "end-to-end" connector 900. Connector 900 comprises a double-ended spiral unit 914, having funnel-opening ends 912 on each end. A generally tubular housing 913 circumferentially surrounds the spiral unit 914, and is immovably fixed to the spiral unit near its center. Latching systems are provided at each of the ends of the spiral unit for latching/locking the ends of the spirals (also called "spiral portions") to the tubular housing 913 after the spirals have been twisted. Preferably, said latching/locking comprises engagement of cooperating ratchet members provided on the spiral unit (on or adjacent funnel-opening ends 912) and interior end surfaces of the housing 913, in a manner similar to the ratchet bars 850 and teeth 853 of connector 800. FIGS. 39A and B illustrate to best advantage how separate cables, with stripped/stripped strands ends may be slid into the funnel-opening ends 912 and deep into the spiral unit 914. Upon twisting (rotating) of the ends 912 in opposite directions (preferably in a "two-handed twist" that does not require the person twisting the ends 912 to touch housing 913), the two spirals twist/rotate along with the ends 912 to tighten on their respective stripped/un-insulated strands. As discussed earlier in this document, as the ends 912 are twisted, preferably to the full extent possible with an adult applying moderate strength, the latching systems will automatically latch and the strands will be captured and preferably permanently be locked in the connector 900. Preferably, the insulated portion of the wire/cables will extend part way into the funnel-opening ends 912 but will not extend into the spiral portions of the connector; thus, the spiral tightens on the stripped/un-insulated strands and squeezes said strands into a tight bundle, wherein the spiral is therefore electrically-connected to the strands on the outside of the bundle and the strands on the outside of the bundle are electrically-connected to the strands on the inside of the bundle. As may be noted in FIG. 39C, this connector 900 may be described as double the structure of connector 800, as if two connectors 800 are placed in mirror-image at each end of connector 900.

In summary, certain embodiments of the invention may be said to include at least one conductive spiral that is moveable from at least one relatively large diameter configuration into which wire(s), cable(s), or other conductive elongated elements may be inserted, to at least one relatively smaller, or reduced, diameter configuration that grips said wire(s), cable(s), or other elongated elements. The preferred at least one conductive spiral may be used for electrically connecting one or more wires, cables, or other elongated, conductive members to any other conductive element. For example, one or more wires, cables, or other elongated, conductive members, stripped of any insulation or other non-conductive material, may be inserted into the at least one spiral, may be electrically connected to each other by virtue of their contact with each other and contact with the conductive spiral, or may be electrically connected to another conductive element such as a terminal end, a fixed conductive element, or other conductive elements. If more than one conductive spiral is used in a connector, it is preferred that the multiple spirals be electrically connected to each other either by being integral portions of a single conductive tube that is cut or otherwise formed to comprise multiple spirals, or by other electrically conductive connection means.

While the term "spiral" is used throughout this document, it should be noted that the conductive element of the preferred embodiments may also be called by other names, for example, the terms "coil", "wrap", or "helix" may be appropriate. As discussed above, many different shapes, sizes, spacings, and surface contours of the wraps or coils of the conductive element may be used. It is preferred that that the wires, cables, or other elongated, conductive members do not enlarge or expand the spiral when inserted into the spiral, but rather that the spiral starts significantly larger than the combined (total, overall) diameter of the wires/members being inserted into it, and then is manually reduced in diameter by a user in order to grip, capture, and electrically connect to the inserted wires/members. Thus, the spiral is moved by a user to engage and electrically connect to the inserted wires/members, rather than the insertion of the wires/members affecting the electrical connection. Insertion of the wires/members into the preferred spiral might, by chance, affect some temporary electrical connection because portions of the wires/members may rest against or otherwise touch the interior surface of the relaxed spiral. However, a reliable and permanent connection is not made until the user purposely tightens the spiral by twisting/rotating the spiral into firm and permanent engagement with the wire/member.

Many different shapes, sizes, and contours of the housing, housing portions, or other insulating members may be used in the connectors, and many different latch/lock systems may be used. It is preferred that the various housing portions, or at least outer surfaces of the housing portions, be insulating/non-electrically-conductive, for safe grasping by a user and for shielding of the conductive portion(s) of the device during installation and use. The housing portions may be rigid, or may be somewhat flexible as long as the twisting force applied by a user to the housing portion(s) is effectively transmitted to the spiral. It is also preferred that the entire spiral be covered by one or more insulating housing portions so that the spiral is not reachable by a user (except for an exposed terminal end in some embodiments). It is preferred that no part of the spiral extends out of the housing (except for an exposed terminal end in some embodiments) and it is preferred that no part of the spiral is broken or removed during installation on wire and/or during use. In view of the above preferences, it may be noted that it should not be necessary to wrap the connector or any part of the wire(s) extending into the connector with electrician's tape or other wraps. [0128] Various systems for operative connection of the housing or housing portions to the conductive portion(s) may be provided and these may comprise the latch/lock systems. The latch/lock systems may themselves be conductive, non-conductive, or part conductive and part non-conductive, as desired for optimizing manufacturing and cost, however, any conductive portions of the latch/lock systems should not be exposed or otherwise left un-insulated/un-shielded.

It may be noted that, when wire(s) are inserted into certain of the connectors, that the user will be able to easily judge and/or feel when the wire(s) are fully and properly inserted. Structure of the connector may provide a stop/limit for insertion, for example, in the embodiments of FIGS. 1-7, 19-27, 30-35, 36, 36A and B, the stripped/un-insulated wires may abut into structure at the distal end of the spiral such as a portion of the terminal end or such as a plug (not shown) inserted into the spiral distal end that does not interfere with tightening of the spiral. Alternatively, but less preferably, the stripped/un-insulated wires may slightly protrude (preferably, less than 1 cm) from the distal end of the spiral to be seen by the user. Alternatively or combination with the above methods, the user may strip the wire a predetermined amount and be able to judge proper insertion by knowing how much stripped wire extends from the insulation and, hence, how far to insert the wire(s). In some embodiments, the insulation will abut into funnel-shaped opening surfaces and therefore indicate full insertion, but this is unlikely in many cases because a single connector may be used with many different wire/cable diameters and, hence, the funnel(s) will typically not be sized to match a single insulation diameter. In the closed-end embodiment of FIG. 38, 38A-E, for example, the user may insert the wire(s) until they abut into the closed end of the housing.

In double-ended embodiments, such as FIGS. 12, 13, 28, 29, 37, 37A and B, 39, 39A-C, the user may insert the wire(s) from opposite directions into the spiral unit and feel when they abut into each other near the center of the spiral unit. Alternatively or combination with the above methods, the user may strip the wire a predetermined amount and be able to judge proper insertion by knowing how much stripped wire extends from the insulation and, hence, how far to insert the wire(s). A stop or limiting structure may be provided (not shown) at or near the center of the double-ended spiral units, but the plug or other stop or limiting structure should be chosen and installed so that it does not interfere with spiral tightening.

The preferred embodiments may provide flexibility in the type and diameter of wire(s) that can be inserted and tightened into the connector. For example, while certain connector embodiments may be designed to optimally capture a single diameter/gauge of wire, many connectors embodiments will have a structure capable of receiving and tightening to capture a range of diameters/gauges of wire. For example, many connectors and their spirals may tighten to capture at least two gauge sizes, for example, 2 gauge (American Wire Gauge) and 4 gauge, or 6 and 8 gauge, or 10 and 12 gauge. However, the inventor envisions that a single connector may be built with the flexibility to receive and tighten to capture even a wider range of gauge sizes, due to various inventive features of the spiral(s), housing(s), and latching systems. This flexibility is provided because there is preferably no structure inside the spiral except for the stripped/un-insulated wire(s) being captured; prior to insertion of the wire(s), the spiral passageway is preferably empty. Also, this flexibility is provided because the cooperating members of the latching system preferably may slide axially relative to each other a distance of at least a few millimeters, for example, about 5-10 mm for certain embodiments of smaller connectors and about 10-25 mm for certain embodiments of large connectors. Also, this flexibility may be enhanced by axial spaces/gaps being supplied between the spiral coils in the relaxed configuration, as discussed previously in this document, so that the spiral coils may tighten in diameter without abutting axially into each other (the axial spaces/gaps may close upon tightening), and, hence, without the spiral ends moving so far outward axially that they compromise the spiral latching mechanism or housing integrity. As further discussed later in this document, certain embodiments of latch/lock systems provide leeway in axial movement of the latch/lock and spiral(s) and so can accommodate axial lengthening of the spiral(s). [0132] Certain embodiments may be tightened over a wide range of diameters, for example, to reduce the spiral internal diameter, for example, by 1-50 percent or more typically 5-50 percent or 10-50 percent. Certain embodiments may reduce the spiral internal diameter, for example, 1-30 percent, or more typically 5-30 percent or 10-30 percent. In a 30 percent reduction, the resulting tightened diameter may be reduced to 70 percent of the relaxed diameter. In a 50 percent reduction, the resulting tightened diameter may be reduced to 50 percent of the relaxed diameter, for example, a relaxed internal diameter of 1 cm could tighten by 50 percent to become 5 mm in diameter. In terms of American Wire Gauge (AWG), a 50 percent reduction in diameter may be roughly equated, by "rule of thumb," to an increase in 6 AWG numbers. So, a connector capable of reducing the spiral diameter by 50 percent would operate with 2 gauge wire but also with smaller wire diameters such as those represented by 4 gauge, 6 gauge, and 8 gauge (or sizes in-between). Or, with said 50 percent reduction, a connector working well with 8 gauge wire could also operate with 10 gauge, 12 gauge, and 16 gauge (or sizes in-between). Thus, a single connector may be used for a variety of wires and cables, and the electrician, auto mechanic, computer technician, and especially the "do-it-yourselfer," may not have to use different connectors for each different size or gauge of wire.

It is also envisioned that embodiments of the invention may be used in applications typically called "burial" connections, wherein cables are connected and buried in the ground, for example, between multiple buildings or equipment on a single site, or for electrical utility lines that travel long distances underground. The preferred connectors are expected to be extremely efficient and effective, because they create a sure and reliable connection in few steps. As an added feature, a moisture-proofing material, or components that react to form a moisture-proofing material, may be included inside the connector at the time of manufacturing of the connector. For example, most connectors that would be used in a burial application would be butt-style connectors, such as the example in FIGS. 39, 39A-C, and such connectors may be made with one or more of the moisture-proofing components/compositions in a solid, semi-solid, or encapsulated or otherwise contained liquid form, inside the housing 913. See, for example, moisture-proofing material MP in FIG. 39C, which is inserted, stuck, glued, or otherwise provided, and temporarily retained, in the otherwise empty spaces inside the housing 913. Preferably, this material MP is placed in several of the "otherwise empty spaces" that are outside of the spiral and against the inner wall of the housing 913. From FIG. 39C, one may see that such empty/void spaces may exist between the spiral and the housing near the housing wall, between each set of ratcheting latch mechanism L and the central ring R that extends to and is fixed to the spiral 914. With the material MP thus positioned, it will not interfere in the insertion of the wires into the spiral, but, after tightening of the spiral on the wires, the connector may be subjected to heat or other activation that starts the reaction(s) that create and/or expand the moisture-proofing effect.

The material MP may be various compositions that will be understood by one of skill in the art after reading this disclosure. The preferred moisture-proofing material helps protect the connector, and especially the conductive spiral and stripped wires, from becoming corroded or damaged by water and ground moisture over many years. Those reading this disclosure and being familiar with expanding polymeric foams and caulking materials will understand how to select a material that may be used to seal the spiral-and-wire combination and water-proof the connector as necessary for burial applications. For example, a heat-activated material may be used that creates a moisture-resistant or moisture-proof foam that expands into all or nearly all the empty spaces that would otherwise available for entering moisture. Other expanding foams or materials may be used that are heat-activated, radiation-activated, or other-wise activated to expand and fill spaces only when purposely activated by an installed. Alternatively, the expansion may be activated by breaking a membrane(s) between two or more chemical sacks or capsules that are provided inside the housing, for instance, upon twisting of the spiral of other pricking or tearing of a membrane(s). It is preferred that the expanding material fill the spaces around the outside of the spiral, between the housing and the spiral, and the spaces between the housing 913 and the housing ends 912, 912', so that the moisture-proofing substance may even expand out of each end of the connector. The moisture-proofing substance may even seep or expand into the spiral as long as the tightening has already been performed and the electrical connection has already been made. Therefore, it is an option for expanding material to be placed inside or at the ends of the spiral, as long the activation of it occurs at a time that does not interfere with the tightening and proper electrical contact.

The electrically-conductive parts of the preferred connectors may be selected from many commonly-available conductive materials available in industry, and from materials to be made available in the future. For example, many metal and metal alloy tubular materials and flat sheet materials are known in the electrical arts, including but not limited to copper and copper alloys, and those of skill in the art will understand how to select materials from these commercially-available stock materials.

ESPECIALLY-PREFERRED EMBODIMENTS

Figure 39B:
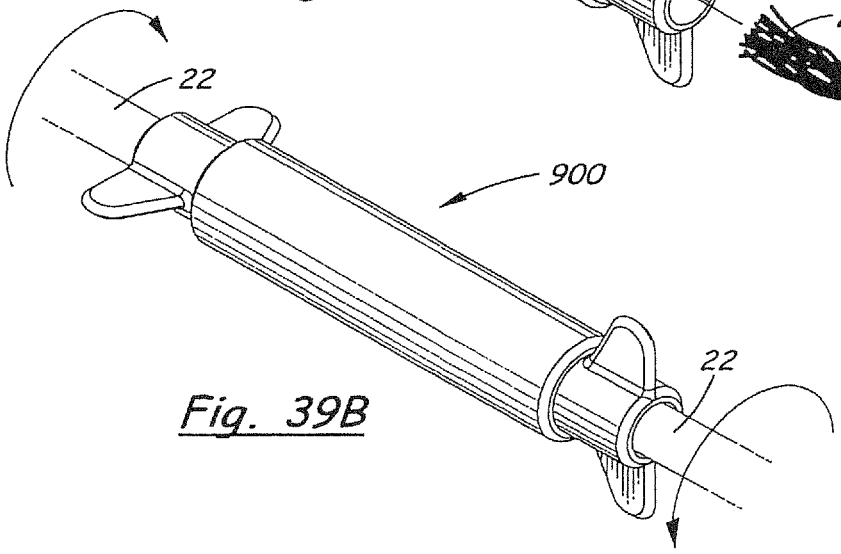
Figure 39C:
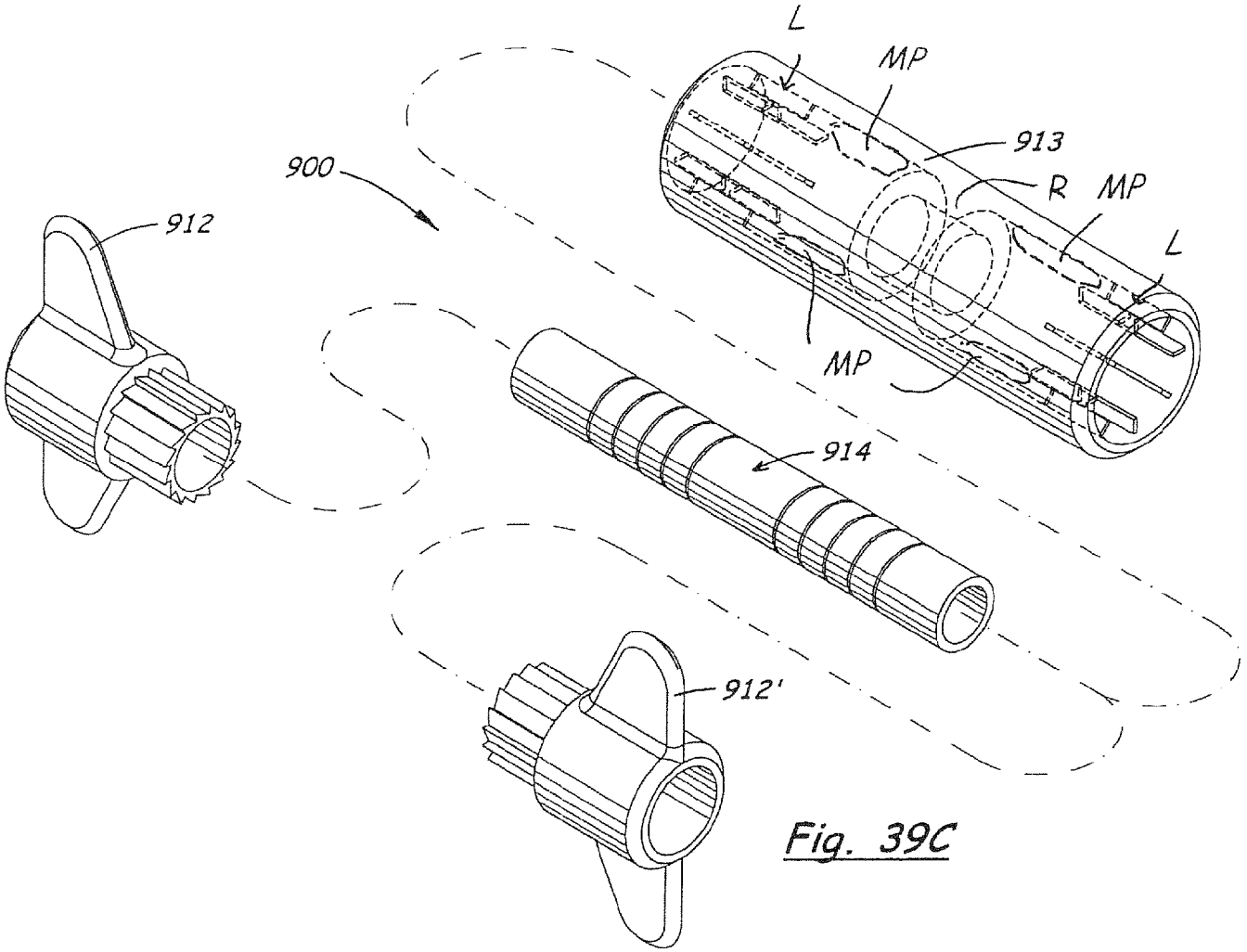
Figure 40:
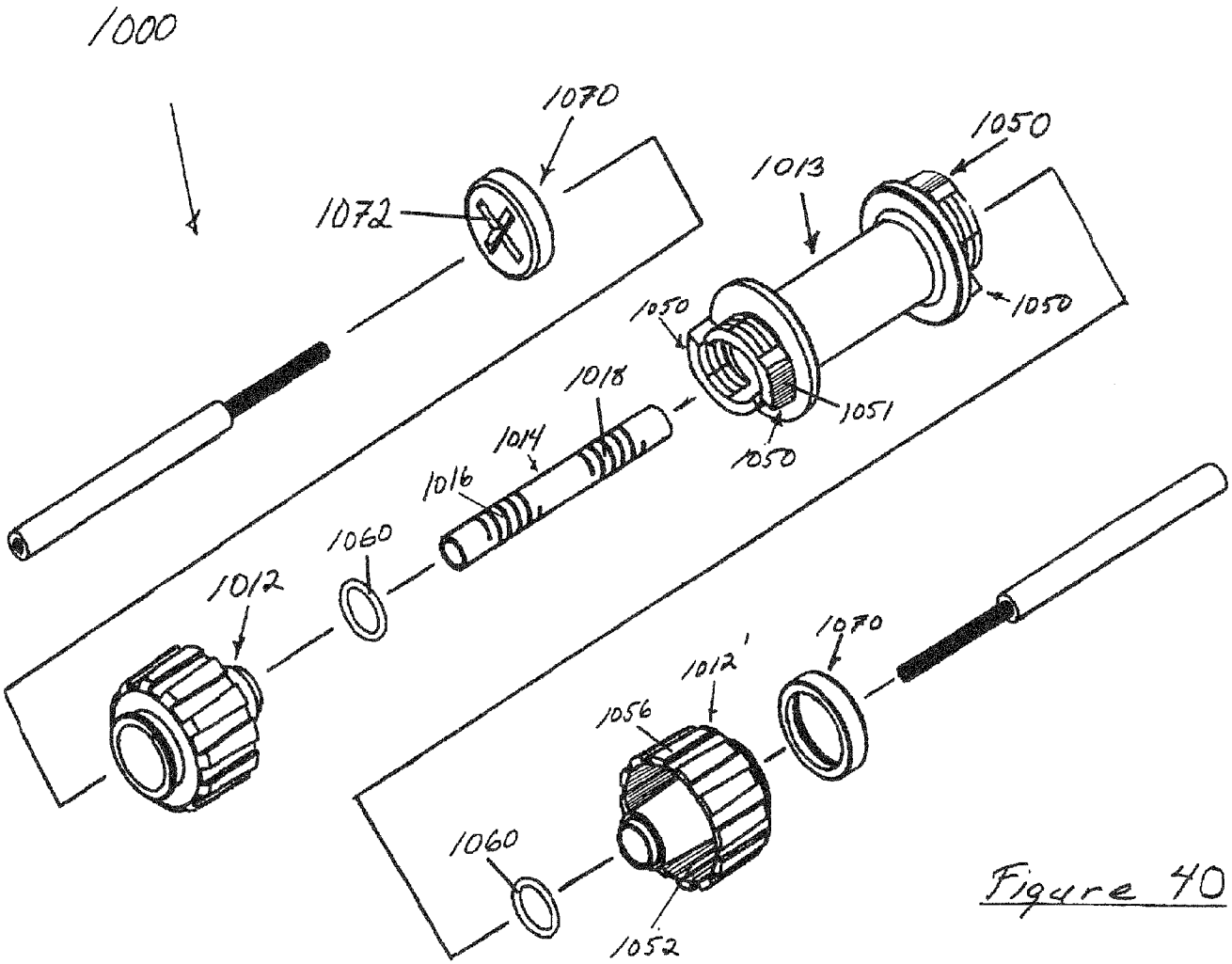
FIG. 40 is an exploded perspective view of yet another embodiment of a butt-style connector, wherein the main body of the housing has curved latch arms that engage with an interior surface of the cooperating end cap.
Figure 41:
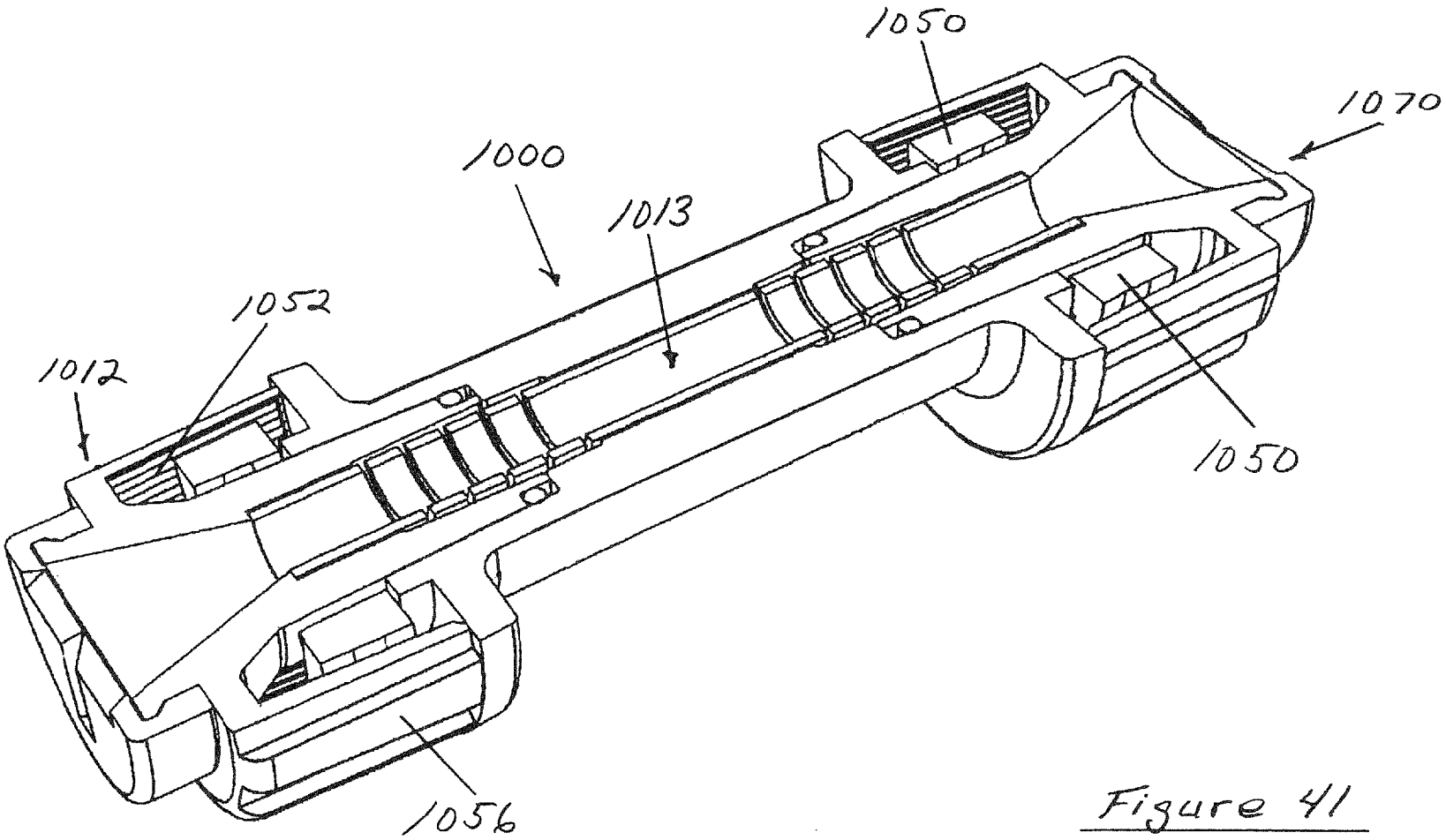
FIG. 41 is a longitudinal cross-sectional, perspective view of the embodiments of FIG. 40.
Figure 42D:
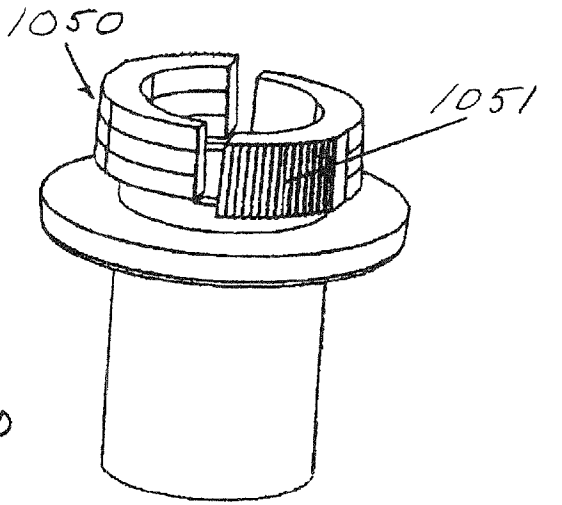
FIG. 42D is a side perspective view of one half of the main body, showing to best advantage the latch arm system of the main body.
Figure 42C:
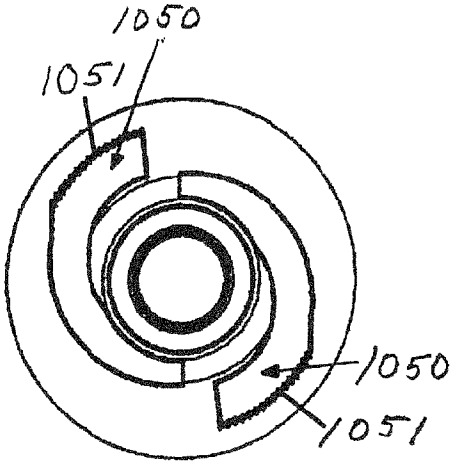
FIGS. 42A-C are a perspective view, side view, and end view, respectively, of the main body of the housing of the embodiment in FIGS. 40 and 41.
Figure 42A:
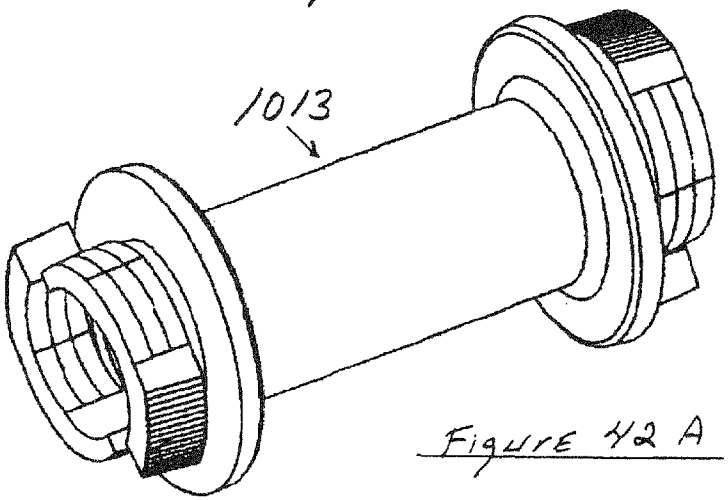
Figure 42B:
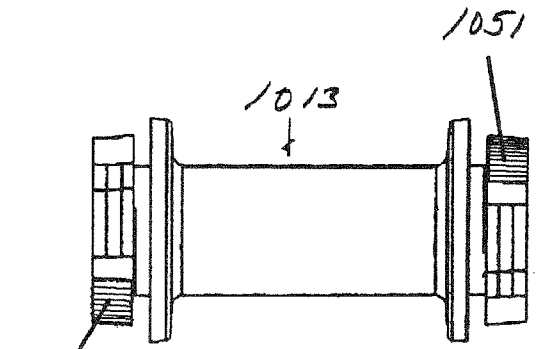
Figures 43A, 43B, 43C, 43D, 43E:
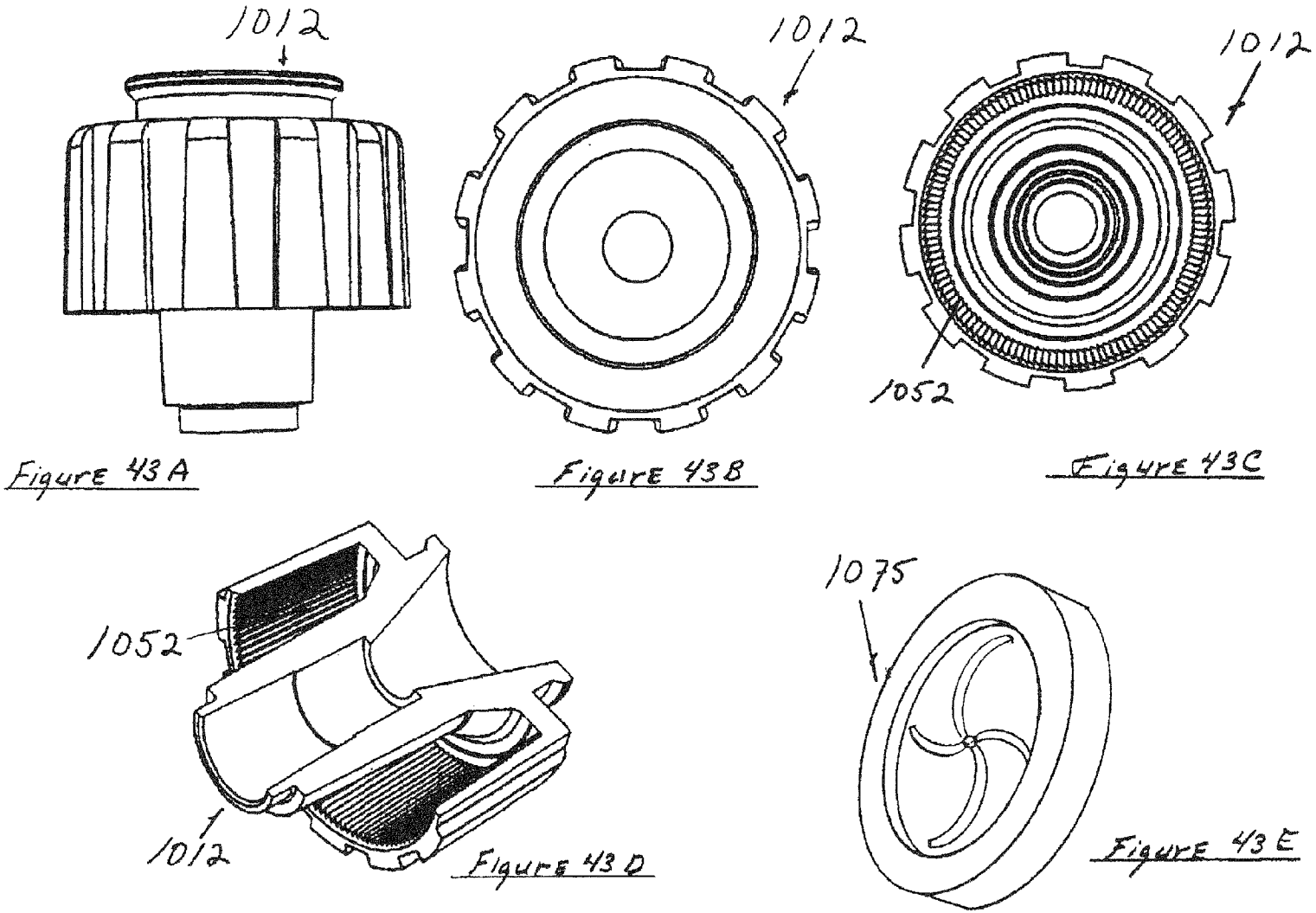
FIGS. 43A-D are a side view, an outer end view, an inner end view, and a longitudinal cross-sectional view, respectively, of the end cap of the embodiment of FIGS. 40 and 41.
FIG. 43E is a perspective view of an alternative dust cover that may be used to cover the opening/passage through the end cap.

Referring to FIGS. 40 through 43A-E, there is shown an alternative butt-style connector 1000, which is similar to the butt-style connector shown in FIGS. 39A-C, but with modified housing 1013 and ends 1012, 1012'. The housing 1013 may also be called the "main housing body" or "central housing portion", and ends 1012, 1012' may also be called "end caps" or "housing end portions", as both housing 1013 and ends 1012, 1012' may be considered portions of one housing that generally surrounds and insulates the conductive spiral and the conductive wires. As will be understood from the description of other embodiments earlier in this document, the housing 1013 is fixed to a central region of the spiral 1014, preferably midway or generally midway between the two end of the spiral 1014, and the two ends of the spiral are fixed to their respective ends 1012, 1012', so that twisting of the ends 1012, 1012' relative to the housing 1013 tightens the spirals to grip wires inserted therein.

The latch interaction between the housing 1013 and ends 1012, 1012' comprises curved latch arms 1050 with teeth 1051 that engage cooperating end cap teeth 1052 on the inside circumferential surface of a generally cylindrical skirt 1056. Thus, portions of the housing 1013 comprising said latch arms 1050 extend into an annular space in each end 1012, 1012', and the shirt 1056 extends outside of, and axially along, the portions of the housing 1013 comprising the latch arms 1050. The latch arms 1050 are preferably inherently biased to press outward against said end cap teeth 1052 to mate with teeth 1052. Upon twisting of the ends 1012, 1012' relative to the housing 1013, latch arms 1050 are slightly resilient, that is, sufficiently resilient to allow relative motion of the ends 1012, 1012', each in one direction, relative to the housing 1013 to tighten the spiral 1014. Specifically, end cap 1012 will be rotated clockwise in a view from the left in FIG. 40, and end cap 1012' will be moved clockwise in a view from the right in FIG. 40. The latch arm teeth 1051 and end cap teeth 1052 are each slanted to allow this relative motion of the ends 1012, 1012' and latch arms during tightening of the spiral, with the teeth 1051 and teeth 1052, in effect, sliding over and past each other, as will be understood from the drawings. Upon release of the tightened ends 1012, 1012', the bias of the latch arms 1050 will cause them to continue to press out against the grooves 1052, and the teeth 1051 and 1052 will mate and catch on each other to stop motion in the reverse. Thus, the latch retains the spiral in the tightened, smaller-diameter configuration.

Viewers of FIGS. 40-43E will see and understand the structure of connector 1000 in view of the earlier drawings and discussion in this document regarding other embodiments of the invented spiral-based connectors. O-rings 1060 or other seals may be provided to form a liquid-seal between the ends 1012, 1012' and the housing 1013, to keep moisture/water out of the connector. Also, or instead, the o-rings 1060 may keep moisture proofing material inside the connector (see the discussion of such material MP above for FIG. 39C) and/or keep any other expanding foam components or other chemical compositions inside the connector, such as any chemical compositions that may be used to contact or chemically treat the spiral or housing interior for any purpose. Also, one may see in the drawings an example of dust covers 1070 that may be used on each end cap 1012, 1012' to keep the connectors clean "on the shelf" and that may remain on the connector when in use. A easily-broken-through portion of the end cap, such as the X-shaped portion 1072 of cover 1070, may be used to allow the wires through a resilient/flexible portion of the cover 1070 during insertion of the wire ends; other opening or apertures may also be used, for example, as portrayed by the alternative cover 1075 in FIG. 43E that has a weakened/thin spiral pattern through which the wire ends may be inserted.

Figure 45A:
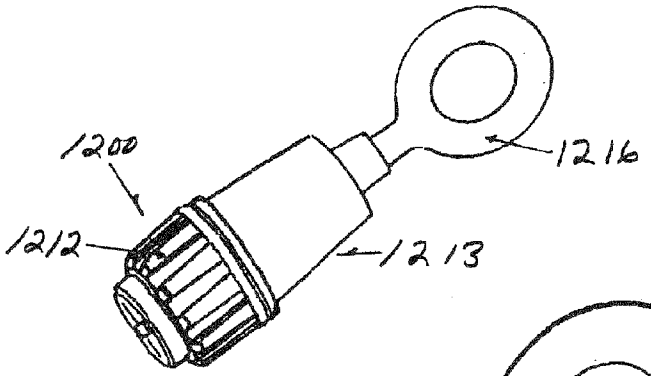
FIGS. 45A and B are side, and longitudinal cross-sectional views, respectively, of an alternative embodiment of a connector that receives wires into one open end of the connector and electrically those wires to a terminal end.
Figure 45B:
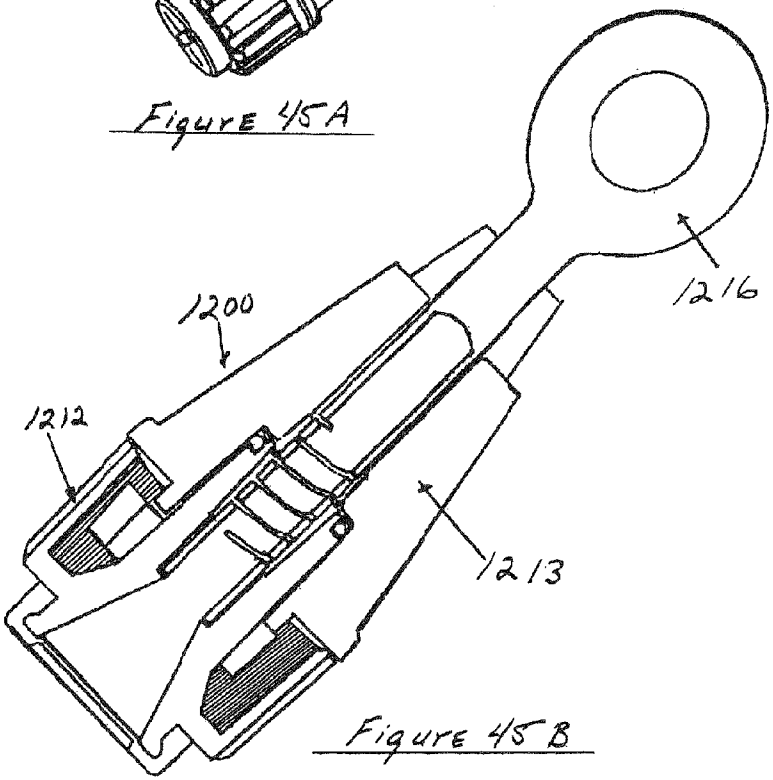
Figure 44A:
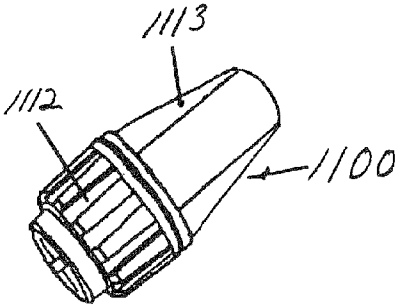
FIGS. 44A and B are side, and longitudinal cross-sectional views, respectively, of an alternative embodiment of a connector that receives wires from separate cables only into one open end of the connector and electrically all of those wires.
Figure 44B:
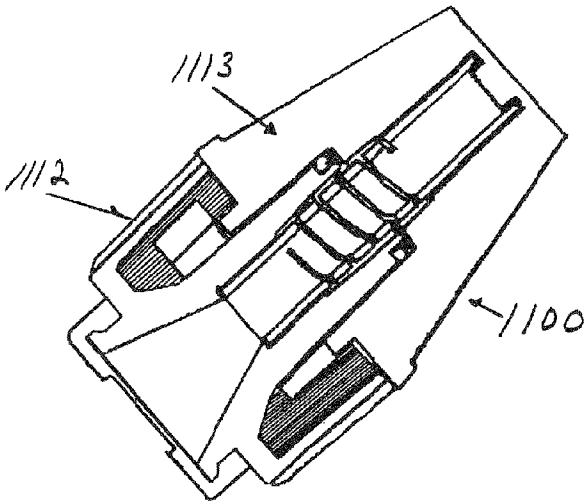

FIGS. 44A and B, and FIGS. 45A and B, illustrate alternative embodiments of a connector 1100 of the general type shown in FIGS. 38-38E, and of a connector of the general type shown in FIGS. 1-7, 19-26, 30-35, respectively. Connector 1100 receives multiple stripped or otherwise un-insulated wires ends into one end of the connector and electrically connects all of said wires. Connector 1200 comprises a terminal end 1216 electrically-connected to the spiral and extending out from the housing to be connected to other conductive equipment, as described earlier in this document. As also discussed earlier, the terminal end may be selected from many different shapes and styles of terminal ends. One may see in FIGS. 44A and B, and 45A and B, that one end 1112, 1212 is provided on connectors 1100 and 1200, respectively, for gripping and turning/twisting relative to housing 1113, 1213 to tighten the spiral inside each connector. End 1112, 1212, and the latch arms of housing 1113, 1213 are similar to the housing ends 1012, 1012' and latch arms 1050 described above for connector 1000, and their interaction for housing and latching the spiral will be understood by those reading and viewing this document.

While wires or cables are not shown in FIGS. 40-45B, it will be understood that said wire/cable ends are inserted into the open ports, or through cover/caps on the ports into the connectors, as described above for other embodiments. One may see a funnel-shaped interior surface of the housing end caps to best advantage in FIGS. 41 and 43D, 44B, and 45B, and this may help accurate and sure insertion of the wires through the ends, as discussed previously in this document. Such a funnel-shaped surface is preferred in certain embodiments but not always required, as long as enough space is provided in the ends to receive the wire ends and allow them to travel into the spiral(s).

Referring to FIGS. 46-55, there are shown some, but not the only, embodiments that could be used in the environments/applications in which a block-style connector is typically desired. Examples of prior art commercially-available block connectors are Polaris™ brand block connectors. Block connectors are desirable for heavy-duty applications such as utilities, for example, wherein very heavy gauge wire(s) are used. For example, 4 or 6 gauge wire may require the special adaptations of the preferred embodiments shown in FIGS. 46-55.

Figure 48:
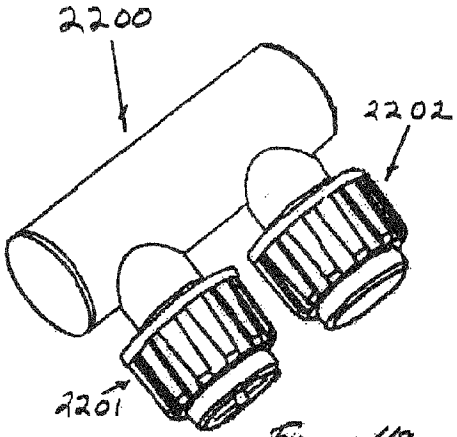
Figure 49:
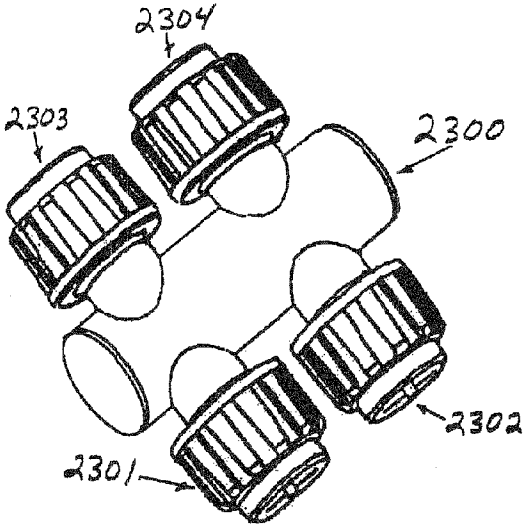
Figure 46:
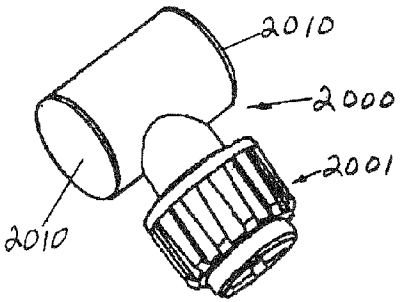
Figure 51A:
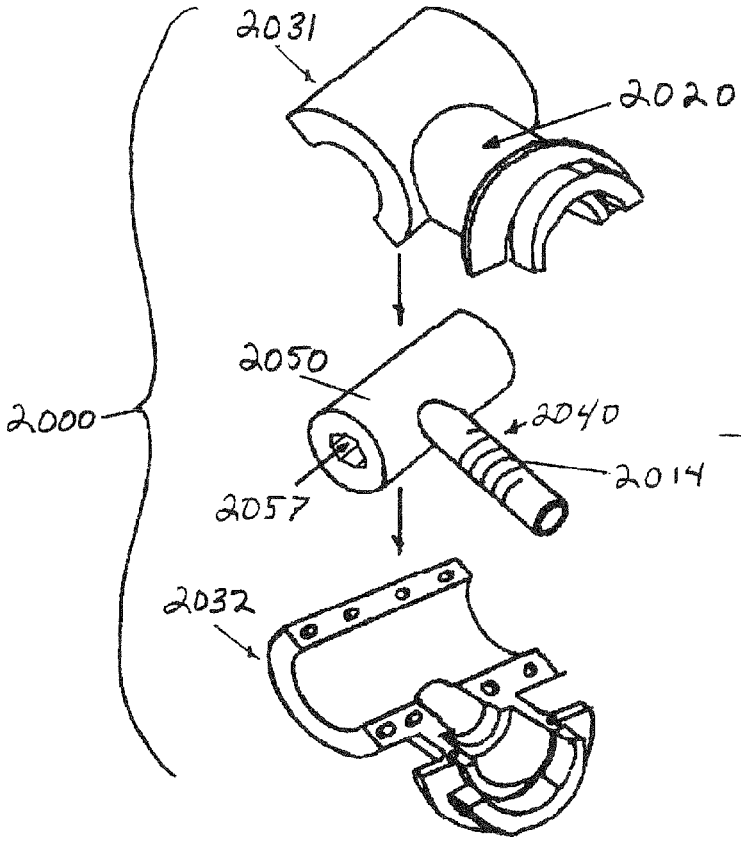
FIGS. 51A and B are perspective exploded views of a module such as shown in FIG. 46, with end-plates removed.
Figure 51B:
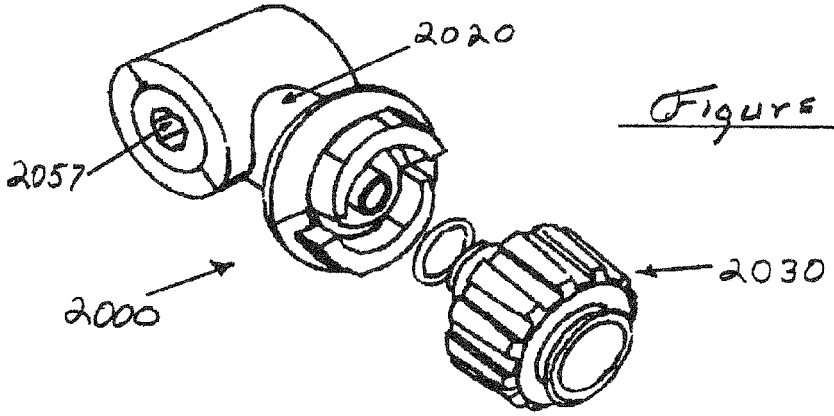

Examples of preferred embodiments of the invented block-style connector are shown in FIGS. 47-50. FIG. 46 portrays a connector 2000 with a single port 2001 for entry of multiple wires that are to be electrically connected, for example in a manner similar to that described for connector 800 in FIGS. 38-38E. FIG. 47 portrays a connector 2100 that has two ports 2101, 2102, each receiving wire(s) in what may be likened as a "butt-style" connection, as discussed earlier in this document, so that the ports 2101, 2102 may be called "opposing" ports. FIG. 48 portrays a connector 2200 with two, side-by-side ports 2201, 2202. FIG. 49 portrays a connector 2300 with four ports 2301, 2302, 2303, 2304, wherein two ports are side-by-side on each side of the connector, so that ports 2301 and 2302 are side-by-side, ports 2303 and 2304 are side-by-side, ports 2301 and 2303 are opposing, and 2302 and 2304 are also opposing. By "side-by-side" is meant that ports are on the same side of the generally cylindrical main housing body of the connector, and preferably each has a longitudinal axis, extending out from the main housing body and coaxial with the axis of its end cap, that is parallel to the adjacent (side-by-side) ports. By "opposing" is means that ports are on opposite sides of the generally cylindrical main housing, and preferably each has a longitudinal axis, extending out from the main body of the connector and coaxial with the axis of its end cap, that is coaxial with the longitudinal axis of the opposing port. Side-by-side ports may be said to be preferably 0 degrees from each other, or approximately 0 degrees from each other (0-10 degrees, for example). Opposing ports may be said to be 180 degrees from each other, or approximately 180 degrees from each other (170-180 degrees, for example). Alternatively, longitudinal axes of multiple ports on a connector may be at angles other than 0 and 180 to each other, and other than approximately 0 and 180 degrees to each other, for example, 90 degrees, 45 degrees, or any angle between 10 degrees and 170 degrees.

Connectors 2000, 2100, 2200, 2300 comprise conductive spiral(s) inside their main housing bodies that preferably are coaxial with said longitudinal axes of the provided ports. In the case of opposing ports, one spiral unit, or multiple spirals, may extend between the ports on a single axis, for example, that single axis being coaxial with the ports. In the case of connector 2100, for example, one may understand from the drawings that two separate spirals may connect to a holder tube 2150, wherein one is provided for port 2101 and one is provided for port 2102, or that a single spiral unit may pass through the holder tube 2150 for both ports 2101 and 2102. In the case of side-by-side ports, each port will cooperate with a spiral, and the spirals will typically be electrically-connected by a conductive holder tube or other holder member or insert that extends between the spirals inside the main body of the housing.

Connectors 2000, 2100, 2200, 2300 may be stand-alone connectors, which are closed at their ends by end portions of the main body of the housing, or by end plates that snap into or otherwise attach to said main body to close the ends of the housing. The preferred end plates 2010 are called-out in FIG. 46 but also may be seen in all of connectors of FIGS. 46-49. If the connectors are to be used solely as stand-alone connectors, these end plates may be permanently attached, and/or may instead be integral portions of the main body. But, if the connectors 2000, 2100, 2200, 2300 are to be used as modular connectors, as will be discussed in detail below, the end plates 2010 may be removable for connection of multiple connectors together.

Figure 50:
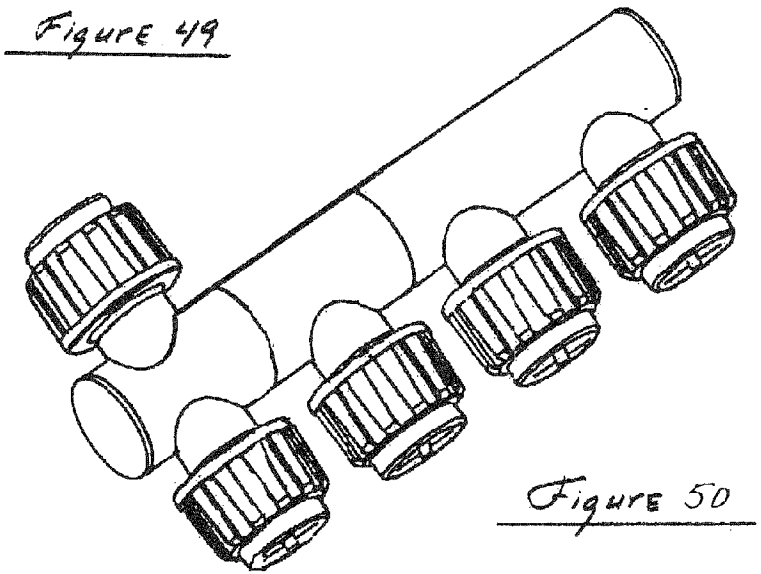
Figure 42:
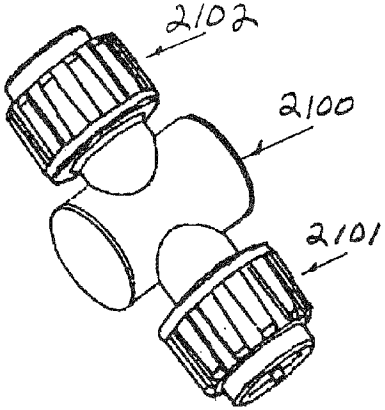

FIG. 50 portrays one embodiment of a modular connector assembly 2400, which is constructed of three modules that are (left to right) connectors 2100, 2000, and 2200, with end plates removed from their housings as appropriate to connect them together. This is but one embodiment of many assemblies that may be put together from multiple modules, for example, to increase the number of the wire ports and wires being connected. Various combinations of connectors may be assembled by a manufacturer or a user, wherein the combinations may comprise, for example, one or more of: a single connector (2000), a single butt-style or "single pass-through" connector (2100), a side-by-side or "double" connector (2200), or a double butt-style or "double pass-through" connector (2300). Electrically-conductive dowels or other protruding fastener members extend between and connect the modules in a great variety of different configurations with a great variety of electrical connection options. Optionally, dowels or other protruding fastener members may mechanically connect certain embodiments of the modular connectors without establishing an electrical connection between at least some of the modules. Optionally, alternative fasteners (electrical, electrical and mechanical, or mechanical but not electrical) may be used to attach modules together, for example, snap-together, detent, push-and-twist, ratchet-lock, hook, threaded, or other fasteners may be used, with the preferred fasteners being ones that are easily and quickly connected. Fasteners that stay permanently together once connected may be desirable in certain embodiments, while detachable fasteners may be desirable in other embodiments. This way, electrical and/or mechanical connection may be made with multiple modules, and the electrician may carry several modules for forming virtually any combination, shape and form of connection device configuration.

It may be noted that alternative holder members may be used, especially those adapted for use with alternative fasteners. Holder members/inserts that are not tubular may be used, for example, conductive bars extending through the main body and terminating at each end with a fastener that can snap-fit, threadably-fit, hook-to, or otherwise connect to fastener of a conductive bar of an adjacent module.

Each dowel/fastener member may be sized so that it extends all the way between spirals in adjacent modules, for example, each dowel/fastener member may be press-fit (or otherwise secured) into the opened end of another module (having removed the end cap EC of that "another module") until it abuts into a stop (not shown) at or near the center of the module or until it abuts into a dowel/fastener inserted into the opposite end of the "another module". Alternatively, in certain embodiments wherein an electrically-conductive holder tube/insert extends transversely outward relative to the spiral(s), the outer end(s) of the holder tube/insert of one module may be connected to the outer end(s) of a holder tube/insert of other module(s) without the dowel/fastener extending deep into the holder tube/insert. Thus, in certain embodiments, the dowel/fastener may extend deep into the modules and/or far enough to contact the spiral(s) themselves, while in certain other embodiments, the dowel-fastener may extend only shallowly into the modules and/or may connect just the end surfaces of the conductive internals of the modules. Preferably, the dowel/fastener, once the modules are assembled together, is hidden and electrically-insulated by the housings of the modules or otherwise covered so that the dowels/fasteners will not allow a user to touch the dowels/fasteners and be shocked.

In certain embodiments, each dowel/fastener member is electrically-conductive, so that all the connected modules are electrically connected to each other by the dowel/fastener member passing between the modules to electrically connect all the spirals contained therein, and also to preferably mechanically connect the modules. This way, one or more "incoming" wires/cables may be installed in one or more ports, and "outgoing" wires/cables may be installed in other port(s), with all electrically connected. While wires or cables are not shown in FIGS. 40-43E, it will be understood that said wire/cable ends are inserted into the open ports, or through cover/caps on the ports into the connectors, as described above for other embodiments.

In other embodiments, certain of the modules in a connection device configuration are electrically connected as well as mechanically connected, while certain of the modules are only mechanically connected. This will be understood by the above discussion of fasteners that may be both electrical and mechanical connectors and fasteners that are only mechanical connectors. In many embodiments, each module in the device configuration will be electrically connected to at least one other module, but this is not always required. For example, a user may want a device configuration wherein at least some electrically-independent connectors are mechanically connected merely as a method of organizing or supporting the modules/connectors in a "framework" or "rack" of modules.

FIGS. 51-55 illustrate details of certain embodiments of the modular connectors. The ports of these connectors have port housing collars 2020 and endcaps 2030, respectively, that are the same or similar to structure shown in FIGS. 40-45B, that is, to portions of the housings 1013, 1113, and 1213, and to ends 1012, 1012', 1112, and 2112 that cooperate with said portions of the housings. Thus, one will understand from the earlier description in this document how the latch arms with teeth, ends with teeth, endcap skirt, and o-rings are constructed and operate to allow tightening of the spiral(s) and latching of the spiral(s) in the smaller-diameter configuration that grips and retains the wires in the connector. Specifically, FIG. 51A shows connector 2000, with its endplates removed, wherein one may see upper half 2031 and lower half 2032 of the main housing body, which are fixed/secured together around the conductive spiral unit 2040. Other housing constructions may be used for this connector and the other modular connectors, but this construction of two halves may be useful when inserting the spiral unit into the housing. The conductive spiral unit 2040 comprises a spiral 2014 that extends into the port 2001 to receive wires at its distal end, with its proximal end integral with or fixed to the conductive holder tube 2050 received in the generally cylindrical interior space of the main body of the housing. Thus, the wires are received and gripped in the spiral 2014, the spiral is electrically-connected to the holder tube 2050, and, in the event that the connector 2000 is used as a module connected to other modules, a conductive elongated member, such as dowel(s) 2070, mechanically and electrically connects the holder tube 2050 to one or two holder tubes of adjacent modules. This way, the conductive dowel(s) electrically connect the holder tubes of adjacent modules, and preferably the radial end surfaces 2055 of the adjacent holder tubes will also be touching and therefore in electrical contact. This results in large surface area of conductive material of each module being in contact with adjacent modules, for a sure electrical connection between the modules. One may understand that the holder tube 2050 may be connected by one dowel 2070 to only one module on either end of the connector 2000, or by two dowels to two modules (one on each end of connector 2000). In certain embodiments, the spiral 2014 extends into the center of the hollow passageway 2057 of the holder tube 2050, so that it creates a stop/limit for the inserted dowel, to ensure that the dowel will be positioned in the module so that it protrudes far enough out of the module to connect to an adjacent modules, and so that it does not become forced all the way into the holder tube 2050. As discussed above, however, alternative stops/limits for dowels/fasteners may be used, and/or alternative fasteners for connecting holder tubes/inserts of adjacent modules may be used including ones that do not require a stop/limit inside the holder tube/insert or other internals of the modules.

Figure 55:
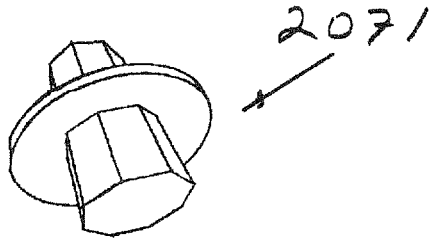
FIG. 55 is a perspective view of one embodiment of an alternative dowel made of non-conducting material that may mechanically connect modules but not place them in electrical contact with each other.
Figures 56, 57:
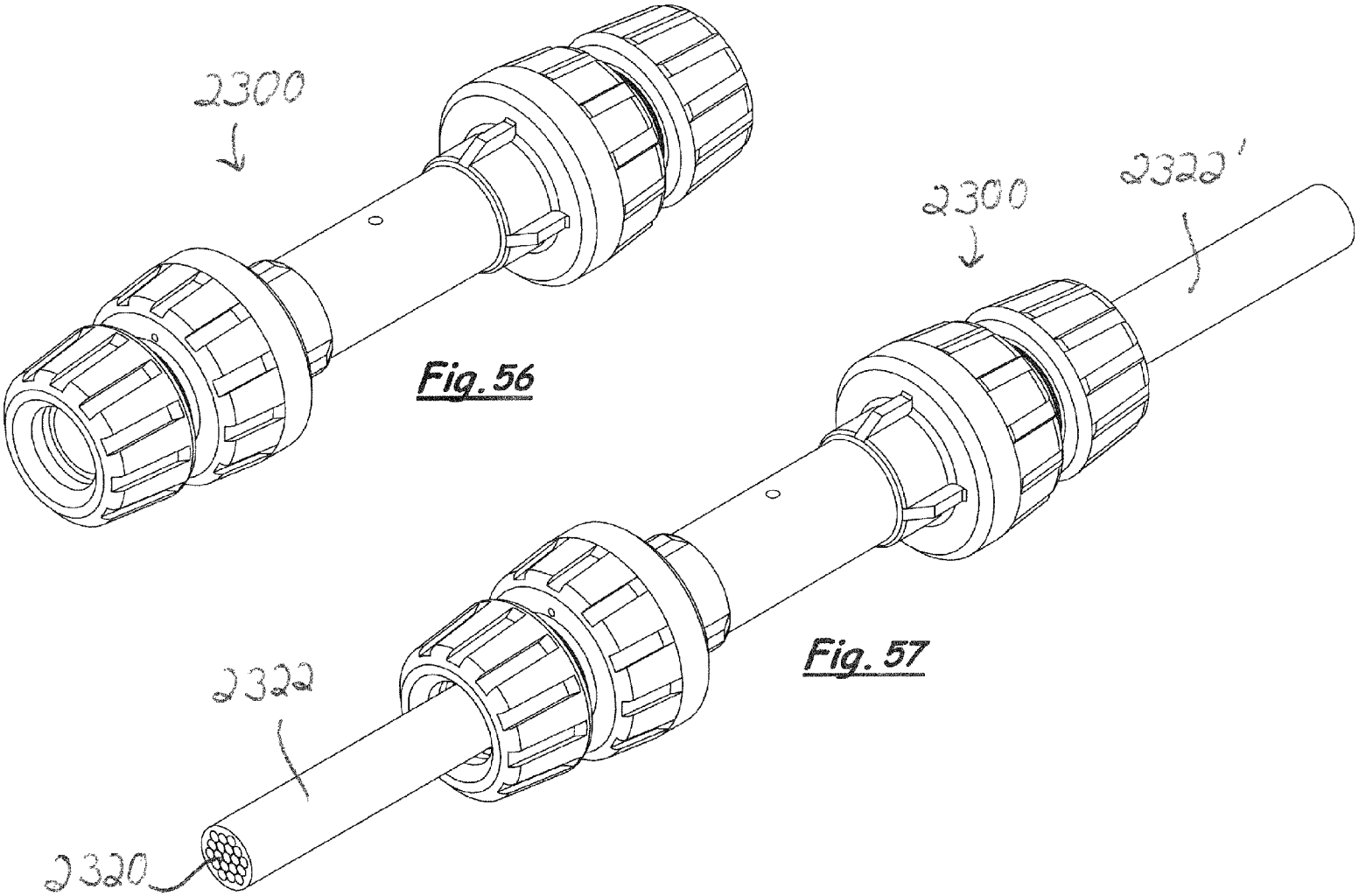
FIG. 56 is a perspective view of another embodiment of a butt-style connector.
FIG. 57 is a perspective view of the embodiment of FIG. 56 in use connecting two cables.
Figure 58:
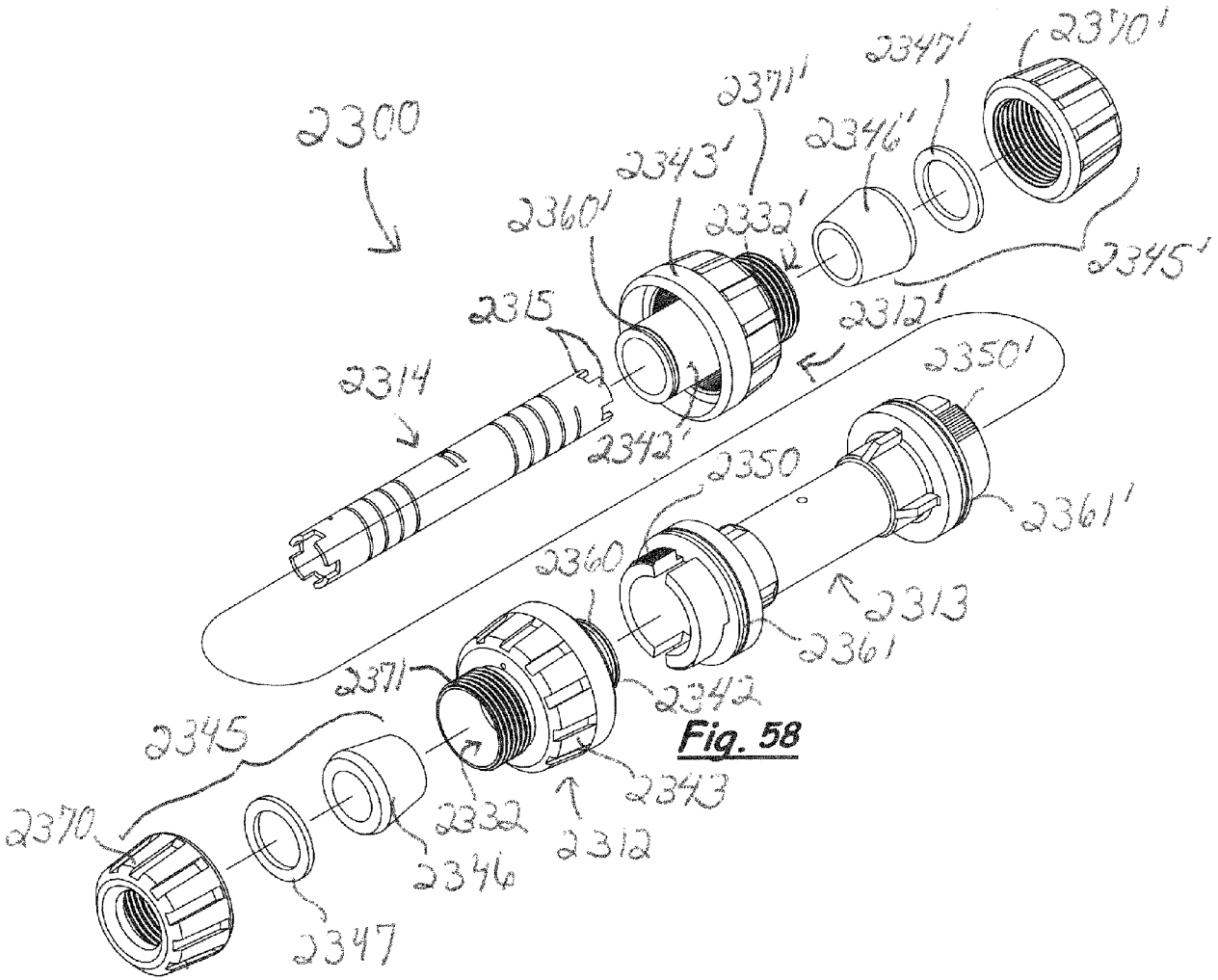
FIG. 58 is an exploded perspective view of the embodiment of FIG. 56.
Figures 59, 60:
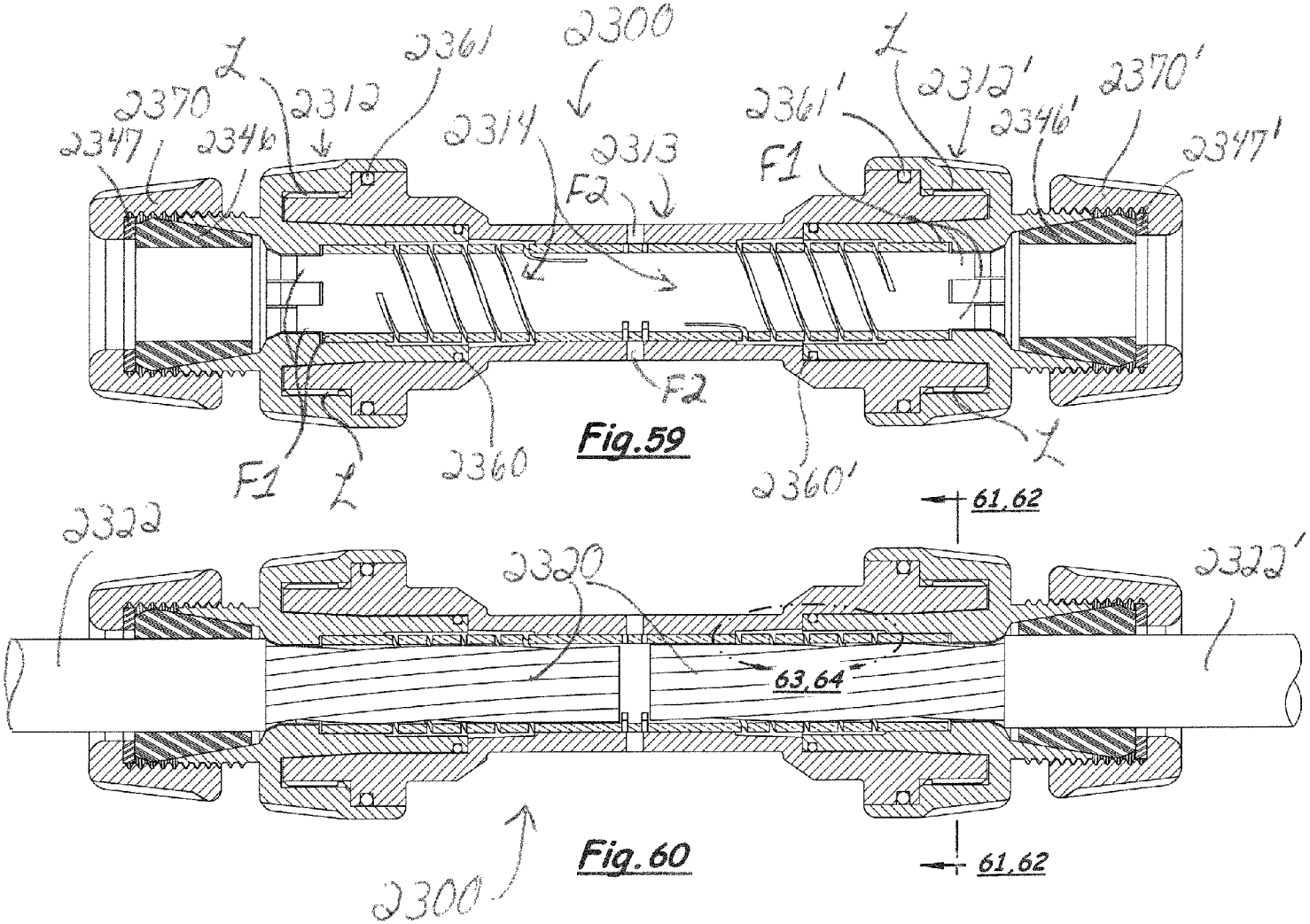
FIG. 59 is a longitudinal cross-sectional view of the embodiment of FIGS. 56 and 58.
FIG. 60 is a longitudinal cross-sectional view of the embodiment of FIGS. 56 and 58 shown connecting two cables (as in FIG. 57).
Figures 61, 62, 63, 64:
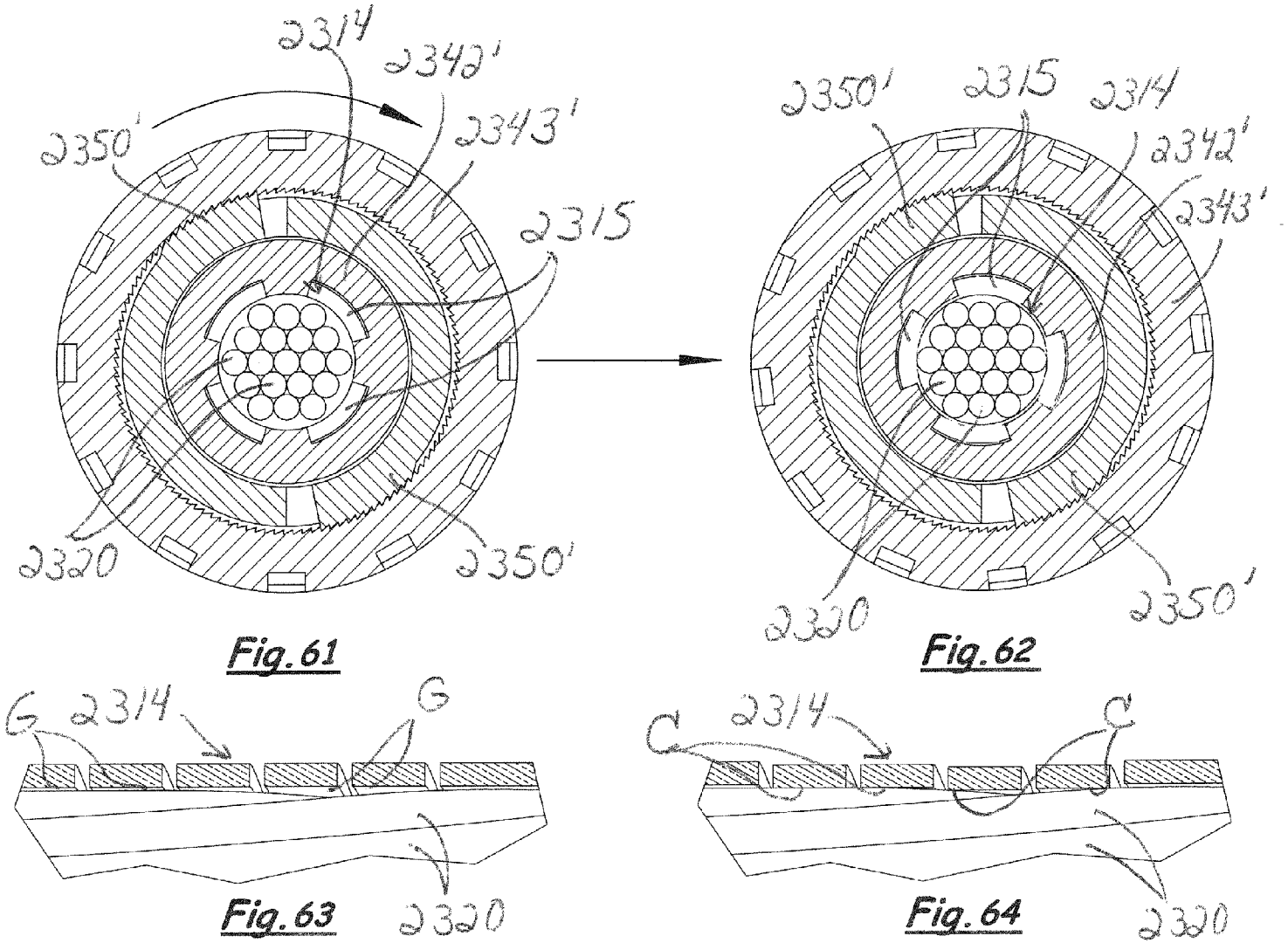
FIGS. 61 and 62 are transverse (radial) cross-sectional views of FIG. 60, viewed along the line 61, 62 in FIG. 60, before (FIG. 61) and after (FIG. 62) the connector is tightened on the wires.
FIGS. 63 and 64 are detail views at the circled portion of FIG. 60, before (FIG. 63) and after (FIG. 64) the spiral unit is tightened on the wires, corresponding to the steps portrayed by FIGS. 61 and 62, respectively.

In the instance of connector 2000, it will be understood that the holder tube 2050 need not be electrically-conductive if the connector 2000 is to be only a stand-alone (or "electrically-independent") connector that is not to be electrically connected to another connector. Or, in the instance of connector 2000 being mechanically connected to other module(s) but not electrically connected, the dowel unit or other fastener may be a non-conductive connector. A non-conductive dowel unit 2071 is shown in FIG. 55, having preferably-non-electrically-conductive polygonal dowel portions, plus a non-electrically-conductive plate to shield/electrically-insulate the ends of the holder tubes/inserts from each other, to mechanically connect modules but not to electrically connect them. This may be done for various reasons, for example, for the convenience of having a single connector unit (or a "device configuration" or "rack" or "framework" as described earlier) wherein not all ports are in electrical contact with all other ports.

Figure 52A:
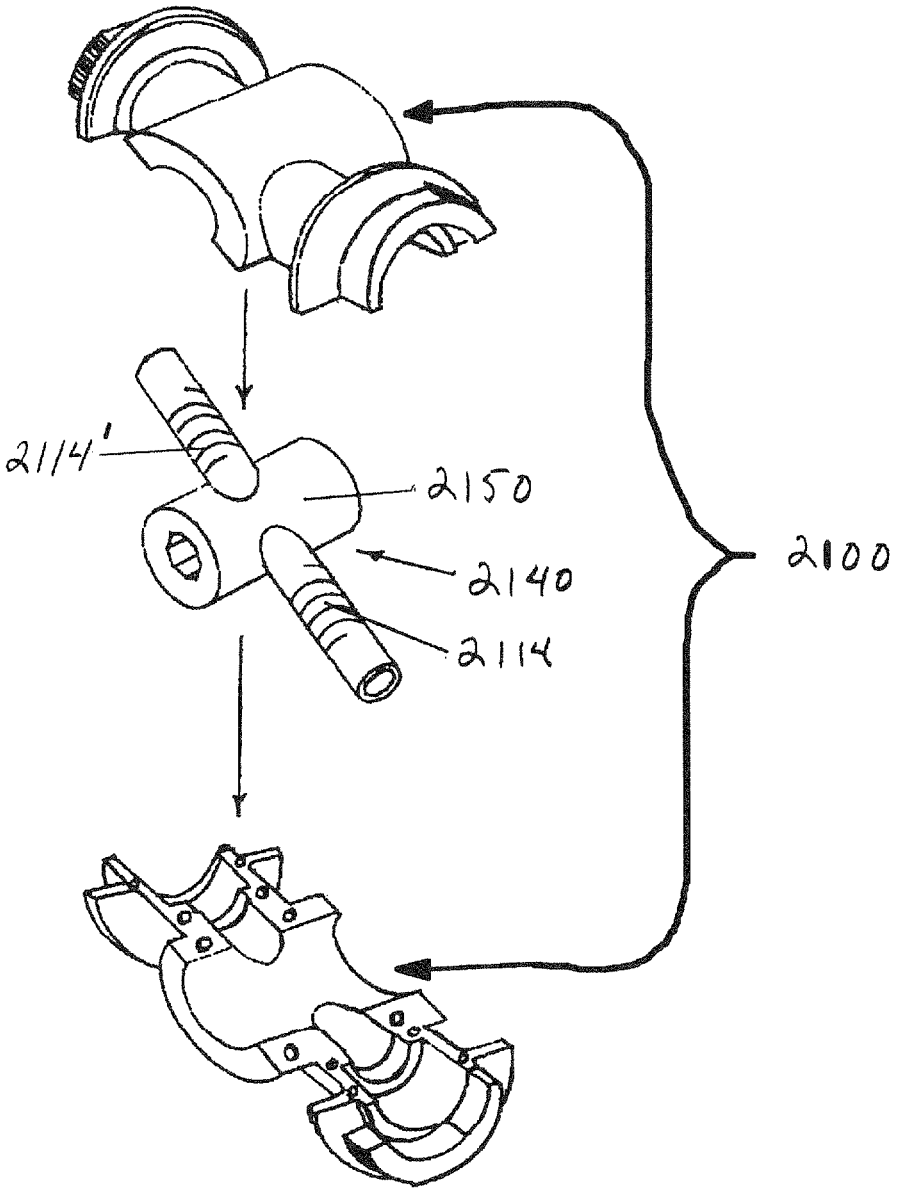
FIGS. 52A and B are perspective exploded views of a module such as shown in FIG. 47, with end-plates shown at the left and right of the main housing body of the connector.
Figure 52B:
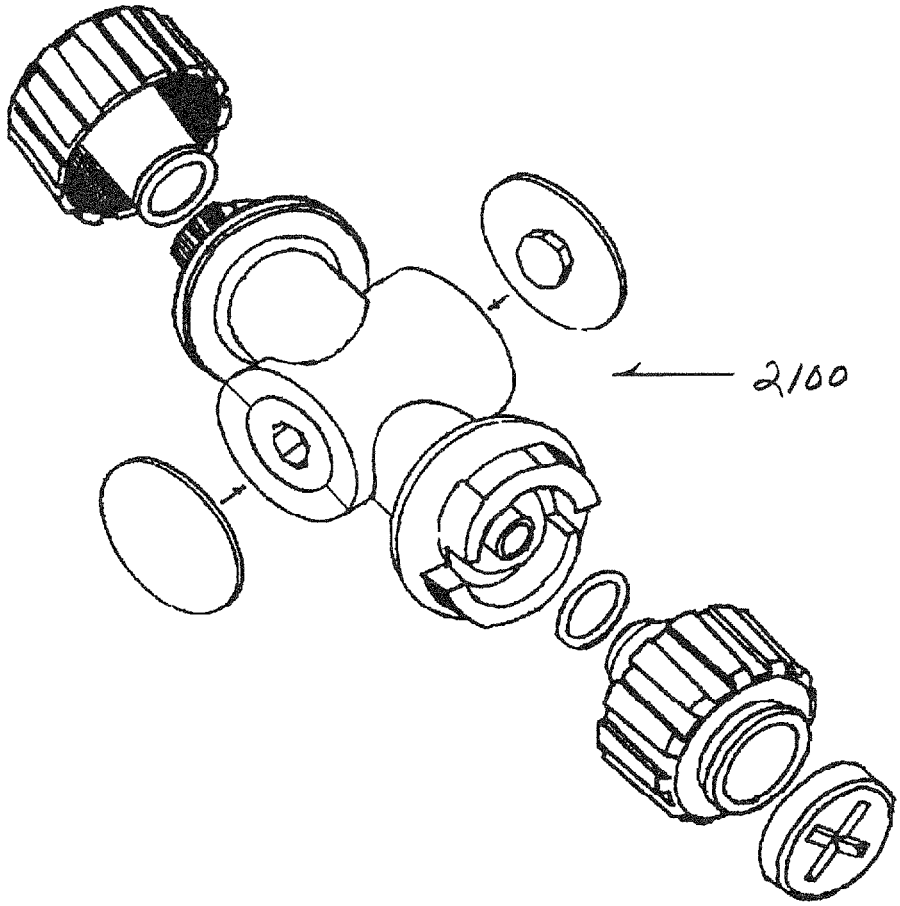

FIGS. 52A and B portray details of connector 2100, with endplates removed, wherein one may see that the main body of the housing may be made from an upper half and a lower half, that are fixed/secured together around spiral unit 2140. Spiral 2140 is made of two conductive spirals 2114, 2114' fixed to, and in electrical contact with conductive holder tube 2150, wherein the spirals 2114, 2114' are preferably coaxial and extend out from the cylindrical side-surface of holder tube 2150 transverse to the longitudinal axis of the holder tube 2150. One may see, therefore, that wires installed in the ports and gripped by the spirals 2114, 2114' will be in electrical contact with each other and with the holder tube 2150, and, if the connector is modularly connected to other modules by a conductive dowel(s) and preferably electrical contact between the 3 holder tube end surfaces, the wires will be in contact with the conductive portions of the adjacent modules. The two spirals 2114, 2114' may be two separate spirals that are individually connected to the holder tube, wherein their inner ends may optionally protrude far enough into the holder tube to be stops, that is, surfaces that limit how far into the holder tube the dowels may be pushed. Or, the two spirals 2114, 2114' may be end portions of a single spiral piece that extends all the way through the holder tube, for example, continuously through the holder tube, again serving as a stop/limit for the dowels inside the passageway of the tube holder.

Figure 53A:
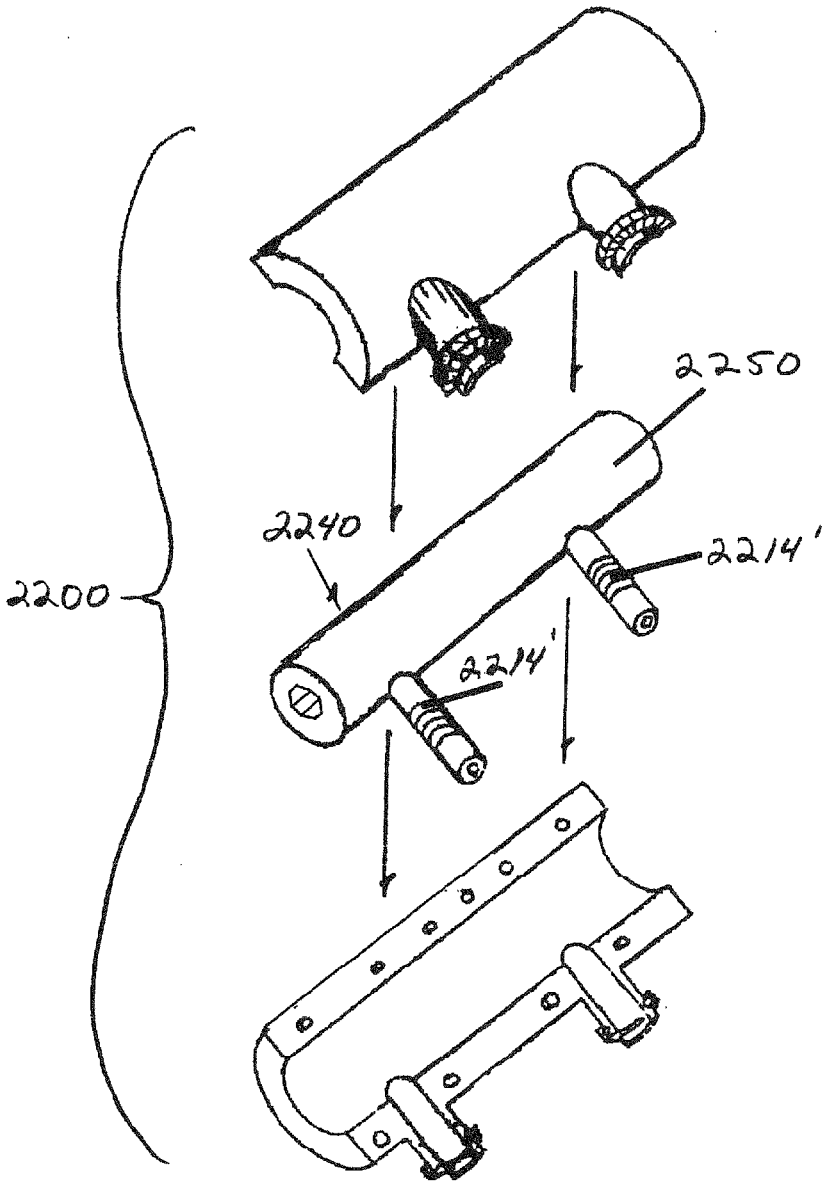
FIGS. 53A and B are perspective exploded views, each of selected portions of a module such as shown in FIG. 48.
Figure 53B:
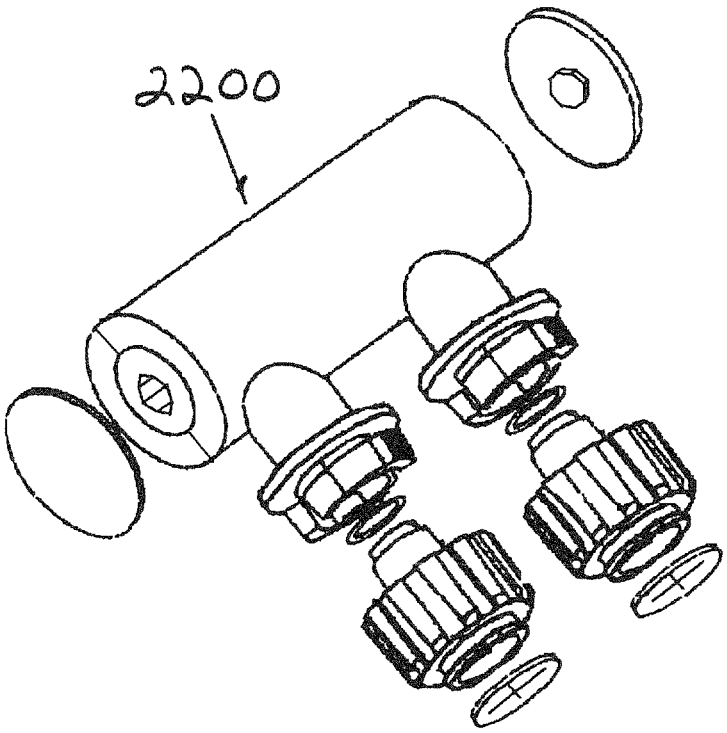
Figure 54:
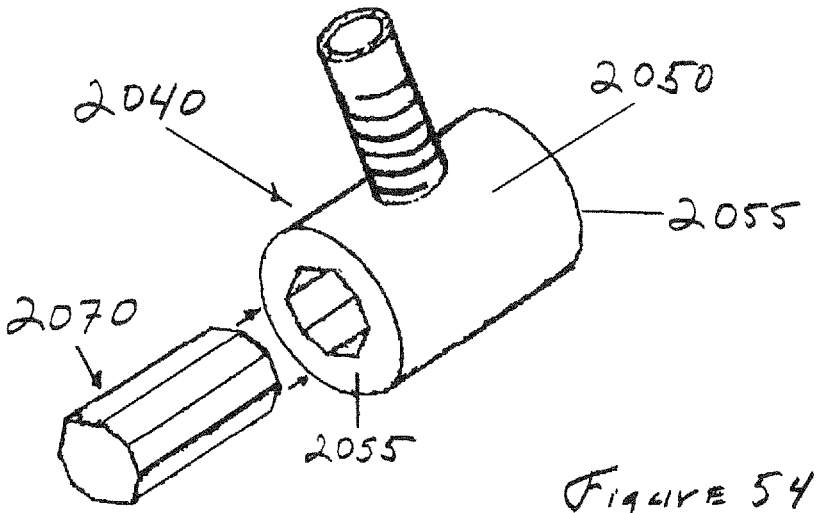
FIG. 54 is perspective view of one embodiment of a holder tube/insert (removed from a connector) having one spiral and being connected to one embodiment of a dowel for modular connection of multiple connectors.

FIGS. 53A and B portray exploded views of a modular connector such as connector 2200, with its two side-by-side ports. The spiral unit 2240 in this connector comprises a holder tube 2250 with two side-by-side spirals 2214, 2214' that extend out from the holder tube 2250 in a direction transverse to the longitudinal axis of the tube 2250. The spirals are preferably parallel to each other.

From the above description, one may see how to construct and use various modules according to certain embodiments of the invention. For example, while it is not shown in exploded view herein, connector 2300 will be understood to have a holder tube that has four spirals/spiral-unit-portions extending out from it to extend into the four ports. In a similar manner as described above for connector 2100, each pair of opposing spirals may be separate spirals, or may be portions of a single spiral that extends all the way through the holder tube.

Spirals may be welded or otherwise connected to each other and/or to the holder tube/insert, or may be formed integrally with the tube/insert. While exemplary relative sizes of the spiral(s) to the holder tube/insert are shown in the drawings, other relative sizes may be used. Also, while the spiral(s) are shown in the drawings as extending perpendicularly (90 degrees) to the length/axis of the holder tube/insert, other angles may be acceptable in certain embodiments, for example, wherein the axis of the spiral(s) extend at any angle in the range of about 10-90 degrees to the length/axis of the holder tube/insert. For ease of gripping and manipulation during tightening of the spiral(s), it is preferred that the axis of the spiral(s) extend at any angle in the range of 45-90 degrees and it is especially preferred that the axis of the spiral(s) extent at 80-90 degrees, to the length/axis of the holder tube/insert.

It should be noted that a portion of the spiral for each port is fixed to the holder tube/insert and/or the main body of the housing, or otherwise restrained from rotation. In certain embodiments, the inner (proximal ends) of the spirals are held stationary inside the housing by their attachment to the holder tube, without being fixed directly to the housing itself. In alternative embodiments, the spiral(s) inner (proximal) ends may be mechanically fixed to the main body of the housing, as long as an electrical connection is also provided between the spiral(s) for the desired electrical connection from the spirals to other modules. Thus, in certain embodiments, the shape of the holder tube/insert or alternative conductive members inside the housing may be altered from that shown.

In the modules drawn in the Figures, the spiral inner ends are fixed to the holder tube/insert, which is shaped and received inside the main body of the housing so that the tube/insert (and hence the spiral inner ends) will not rotate when the outer ends of the spirals are rotated. A user holding the main body of the housing in one hand may thus use the other hand to rotate the endcap (and hence an outer end of a spiral) relative to the main body to tighten the spiral.

In certain embodiments, both the passageway in the preferred holder, and the preferred dowel that is inserted into or otherwise resides in the passageway, are mating polygonal shapes. This will prevent connected modules from rotating relative to each other, that is, each or any of the modules rotating on its housing main body longitudinal axis relative to the other modules of a device configuration. The polygon shape shown is an octagon shape for both passageway and dowel, but others may be used, such as hexagon, pentagon, or rectangular, or other non-circular shapes. Also because of the preferred polygonal connection, modules may be connected together at various "rotational angles" relative to each other. For example, all the ports of the three modules connected in FIG. 50 are generally co-planar, that is, the longitudinal axis of all the ports is on a single plane. But one or more of the modules could be connected to the others so not all the ports are generally co-planar. For example, any module of the assembly could be rotated relative to the others, before connection of the modules, in some increment of 45 degrees (the dowel and passageway polygon shape being 8-sided). Or, for example, one module could be 45 degrees from the next, and that module could be 90 degrees from the next. If the outer surface of the dowel and the inner surface of the passageway is an octagon, then ports of one module may extend at 45 degrees, at 90 degrees, at 135 degrees, or at 180 degrees from other modules' ports, for example. If the outer surface of the dowel and the inner surface of the passageway is a hexagon, then ports may extend at 60 degrees, at 120 degrees, or at 180 degrees from other modules' ports. This may be convenient for electricians that need to make a connection between wires/cables that are extending from/to different locations, for example, one extending horizontally and another extending vertically, in which a 90 degree connection would be ideal and would be possible and convenient with the invented modular block connector.

Alternatively, the dowel(s) or other protruding elongated member(s) may be permanently affixed to modules, and therefore, not removable. This way, the dowels would not be "loose parts". Non-removable dowels are less preferred, however, as female modules without dowels would also have to be made to allow mating of male modules and the female modules. Also, in order to cover the ends of the male and also the female modules, the cover plate and/or other covers would need to be adapted to provide either two styles or one larger or more complex style that could cooperate with both types of modules.

Various materials may be used for the connectors described herein. For example, housings, including main bodies and ends, may be various electrically-insulating polymer or composites. Especially-preferred housing materials are glass-filled polymers such as 10% glass filed ABS. Electrically-conductive portions, such as spirals, holder tubes or other inserts, and dowels or other electrically-conductive fasteners may be various conductive materials, such as copper, including but not limited to CU120, or other low-oxidation, low-rust, and high-conduction metals, alloys and compositions. O-rings and dust covers may be rubber or neoprene, for example. It will be understood by those of skill in the arts that various fasteners, welding, sonic welding, plastics-joining, metal-joining, adhesives, press-fit techniques, cutting, forming and molding techniques may be used to form the embodiment shown herein.

Additional adaptations may be made in certain embodiments to maintain the spiral(s) in a tightened condition. For example, selection of materials may prevent creep of plastic and/or other causes of possible loosening of the spiral over time and/or due to heating/cooling cycles. The latch/lock system materials may be selected for resilience or bias, so that the spiral is constantly urged into a tightened configuration to counteract heating or cooling effects that might otherwise loosen the spiral. Also, further adaptations of the spiral may be made to ensure tight and sure gripping of wire(s) and no or minimal hot-spots; for example, barbs or protrusions may extend from the spiral into the center space of the spiral to grip/engage wire(s) to an even greater extent when the spiral is tightened on the wire(s). Adhesives, expanding foam, or other chemicals that harden around at least portion of the spiral(s), after installation of wires into the connectors and after tightening of the spiral(s), are envisioned.

The simplicity of the preferred embodiments allows economical manufacture and use. For example, some embodiments of the invented connector may be described as comprising, consisting essentially of, or consisting only of, a spiral unit, a single housing portion, and a terminal end, wherein one or more wires with stripped ends are inserted into and tightened in the spiral. Other embodiments of the invented connector may be described as comprising, consisting essentially of, or consisting only of, a spiral unit, and two housing portions that may be twisted relative to each other, wherein multiple wires with stripped ends are inserted into and tightened in the spiral. Other embodiments may be described as comprising, consisting essentially of, or consisting of, a spiral unit, and three housing portions wherein multiple portions may be twisted relative to the others and preferably the two outer end housing portions are twisted simultaneously in opposite directions to tighten the spiral unit, wherein wires with stripped ends are inserted into each end of the connector and tightened in the spiral by said twisting of two of the housing portions. Other embodiments may be described as having modular capability and comprising, consisting essentially of, or consisting of, a spiral unit, and at least two housing portions that may be twisted relative to each other to tighten the spiral unit on the stripped ends of wires/cables that have been inserted into the connector, and electrically-conductive fastener(s) adapted to mechanically connect(s) two or more of the connectors to form a modular device configuration, and also electrically connect at least some of the spirals of said two or more connectors in the modular device configuration.

Certain embodiments may include moisture-proofing material and/or sealing materials located inside at least one of the housing portions. Moisture-proofing material may be heat-activatable or otherwise activatable to expand into empty spaces inside the connector, and optionally out from between the multiple housing portions, to block water and moisture from entering the connector. See FIG. 39C, for example. In addition or alternatively, sealing materials such as o-rings, gaskets, sealing glands, and/or housing opening covers may be placed between the wire/cable and the housing portion(s) when the wire/cable enters the connector and/or between the various portions of the housing. FIGS. 40-53B portray certain embodiments comprising o-ring(s) between the main body of the housing and the end portions of the housing, and covers over the openings into the housing end portions that may remain in place during and after wire/cable insertion. FIGS. 46-53B also portray certain embodiments of end plates that cover the openings into the housing main body of modular connectors. FIGS. 56-66 portray an especially-preferred butt-style connector 2300 that illustrates adaptations that may be applied to various embodiments for moisture-proofing or at least moisture-resistance. As is apparent from FIGS. 56-66, connector 2300 comprises many of the housing and spiral features discussed in detail above, including a spiral unit 2314, a housing main body 2313, and two housing end portions (or "end caps") 2312, 2312' having apertures 2332, 2332' for receiving wire/cable 2322, 2322' into the connector 2300, inner tubes 2342, 2342' that slide into the open ends of the main body 2313 and are fixed at their inner surfaces at or near F1 to the outer ends of the spiral unit 2314, and outer skirts 2343, 2343' that extend around the open ends of the main body 2313. As shown to best advantage in the exploded view of FIG. 58 and the cross-sections of 59 and 60, connector 2300 comprises two seals that reside between each of the housing end portions 2312, 2312' and the housing main body 2313. These seals are portrayed as o-rings 2360, 2360' provided on the outer circumference of the generally cylindrical inner tubes 2342, 2342' to form a seal between said inner tubes and the inner surface of the housing main body 2313, and o-rings 2361, 2361' provided on the outer circumference of the ends of main body 2313 to form a seal between the main body and the inner surface of the outer skirts 2343, 2343'. In addition, entry port assemblies 2345, 2345' are provided for connection to the end caps 2312, 2312' for sealing the entering wire/cable to the connector. Each entry port assemblies 2345, 2345' comprises a compression bushing 2346, 2346' and an antifriction washer 2347, 2347' captured between the end caps 2312, 2312' and the covers 2370, 2370'. The covers 2370, 2370' preferably threadably connect to the threaded ends 2371, 2371' end caps 2312, 2312', so that tightening the covers on the end caps after insertion of the wire/cable into the connector (through the passageway comprising the bore through the covers, washer, compression bushing, end cap, and into the spiral unit inside the main body of the housing) will push the bushing further into the end cap, compressing the bushing against the wire/cable to create a moisture-proof/resistant seal between the wire/cable and the bushing. The antifriction washer allows screwing-on the cover to the end cap in a smooth manner without undesired disruption of the position of the bushing, because the cover might otherwise stick to the rubber-like end surface of the compression bushing. Therefore, all possible entry points for moisture into connector 2300 are sealed/blocked.

Note that temporary holes through the main body 2313 are shown at F2, but these are holes for providing adhesive, bonding material or other access for fixing the central region of the spiral unit 2314 to the main body, wherein the holes are filled or otherwise sealed (see FIG. 65) after said fixing to prevent moisture from entering the connector. Note also that holes 2373 are shown in FIG. 66 and their location is indicated by F1' in FIG. 65; holes 2373 are one embodiment of an adaptation to allow for providing adhesive, bonding material or other access to the region noted as F1 in FIG. 59 for fixing the end if the spiral unit 2314, for example, the protruding portions 2315 of the spiral unit, to the end cap 2312, 2312'. Holes 2373 may be filled after the spiral is fixed to the end caps, or the compression bushing may be relied upon to prevent moisture from reaching the holes to travel to the spiral.

FIGS. 61-64 are provided to further illustrate operation of connector 2300. Upon insertion of the stripped end of the cable, one may see space surrounding the wires 2320 in FIG. 61. Upon grasping the outer skirt 2343' and turning it relative in the direction of the arrow in FIG. 61, one may see movement of teeth of the end cap against the ratchet arms 2350 and may see the tightening of the spiral unit 2314 against the wires in FIG. 62. This is further illustrated by the spiral unit 2314 surrounding the wires 2322 loosely (including not touching the wires, at gaps G) in FIG. 63, followed by at least some of the coils/wraps of the spiral unit 2314 contacting and compressing at least some portions of the wire 2320 at C in FIG. 64. Due to the cylindrical nature of the wires, and the twisted-wire nature of a cable, not all of the wires and not all portions of the outer wires may be directly contacted by the spiral unit, but the spiral unit will compress against at least portions of the outer wires, which will in turn compress the entire bundle of wires for an effective, large-surface-area electrical connection.

Figure 65:
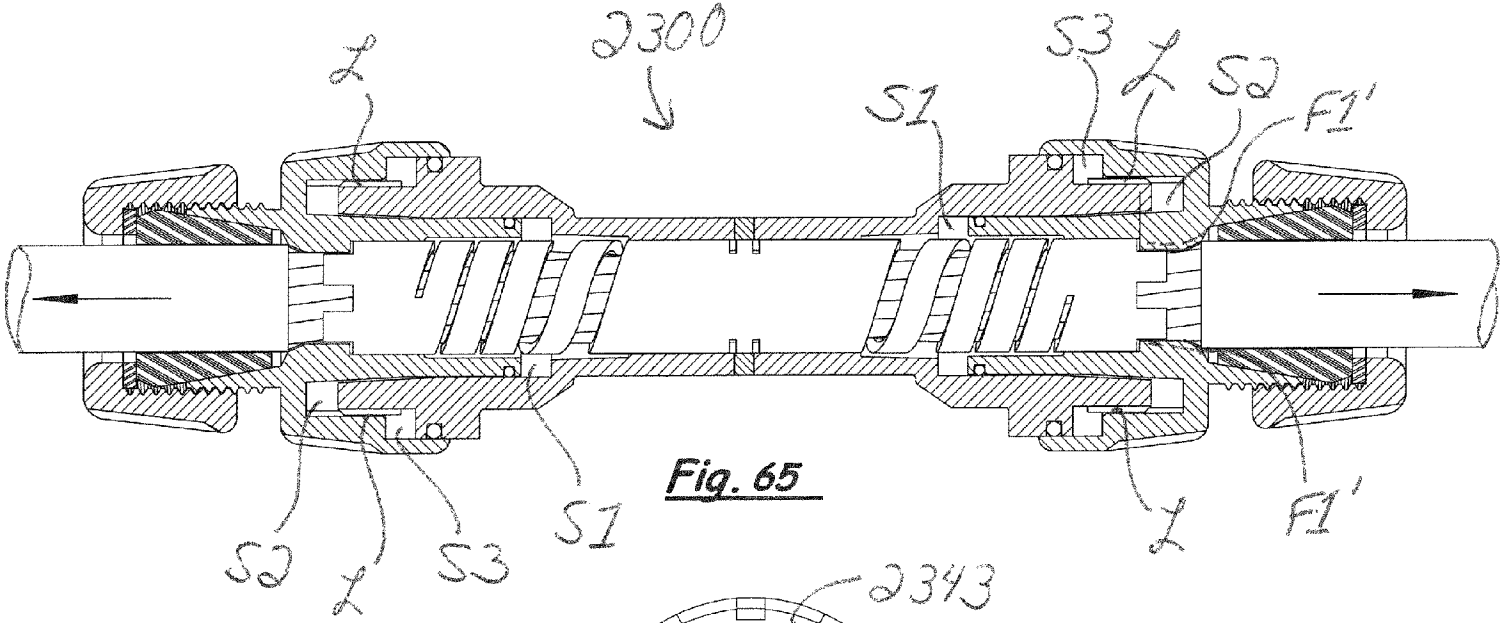
FIG. 65 is a longitudinal (axial) cross-sectional view of the connector of FIGS. 56-64, wherein the connector has been stretched from the cable being placed under extreme tension.
Figure 66:
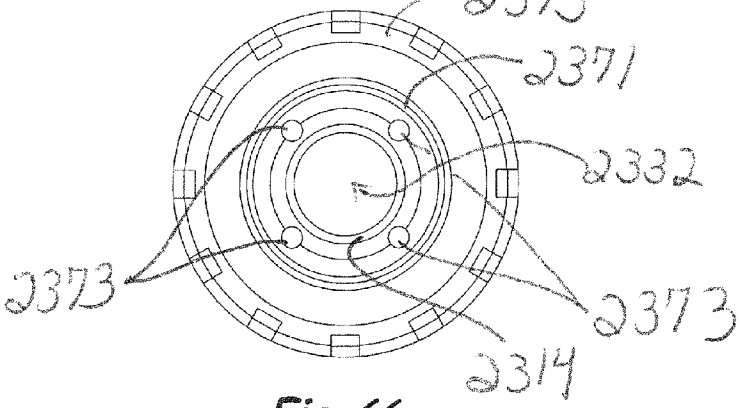
FIG. 66 is an end view of the connector of FIGS. 56-64, with the cover removed, illustrating how holes through the end cap may allow access to the area wherein the spiral unit is to be fixed to the end cap, for example, by injection of adhesive through the holes to the region wherein the protrusions of the spiral unit rest in mating recesses in the interior of the inner tube of the end cap.

FIG. 65 illustrates several adaptations that allow tension to be placed on certain embodiments of the connector and/or lengthening of the connector, without the connector failing. FIG. 65 illustrates connector 2300 stretched as a result of extreme tension, by the cables being pulled outward in the directions shown by the arrows, for example, by ground movement or other unusual force on the cables. Note that the spiral unit has stretched out to a greater length than that shown in FIGS. 59 and 60, increasing the gaps between at least some of the coils/wraps, but note that, if anything, this has tightened the grip of the spiral unit on the wires. Note that the end caps have slid outward relative to the main body of the housing, increasing the size of spaces S1, S2, and S3, but the o-rings and compression bushing are still in place and operative, and the ratchet-style portions of latch L are still in contact with each other and operative for their normal latching function. The seals and latch are specially adapted to remain effective even when the connector is stretched to a greater than normal length, due to their placement on longitudinal (axial) surfaces that are long enough to stay in contact even when they are shifted longitudinally relative to each other some distance, for example, a few millimeters up to a few centimeters or in certain embodiments 1 mm up to 10 cm. In the case of certain embodiments similar to connector 2300 being sized and designed as a 4/0 wire connector, there is a leeway for the seals and latch to move in the range of 1 cm up to 3 cm at each end of the connector. Thus, preferred embodiments are adapted to allow some lengthening of the spiral and/or of the entire connector without the connector breaking or becoming inoperative (that is, without the connector "failing"); some of the lengthening will normally occur in many embodiments during tightening of the spiral to capture the wire(s) and some may occur upon tensioning of the connector in an emergency or other unusual circumstances. Note that, in certain embodiments, the spiral unit will remain tightened on the wires due to its composition and physical properties, thus maintaining an effective electrical connection with the wires, even though stretched to an extreme (such as in FIG. 65) and even if the latches become unlatched due to over-stretching, breakage or other failure. Note that it may be said that the preferred latch(es) is/are adapted to prevent multiple housing portions from rotating in an opposite direction to relax the spiral to the relaxed configuration, and the latch comprises cooperating axially-extending ratchet teeth on multiple portions that engage to retain the spiral in a tightened configuration, said multiple portions being moveable apart a distance relative to each other in an axial direction, said ratchet teeth stay engaged to retain the spiral in tightened configuration. For example, assuming that the ratchet teeth of the multiple portions of the housing are axially aligned evenly with each other to start and are the same length, it may be said generally that as long as the distance moved by the multiple portions is shorter than the length of the ratchet teeth, the ratchet teeth, and hence the latch, will stay engaged and latched.

Figure 67:
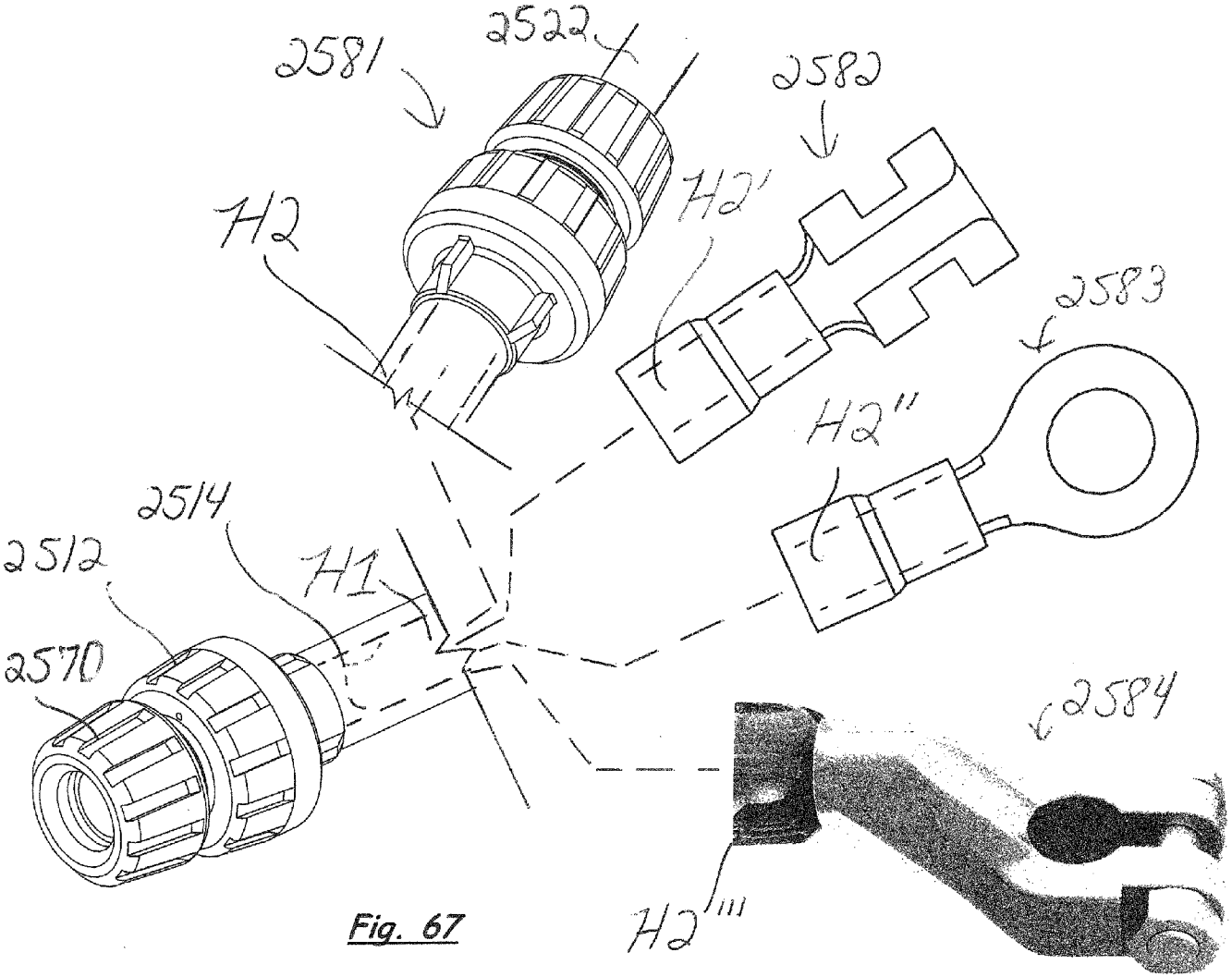
FIG. 67 is an "exploded view" of some but not all of the various options that may be installed, with both electrical and mechanical connection, on a spiral connector end similar to a portion of the connector of FIGS. 56-65.

FIG. 67 calls attention to a particularly-beneficial adaptation of certain embodiments, wherein a spiral unit may be connected to many different types of structure. In FIG. 67, one may see a connector end 2500, similar or the same as one half of connector 2300 shown in FIGS. 56-66, having a spiral unit 2514 inside a housing main body H1, an end cap 2512, and a cover 2570. The spiral unit and housing main body are cut/broken at the right end, and dashed lines are provided, to emphasize that many different structures may be mechanically and electrically connected to this connector end 2500. For example, another similar connector 2581 may be mechanically and electrically connected to connector end 2500, wherein a spiral unit inside connector 2581 captures a cable 2522 and may be electrically connected to the spiral 2514 by virtue of the spirals being coaxial and sliding one-into-the other, or by other mating cooperation. The housing H1 of connector 2500 may also connect to the housing H2 of connector 2581, for example by housing prongs or other housing protrusions (not shown) extending from H1 and snapping into or otherwise mating with slots or other receiving structure (not shown) of H2, wherein this mechanical housing mating/connection preferably occurs at the same time the spirals of 2500 and 2581 meet and mate. Alternatively, other structure, such as terminal ends 2582, 2583, and 2584, may be connected to connector end 2500, as in the integral/permanent connections discussed earlier in this document, or with a sliding or other mating connection of conductive structure in the terminal end to the spiral 2514 and optionally a snap-together or other mechanical mating connection of the housing H1 of connector end 2500 to the housings H2', H2", and H2'" (for terminal ends 2582, 2583, 2584, respectively). Thus, it will be understood that electrical and mechanical connections between the connector end 2500 and the other opposing ends (2581-2584) or other optional opposing ends may be permanent, semi-permanent (detachable but with significant effort or tools), or easily detachable. Embodiments such as connector end 2500 plus connector 2581, with a snap-together, prong- and slot-based housing connection, may be especially useful for photovoltaic connectors, for example. Embodiments such as connector end 2500 plus terminal end 2584, which is a battery terminal, may be especially useful for electrical connections to battery posts, for example.

Figure 68:
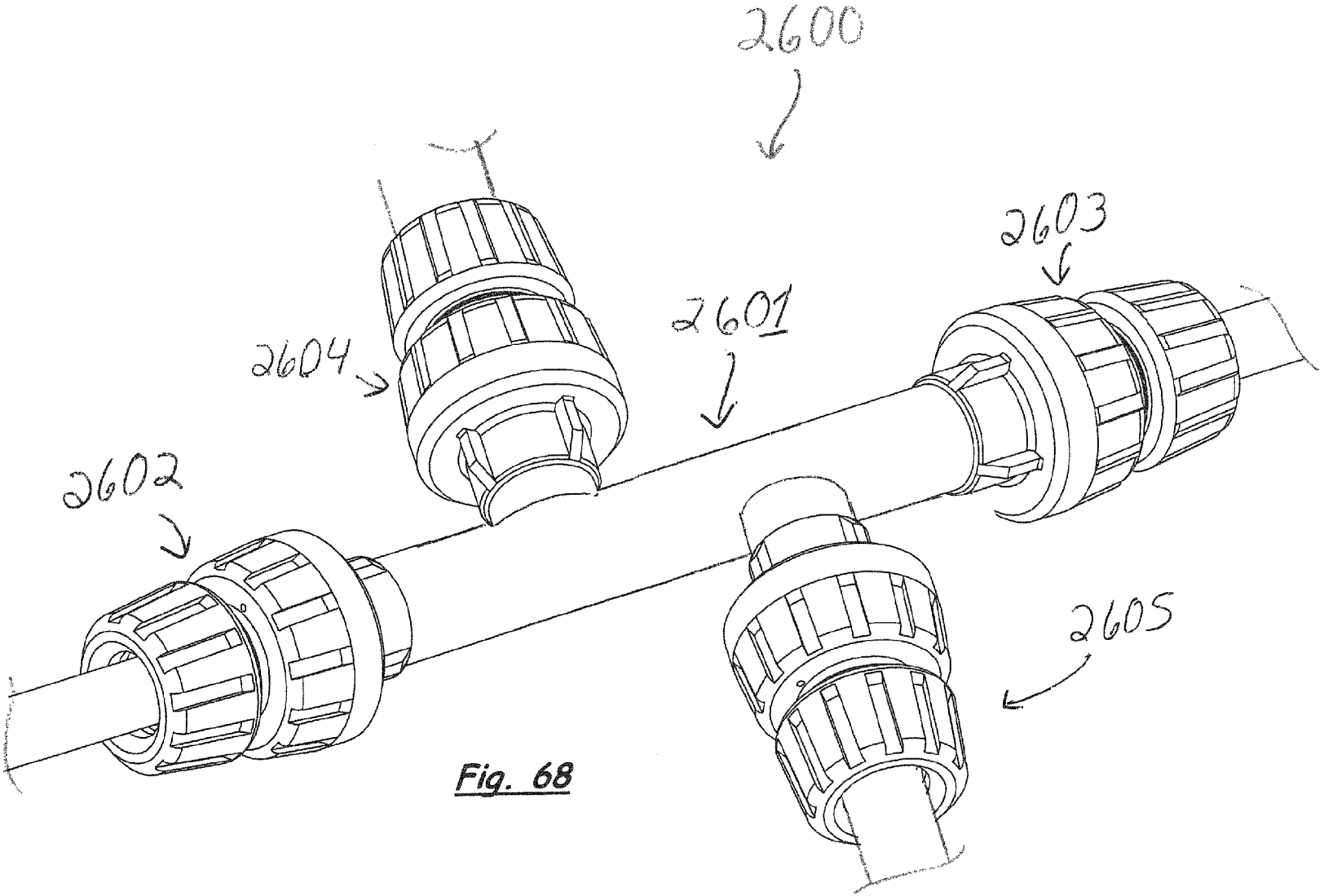
FIG. 68 is a perspective view of an alternative connector having a total of four spiral ports for connection of multiple wires/cables.

FIG. 68 calls further attention to the adaptability of certain embodiments, wherein multiple electrical connections may be made by a connector having multiple spiral coils and ports for insertion of wire(s)/cable(s). Connector 2600 comprises a main portion 2601 (with ports 2602 and 2603) the same or similar to connector 2300 in FIGS. 56-66, but with two additional ports 2604, 2605 extending transversely from that main portion for connection of additional wire(s)/cable(s) to the conductive spirals inside the main portion. This may be likened to a modular approach, discussed earlier in this document, with spiral connectors being provided at the ends of the housing main body rather than connective dowels. As one may understand from this disclosure and the drawings, many different configurations of such a modular approach may be used.

Although this invention has been described in this document and in the drawings with reference to particular means, materials and embodiments, it is to be understood that the invention is not limited to these disclosed particulars, but extends instead to all equivalents within the broad scope of the following claims.

The invention claimed is:

1. A connector for electrically-conductive wires, the connector comprising:

an electrically-conductive first spiral being twistable from a relaxed configuration having a relaxed diameter to a tightened configuration having a tightened diameter that is smaller than the relaxed diameter; and an electrically-insulating first housing adapted to receive electrically-conductive wire extending into the first spiral through a first housing port, the first housing comprising multiple housing portions connected to different regions of the first spiral so that relative rotation of the multiple housing portions tightens the first spiral into said tightened configuration so that the first spiral electrically connects to the wire; and wherein the first housing further comprises a latch means adapted to prevent said multiple housing portions from rotating in an opposite direction to relax the spiral to the relaxed configuration.

2. A connector as in claim 1, further comprising seals between said multiple housing portions for limiting or preventing moisture from entering the connector.

3. A connector as in claim 1, further comprising a compression bushing in the first housing port for limiting or preventing moisture from entering the connector along the wire.

4. A connector as in claim 1, further comprising a terminal end electrically connected to said first spiral and extending out beyond the first housing.

5. A connector as in claim 4, wherein the terminal end is a battery terminal.

6. A connector as in claim 1, further comprising a second spiral in a second housing port of the first housing, the second spiral being electrically connected to said first spiral, said second spiral being adapted to tighten to a tightened configuration to capture and electrically connect additional wire.

7. A connector as in claim 6, further comprising a second spiral in a second housing, the second spiral being adapted to receive additional wire through a port of the second housing and to tighten to capture and electrically connect to the additional wire, wherein the first housing and second housing are detachably mechanically connectable and the second spiral is detachably electrically connectable to said first spiral for electrically connecting wire in the first spiral and wire in the second spiral.

8. A connector as in claim 7, further comprising an electrically-conductive fastener that both detachably mechanically connects the first and second housings and also detachably electrically connects the first and second spirals.

9. A connector for electrically-conductive wires, the connector comprising:

an electrically-conductive first spiral being twistable from a relaxed configuration having a relaxed diameter to a tightened configuration having a tightened diameter that is smaller than the relaxed diameter; and an electrically-insulating first housing adapted to receive electrically-conductive wire extending into the first spiral through a first housing port, the first housing comprising multiple housing portions connected to different regions of the first spiral so that relative rotation of the multiple housing portions tightens the first spiral into said tightened configuration so that the first spiral electrically connects to the wire; and wherein the first housing further comprises a latch adapted to prevent said multiple housing portions from rotating in an opposite direction to relax the spiral to the relaxed configuration, and wherein the latch comprises cooperating axially-extending ratchet teeth on said multiple portions of the first housing that engage to retain the first spiral in a tightened configuration, wherein, when said multiple portions of the first housing move apart a distance relative to each other in an axial direction, said ratchet teeth stay engaged to retain the first spiral in tightened configuration.

10. A connector as in claim 9, further comprising seals in sealing engagement between the multiple portions of the housing for limiting moisture entry into the connector, wherein said seals stay in sealing engagement when said multiple portions move apart said distance.

11. A connector as in claim 9, wherein said distance that the multiple portions of the housing move apart in an axial direction is in the range of 1-3 cm long.

12. A connector as in claim 11, wherein the ratchet teeth are 1-3 cm long.

13. A connector as in claim 9, further comprising a compression bushing in the first housing port.

14. A connector as in claim 10, further comprising a compression bushing in the first housing port and the bushing having a central passageway adapted to receive wire being installed into the first port.

* * * * *